US011380154B2

(12) United States Patent
Yamamiya

(10) Patent No.: US 11,380,154 B2
(45) Date of Patent: Jul. 5, 2022

(54) COIN EJECTION APPARATUS CAPABLE OF PREVENTING INCORRECT EJECTION

(71) Applicant: ASAHI SEIKO CO., LTD., Tokyo (JP)

(72) Inventor: Takahito Yamamiya, Saitama (JP)

(73) Assignee: ASAHI SEIKO CO., LTD., Tokyo (JP)

( * ) Notice: Subject to any disclaimer, the term of this patent is extended or adjusted under 35 U.S.C. 154(b) by 282 days.

(21) Appl. No.: 16/803,115

(22) Filed: Feb. 27, 2020

(65) Prior Publication Data

US 2020/0286319 A1 Sep. 10, 2020

(30) Foreign Application Priority Data

Mar. 4, 2019 (JP) ..... JP2019-038142

(51) Int. Cl.
*G07D 1/00* (2006.01)

(52) U.S. Cl.
CPC ..... *G07D 1/00* (2013.01); *G07D 2201/00* (2013.01)

(58) Field of Classification Search
CPC ..... G07D 1/00; G07D 2201/00
See application file for complete search history.

(56) References Cited

U.S. PATENT DOCUMENTS

| | | | | |
|---|---|---|---|---|
| 8,973,457 | B2 | 3/2015 | Yamaoka | |
| 2002/0146975 | A1* | 10/2002 | Seagle | G07F 17/32 453/57 |
| 2003/0024790 | A1* | 2/2003 | Quattrini | G07F 11/04 453/58 |

FOREIGN PATENT DOCUMENTS

| | | | |
|---|---|---|---|
| GB | 1 445 089 | | 8/1976 |
| JP | 4005869 | B2 | 11/2007 |
| JP | 5265046 | B1 | 8/2013 |
| JP | 6182787 | B2 | 8/2017 |

OTHER PUBLICATIONS

Extended European Search Report issued in EP 20159458, dated Jul. 22, 2020.

* cited by examiner

*Primary Examiner* — Thien M Le
*Assistant Examiner* — Asifa Habib
(74) *Attorney, Agent, or Firm* — Greenblum & Bernstein, P.L.C.

(57) ABSTRACT

A coin ejection apparatus makes it possible to surely prevent incorrect dispensing due to incorrect normal rotation of a rotary disk or disks in one or more coin ejection units in a non-driving state while permitting normal and reverse rotations of the disk in a driving state. An unnecessary rotation prevention mechanism has a prevention member that prevents unnecessary rotation of the disk in the non-driving state. Engagement/disengagement of the prevention member with a coupling gear is switched responsive to shift between the driving state and the non-driving state. When the relevant coin ejection unit is in the driving state, the prevention member and the coupling gear are disengaged, permitting normal and reverse rotations of the disk. When the relevant coin ejection unit is in the non-driving state, the prevention member and the coupling gear are engaged, preventing incorrect normal rotation of the disk to result in incorrect dispensing.

20 Claims, 29 Drawing Sheets

(CAM END = DIAGONALLY DOWNWARD RIGHT)
(COUPLING GEAR = NON-COUPLED)

(CAM END = DIAGONALLY UPWARD RIGHT)
(COUPLING GEAR = NON-COUPLEED)

(CAM END = DIAGONALLY UPWARD LEFT)
(COUPLING GEAR = NON-COUPLED)

(CAM END = DIAGONALLY DOWNWARD LEFT)
(COUPLING GEAR = COUPLED)

NON-COUPLED STATE
(NON-COUPLING POSITION)

COUPLED STATE
(COUPLING POSITION)

COIN EJECTION APPARATUS CAPABLE OF PREVENTING INCORRECT EJECTION

BACKGROUND OF THE INVENTION

1. Field of the Invention

The present invention relates to a coin ejection apparatus having one or more coin ejection units which is/are switchable between a driving state and a non-driving state in response to instructions. More particularly, the present invention relates to a coin ejection apparatus capable of surely preventing incorrect coin ejection to result in incorrect dispensing from one or more coin ejection units in a non-driving state.

In this specification, the term "coin" has a wide meaning that includes not only coins as currency but also coin equivalents such as tokens and medals other than coins as currency, in which the shape of a "coin" is not limited to a circular one and may be a polygonal or any other one.

2. Description of the Related Art

Conventionally, multi-unit coin ejection apparatuses having a plurality of coin ejection units have been known. For example, Japanese Examined Patent Publication No. 6182787 issued on Aug. 4, 2017 discloses a multi-unit coin ejection apparatus, which comprises a plurality of coin ejection units and a plurality of coin storing containers respectively placed on the coin ejection units. Each of the coin ejection units is configured in such a way that coins stored in a corresponding one of the coin storing containers are ejected by a rotating disk placed just below the said container through a corresponding coin outlet. The coin ejection units, which are assigned to the respective denominations of coins, are driven in synchronization with each other by a single motor. When a dispensing instruction is received, coins of one or more necessary denominations for the instruction are ejected from one or more of the coin ejection unit. In each of the coin ejection units, the control for selectively ejecting one or more coins of the assigned denomination in response to a dispensing instruction is realized by a shutter provided near the coin outlet. The shutter is formed by a passage preventing member provided movably in a through hole of the disk. The passage preventing member is configured in such a way as to protrude from the surface of the disk and to sink below the same. When preventing the coin ejection, the passage preventing member is moved to protrude from the surface of the disk. When permitting the coin ejection, the passage preventing member is moved to sink below the surface of the disk. In this way, the control for selectively ejecting one or more coins of the assigned denomination in each of the coin ejection units in response to a dispensing instruction is realized using the corresponding shutter.

The coin ejection units are arranged along a straight line on the mounting surface of a chassis provided in a base section. The coin ejection units are selectively driven by transmitting the rotational driving force of a single motor to a desired one of the coin ejection units in response to an instruction by way of a driving mechanism which is provided in the chassis.

Japanese Examined Patent Publication No. 4005869 issued on Aug. 31, 2007 discloses a game machine having a hopper unit (which is equivalent to a coin ejection unit) in which a rotatable disk is provided. A lock pin is provided in such a way as to be movable by a magnetic force of a solenoid and to be engageable with an engagement part (e.g., a hole or depression) of the disk. The rotation of the disk is stopped by engaging the lock pin with the engagement part, thereby preventing incorrect dispensing of medals or coins.

Japanese Examined Patent Publication No. 5265046 issued on May 10, 2013 discloses a hopper-type medal ejection apparatus having a rotary disk for ejecting medals and a medal ejection runner for guiding medals in a predetermined direction and counting the medals thus ejected. The medal ejection runner comprises a cylindrical shaft having elongated protrusions on its outer surface (which are similar to gear teeth), and a claw member which are engageable with the elongated protrusions. The combination of the elongated protrusions and the claw member constitutes a ratchet mechanism that prevents the reverse rotation of the cylindrical shaft.

With the aforementioned multi-unit coin ejection apparatus disclosed in Publication No. 6182787, since the coin ejection units, which are assigned to the respective denominations of coins, are driven by a single motor in synchronization with each other, there is an advantage that the cost for the motor can be reduced compared with the case where each of the coin ejection units is driven by its own motor. However, in the one or more coin ejection units which is/are not driven by the driving mechanism formed in the chassis, the disk(s) provided in the one or more coin eject ion units is/are separated from the driving mechanism and is/are rotatable freely. Thus, there are a possibility that unintentional normal rotation of the rotary disk(s) usually occurs due to vibration or the like which is induced by a coin ejection operation in the coin ejection unit which is being driven by the driving mechanism and/or vibration or the like applied from the outside of the said coin ejection unit. If such the unintentional normal rotation occurs, one or more coins stored in the one or more coin ejection units in the non-driving state is/are ejected incorrectly (i.e., incorrect ejection) to result in incorrect dispensing.

The aforementioned problem of incorrect coin ejection and incorrect dispensing in the one or more coin ejection units in the non-driving state which is likely to occur in the multi-unit coin ejection apparatus of Publication No. 6182787 will occur in any multi-unit coin ejection apparatus also including the apparatus of Publication No. 6182787, if it has a mechanism or structure that the coin ejection units are selectively driven using a single motor in response to instructions and that only desired one of the coin ejection units is connected to the driving mechanism for selectively driving the same.

The aforementioned problem of incorrect coin ejection and incorrect dispensing in the one or more non-driven coin ejection units can be solved by using the mechanism of Publication No. 4005869 that stops the rotation of the disk by engaging the lock pin with the engagement part of the disk using the magnetic force, thereby preventing incorrect dispensing of medals or coins. However, with this mechanism, an actuator such as a solenoid needs to be provided only for moving the lock pin and therefore, there arises a disadvantage that the means for solving the said problem is complicated and as a result, the production cost for this means is high.

With the ratchet mechanism of Publication No. 5265046 that prevents the reverse rotation of the cylindrical shaft using the elongated protrusions and the claw member, there is no need to provide an actuator such as a solenoid necessitated in the mechanism of Publication No. 4005869. For this reason, the aforementioned problem of incorrect coin ejection and incorrect dispensing in the one or more non-driven coin ejection units can be solved with a comparatively simple structure. However, with a multi-unit coin ejection apparatus having the mechanism or structure that the coin ejection units are selectively driven using a single motor in response to instructions and that only desired one of the coin ejection units is connected the driving mechanism for selectively driving the same, it is essential that the normal rotation of the disk(s) in the one or more coin ejection units in the non-driving state is/are stopped to prevent the incorrect coin ejection and incorrect dispensing, and that when one of the one or more non-driven coin ejection units is shifted to the driving state, both of the normal rotations of the disk for ejecting coins and the reverse rotation thereof for eliminating malfunction such as coin jam are possible. However, it is apparent that the ratchet mechanism of Publication No. 5265046 is unable to realize such the different operations as described here in the driving state and the non-driving state.

SUMMARY OF THE INVENTION

The present invention was created while taking the aforementioned circumstances into consideration.

Accordingly, an object of the present invention is to provide a coin ejection apparatus having one or more coin ejection units that enables one or more coin ejection units in a driving state to perform both of normal rotation of its rotary disk for ejecting desired coins and reverse rotation thereof for eliminating malfunction, and that enables the one or more coin ejection units in a non-driving state to surely prevent undesired normal rotation of its/their rotary disk or disks for incorrectly ejecting coins to result in incorrect dispensing, in the case where the one or more coin ejection units is/are selectively driven using a single motor in response to an instruction.

Another object of the present invention is to provide a coin ejection apparatus having one or more coin ejection units that can be switched between a state where both of normal rotation of a rotary disk for ejecting desired coins and reverse rotation thereof for eliminating malfunction are possible and a state where undesired normal rotation of a rotary disk or disks for incorrectly ejecting coins to result in incorrect dispensing is prevented by simply shifting one or more coin ejection units between a driving state and a non-driving state.

Still another object of the present invention is to provide a coin ejection apparatus having one or more coin ejection units that makes it possible to realize the function that both of normal rotation of a rotary disk for ejecting desired coins and reverse rotation thereof for eliminating malfunction are possible in a driving state and undesired normal rotation of a rotary disk or disks for incorrectly ejecting coins to result in incorrect dispensing is prevented in a non-driving state using only a mechanical structure.

A further object of the present invention is to provide a coin ejection apparatus having one or more coin ejection units that has the function that both of normal rotation of a rotary disk for ejecting desired coins and reverse rotation thereof for eliminating malfunction are possible in a driving state and undesired normal rotation of a rotary disk or disks for incorrectly ejecting coins to result in incorrect dispensing is prevented in a non-driving state is realized using only a mechanical structure which is simplified, produced at low cost, unlikely to malfunction, and likely to have desired durability.

The above objects together with others not specifically mentioned here will become clear to those skilled in the art from the following description.

According to a first aspect of the present invention, a multi-unit coin ejection apparatus is provided, which comprises:

a base having a mounting surface;

coin ejection units mounted on the mounting surface, each of the coin ejection units having a rotary disk;

a first motor commonly used for driving the coin ejection units;

a driving mechanism that is configured to drive the coin ejection units by transmitting a driving force of the first motor using gears;

a switching unit that is configured to switch a destination of the driving force of the first motor, thereby selectively driving a desired one of the rotary disks of the coin ejection units; and an unnecessary rotation prevention mechanism, provided in each of the coin ejection units, that is configured to prevent unnecessary normal rotation of a corresponding one of the rotary disks of the coin ejection units;

wherein the switching unit comprises (i) first coupling gears which are respectively provided for the coin ejection units, (ii) second coupling gears which are engageable with the corresponding first coupling gears and which are provided for the driving mechanism, and (iii) a coupling gear displacement mechanism that is configured to displace the second coupling gears between a coupling position and a non-coupling position;

the coupling gear displacement mechanism is operated in response to an instruction in such a way that a designated one of the coin ejection units is placed in a driving state where a designated one of the second coupling gears is disposed at the coupling position and that a remainder of the coin ejection units is/are placed in a non-driving state where a remainder of the second coupling gears is/are disposed at the non-coupling position;

the unnecessary rotation prevention mechanism comprises an unnecessary rotation prevention member that is formed to prevent the relevant rotary disk from normally rotating to result in incorrect coin ejection when the relevant coin ejection unit is placed in the non-driving state;

the unnecessary rotation prevention member is structured in such a way as to be engaged with the relevant first coupling gear or disengaged therefrom in response to displacement of the relevant second coupling gear between the coupling position and the non-coupling position;

when the relevant coin ejection unit is placed in the non-driving state, an engaging or engaged part (e.g., an engaging part 117*b*) of the unnecessary rotation prevention member is engaged with one or more engaged or engaging parts (e.g., an engagement hole 114*d*) of the relevant first coupling gear, thereby preventing normal rotation of the relevant rotary disk; and when the relevant coin ejection unit is placed in the driving state, the engaging or engaged part (e.g., the engaging part 117*b*) of the unnecessary rotation prevention member is disengaged from the one or more engaged or engaging parts (e.g., the engagement hole 114*d*) of the relevant first coupling gear, thereby permuting normal rotation and reverse rotation of the relevant rotary disk.

With the multi-unit coin ejection apparatus according to the first aspect of the present invention, as explained above, the coin ejection units, which are mounted on the mounting surface of the base, are structured in such a way that one of the coin ejection units is selectively driven by switching the transmission destination of the driving force of the commonly used first motor using the switching unit. The designated one of the coin ejection units thus driven by the transmitted driving force of the first motor ejects one or more coins of a corresponding denomination to the instruction using a corresponding one of the rotary disks. In this way, it is possible for the designated one of the coin ejection units to eject one or more coins of the desired denomination by selectively transmitting the driving force of the first motor to the desired one of the coin ejection units.

Moreover, the unnecessary rotation prevention mechanism, which is provided in each of the coin ejection units, comprises the unnecessary rotation prevention member that is formed to prevent the normal rotation of the relevant rotary disk to result in incorrect coin ejection when the relevant coin ejection unit is placed in the non-driving state. The unnecessary rotation prevention member is structured in such a way as to be engaged with the relevant first coupling gear or disengaged therefrom in response to displacement of the relevant second coupling gear between the coupling position and the non-coupling position. Thus, the unnecessary rotation prevention mechanism can be enabled or disabled by simply moving the relevant coin ejection unit between the driving state and the non-driving state, in other words, by simply moving the relevant second coupling gear between the coupling position and the non-coupling position, using the coupling gear displacement mechanism of the switching unit. Accordingly, the state where both of normal rotation and reverse rotation of the relevant rotary disk are possible (i.e., where the unnecessary rotation prevention mechanism is disabled) and the state where normal rotation of the relevant rotary disk is prevented (i.e., where the unnecessary rotation prevention mechanism is enabled) can be switched by simply moving the relevant second coupling gear between the coupling position and the non-coupling position.

Furthermore, when the relevant coin ejection unit is placed in the non-driving state where the relevant second coupling gear is disposed at the non-coupling position, the engaging or engaged part of the unnecessary rotation prevention member is engaged with the one or more engaged or engaging parts of the relevant first coupling gear, thereby preventing normal rotation of the relevant rotary disk. This means that the undesired normal rotation of the relevant rotary disk is surely prevented when the relevant coin ejection unit is placed in the non-driving state. Accordingly, undesired normal rotation of a relevant rotary disk or disks for incorrectly ejecting coins to result in incorrect dispensing, which is likely to be caused by vibration from the coin ejection unit placed in the driving state and/or that from outside of the said coin ejection unit, can be surely prevented when a remainder of the coin ejection units is/are in the non-driving state.

On the other hand, when the relevant coin ejection unit is placed in the driving state where the relevant second coupling gear is disposed at the coupling position, the engaging or engaged part of the unnecessary rotation prevention member is disengaged from the one or more engaged or engaging parts of the relevant first coupling gear, thereby permitting both of normal rotation and reverse rotation of the relevant rotary disk. This means that both of the normal and reverse rotations of the relevant rotary disk are permitted when the relevant coin ejection unit is placed in the driving state. Accordingly, both of normal rotation of a rotary disk for ejecting desired coins and reverse rotation thereof for eliminating malfunction are possible when a designated one of the coin ejection units is in the driving state.

As described above, with the multi-unit coin ejection apparatus according to the first aspect of the present invention which is structured in such a way that the coin ejection units are selectively driven using a single motor in response to an instruction, both of normal rotation of a rotary disk for ejecting desired coins and reverse rotation thereof for eliminating malfunction can be performed in a designated one of the coin ejection units which is in a driving state and at the same time, undesired normal rotation of a rotary disk or disks for incorrectly ejecting coins to result in incorrect dispensing can be surely prevented in a remainder of the coin ejection units which is/are in a non-driving state.

In addition, with the multi-unit coin ejection apparatus according to the first aspect of the present invention, the function that both of normal rotation of a rotary disk for ejecting desired coins and reverse rotation thereof for eliminating malfunction can be performed in a designated one of the coin ejection units placed in a driving state while surely preventing undesired normal rotation of a rotary disk or disks for incorrectly ejecting coins to result in incorrect dispensing in a remainder of the coin ejection units which is/are in a non-driving state is realized by switching the engagement/disengagement between the engaging or engaged part of the unnecessary rotation prevention member and the one or more engaged or engaging parts of the relevant first coupling gear. Moreover, since the state where both of normal rotation and reverse rotation of the relevant rotary disk are possible (i.e., the unnecessary rotation prevention mechanism is disabled) and the state where normal rotation of the relevant rotary disk is prevented (i.e., the unnecessary rotation prevention mechanism is enabled) can be switched by simply moving the relevant coin ejection unit between the driving state and the non-driving state using the switching unit, there is no need to provide a dedicated mechanism or device for switching these two states. Accordingly, the aforementioned function can be realized using only a mechanical structure.

Further in addition, it is sufficient for the aforementioned mechanical structure for realizing the aforementioned function to include the engaging or engaged part of the unnecessary rotation prevention member and the one or more engaged or engaging parts of the relevant first coupling gear. Moreover, it is unnecessary to provide a dedicated mechanism or device for switching between the state where both of normal rotation of a rotary disk for ejecting coins and reverse rotation thereof for eliminating malfunction can be performed and the state where the undesired normal rotation of the relevant rotary disk can be surely prevented. Accordingly, the aforementioned mechanical structure is simplified, produced at low cost, unlikely to malfunction, and likely to have desired durability.

In a preferred embodiment of the multi-unit coin ejection apparatus according to the first aspect of the present invention, each of the first coupling gears is formed by a first gear which has teeth and grooves formed on one side face thereof and which is fixed to a rotation shaft for the rotary disk of the relevant coin ejection unit, and each of the second coupling gears is formed by a second gear which has grooves and teeth formed on one side face thereof to be engageable respectively with the teeth and the grooves of the first gear and which is fixed to a relevant linking gear (e.g., a driven gear) of the driving mechanism.

In another preferred embodiment of the multi-unit coin ejection apparatus according to the first aspect of the present invention, each of the first coupling gears comprises teeth and grooves formed on one side face thereof and is fixed to a rotation shaft for the rotary disk of the relevant coin ejection unit;

the relevant first coupling gear comprises an engagement face on or in which the engaged or engaging parts are arranged annularly along a rotation direction of the relevant first coupling gear; and the engaging or engaged part of the unnecessary rotation prevention member is structured in such a way as to be engaged with any one of the engaged or engaging parts of the relevant first coupling gear when the relevant coin ejection unit is placed in the non-driving state.

In still another preferred embodiment of the multi-unit coin ejection apparatus according to the first aspect of the present invention, a function of a one-way clutch that permits only normal rotation of the relevant rotary disk is generated by engaging the engaging or engaged part of the unnecessary rotation prevention member with the one or more engaged or engaging parts which is/are formed on or in an engagement face of the relevant first coupling gear.

In a further preferred embodiment of the multi-unit coin ejection apparatus according to the first aspect of the present invention, in each of the coin ejection units placed in the non-driving state, a function of a one-way clutch that prevents only normal rotation of the relevant rotary disk is generated by engaging the engaging or engaged part of the relevant unnecessary rotation prevention member with the one or more engaged or engaging parts which is/are formed on or in an engagement face of the relevant first coupling gear; and when the relevant coin ejection unit is moved to the driving state from the non-driving state by the switching unit, the relevant unnecessary rotation prevention member is moved in such a way that the engaging or engaged part of the relevant unnecessary rotation prevention member is disengaged from the one or more engaged or engaging parts of the relevant first coupling gear due to displacement of the relevant second coupling gear to the coupling position from the non-coupling position; resulting in loss of the function of the one-way clutch;

In a further preferred embodiment of the multi-unit coin ejection apparatus according to the first aspect of the present invention, the relevant unnecessary rotation prevention member comprises a roller which is contactable with the relevant second coupling gear and rotatable thereon;

when one of the coin ejection units is moved to the driving state from the non-driving state by the switching unit, the relevant unnecessary rotation prevention member is moved by displacement of the relevant second coupling gear to the coupling position from the non-coupling position in such a way that the engaging or engaged part of the relevant unnecessary rotation prevention member is disengaged from the one or more engaged or engaging parts of the relevant first coupling gear, thereby permitting both of normal rotation and reverse rotation of the relevant rotary disk; and the roller which is in contact with the relevant second coupling gear is rolled with rotation of the relevant second coupling gear while permitting both of normal rotation and reverse rotation of the relevant rotary disk.

In a further preferred embodiment of the multi-unit coin ejection apparatus according to the first aspect of the present invention, the relevant unnecessary rotation prevention member comprises a spring having an elastic force that urges the engaging or engaged part of the relevant unnecessary rotation prevention member toward the relevant first coupling gear;

when the relevant coin ejection unit is placed in the non-driving state, the engaging or engaged part of the relevant unnecessary rotation prevention member is engaged with the one or more engaged or engaging parts of the relevant first coupling gear by the elastic force of the spring; and when the relevant coin ejection units is placed in the driving state, the engaging or engaged part of the relevant unnecessary rotation prevention member is disengaged from the one or more engaged or engaging parts of the relevant first coupling gear by displacement of the relevant second coupling gear to the coupling position from the non-coupling position against the elastic force of the spring, resulting in permission of both of normal rotation and reverse rotation of the relevant rotary disk.

In a further preferred embodiment of the multi-unit coin ejection apparatus according to the first aspect of the present invention; the coupling gear displacement mechanism comprises a camshaft which is rotationally driven by a second motor; wherein the camshaft has cams which are respectively assigned to the coin ejection units; and cam followers which are respectively engaged with the second coupling gears and which are displaceable by the corresponding cams;

wherein the second coupling gears are structured in such a way as to be displaced between the coupling position and the non-coupling position according to displacements of the corresponding cam followers which are respectively caused by rotations of the corresponding cams.

In a further preferred embodiment of the multi-unit coin ejection apparatus according to the first aspect of the present invention, there are provided with sensors that detect respectively rotational positions (or rotational angles) of the cams; and which one of the second coupling gears is disposed at the coupling position is judged based on the detected rotational positions (or rotational angles) of the cams using the sensors.

In a further preferred embodiment of the multi-unit coin ejection apparatus according to the first aspect of the present invention, detection members are fixed to the camshaft in a one-by-one correspondence to the cams;

sensors that detect respectively rotational positions of the detection members are provided at corresponding positions to the detection members; and which one of the second coupling gears is disposed at the coupling position is judged based on detection of the detection members by the corresponding sensors.

In a further preferred embodiment of the multi-unit coin ejection apparatus according to the first aspect of the present invention, there is provided with a switching unit displacement mechanism that is configured to displace the switching unit between a connection position where the driving force of the first motor is selectively transmittable to a designated one of the coin ejection units and a separation position where the driving force of the first motor is transmittable to none of the coin ejection units;

the switching unit displacement mechanism comprises an operating member (e.g., a lever 52) mounted on the base, and a moving member (e.g., a combination of an operating part 53 and a frame rocking member 54) that displaces mechanically the switching unit between the connection position and the separation position in response to a predetermined action applied to the operating member; and when a predetermined action is applied to the operating member in the state where the switching unit is disposed at the connection position, the switching unit is displaced to the separation position.

In a further preferred embodiment of the multi-unit coin ejection apparatus according to the first aspect of the present invention, when the switching unit is displaced to the separation position from the connection position using the switching unit displacement mechanism, the said apparatus is shifted to a non-operable mode where the driving force of the first motor is transmitted to none of the coin ejection units, wherein a desired one of the coin ejection units can be removed from the base; and when the switching unit is returned to the connection position from the separation position using the switching unit displacement mechanism, the said apparatus is shifted to an operable mode where the driving force of the first motor is selectively transmitted to a desired one of the coin ejection units.

In a further preferred embodiment of the multi-unit coin ejection apparatus according to the first aspect of the present invention, the operating member of the switching unit displacement mechanism comprises a manually operable lever which is mounted on the base;

the moving member of the switching unit displacement mechanism is structured in such a way as to be mechanically connected to the switching unit and to be moved by a manual operation applied to the lever; and when a predetermined manual operation is applied to the lever, the switching unit is displaced mechanically between the connection position and the separation position in response to the applied manual operation.

In a further preferred embodiment of the multi-unit coin ejection apparatus according to the first aspect of the present invention, the coupling gear displacement mechanism is structured in such a way as to be rockable around a shaft which is supported by the base; and an operable mode where the driving force of the first motor is selectively transmitted to a desired one of the coin ejection units and a non-operable mode where the driving force of the first motor is transmitted to none of the coin ejection units are switched by rocking the coupling gear displacement mechanism around the shaft.

In a further preferred embodiment of the multi-unit coin ejection apparatus according to the first aspect of the present invention, a non-operable mode where the driving force of the first motor is transmitted to none of the coin ejection units is provided in addition to an operable mode where the driving force of the first motor is selectively transmitted to a desired one of the coin ejection units are provided; and the coin ejection units are configured to be detachable from the base by sliding a desired one or ones of the coin ejection units along the mounting surface in the separation mode.

According to a second aspect of the present invention; a coin ejection apparatus is provided, which comprises:

a base having a mounting surface;

a coin ejection unit mounted on the mounting surface, the coin ejection unit having a rotary disk;

a first motor for driving the coin ejection unit;

a driving mechanism that is configured to drive the coin ejection unit by transmitting a driving force of the first motor using gears;

a switching unit that is configured to switch between a driving state where the driving force of the first motor is transmitted to the coin ejection unit and a non-driving state where the driving force of the first motor is not transmitted to the coin ejection unit, thereby selectively driving the coin ejection unit; and an unnecessary rotation prevention mechanism, provided in the coin ejection unit, that is configured to prevent unnecessary normal rotation of the rotary disk;

wherein the switching unit comprises (i) a first coupling gear which is provided for the coin ejection unit, (ii) a second coupling gear which is engageable with the first coupling gear and which is provided for the driving mechanism, and (iii) a coupling gear displacement mechanism that is configured to displace the second coupling gear between a coupling position and a non-coupling position;

the coupling gear displacement mechanism is operated in response to an instruction in such a way that the coin ejection unit is placed in the driving state where the second coupling gear is disposed at the coupling position or in the non-driving state where the second coupling gear is disposed at the non-coupling position; and the unnecessary rotation prevention mechanism comprises an unnecessary rotation prevention member that is formed to prevent the rotary disk from normally rotating to result in incorrect coin ejection when the coin ejection unit is placed in the non-driving state;

the unnecessary rotation prevention member is structured in such a way as to be engaged with the first coupling gear or disengaged therefrom in response to displacement of the second coupling gear between the coupling position and the non-coupling position;

when the coin ejection unit is placed in the non-driving state, an engaging or engaged part (e.g., an engaging part 117*b*) of the unnecessary rotation prevention member is engaged with one or more engaged or engaging parts (e.g., an engagement hole 114*d*) of the first coupling gear, thereby preventing normal rotation of the rotary disk; and when the coin ejection unit is placed in the driving state, the engaging or engaged part (e.g., the engaging part 117*b*) of the unnecessary rotation prevention member is disengaged from the one or more engaged or engaging parts (e.g., the engagement hole 114*d*) of the first coupling gear, thereby permitting normal rotation and reverse rotation of the rotary disk.

With the coin ejection apparatus according to the second aspect of the present invention, as explained above, the coin ejection unit, which is mounted on the mounting surface of the base, is structured in such a way that the coin ejection unit is selectively driven by transmitting the driving force of the first motor or not using the switching unit. The coin ejection unit thus driven by the transmitted driving force of the first motor ejects one or more coins of a denomination corresponding to an instruction using the rotary disk. In this way, it is possible for the coin ejection unit to eject one or more coins of the desired denomination by transmitting the driving force of the first motor to the coin ejection unit or not.

Moreover, the unnecessary rotation prevention mechanism, which is provided in the coin ejection unit, comprises the unnecessary rotation prevention member that is formed to prevent the normal rotation of the rotary disk to result in incorrect coin ejection when the coin ejection unit is placed in the non-driving state. The unnecessary rotation prevention member is structured in such a way as to be engaged with the first coupling gear or disengaged therefrom in response to displacement of the second coupling gear between the coupling position and the non-coupling position. Thus, the unnecessary rotation prevention mechanism can be enabled or disabled by simply moving the coin ejection unit between the driving state and the non-driving state, in other words, by simply moving the second coupling gear between the coupling position and the non-coupling position, using the coupling gear displacement mechanism of the switching unit. Accordingly, the state where both of normal rotation and reverse rotation of the rotary disk are possible (i.e., where the unnecessary rotation prevention mechanism is disabled) and the state where normal rotation of the rotary disk is prevented (i.e., where the unnecessary rotation prevention mechanism is enabled) can be switched by simply moving the second coupling gear between the coupling position and the non-coupling position.

Furthermore, when the coin ejection unit is placed in the non-driving state where the second coupling gear is disposed at the non-coupling position, the engaging or engaged part of the unnecessary rotation prevention member is engaged with the engaged or engaging parts of the first coupling gear, thereby preventing normal rotation of the rotary disk. This means that the undesired normal rotation of the rotary disk is surely prevented when the coin ejection unit is placed in the non-driving state. Accordingly, undesired normal rotation of a rotary disk for incorrectly ejecting coins to result in incorrect dispensing, which is likely to be caused by vibration from outside of the said coin ejection unit, can be surely prevented when the coin ejection unit is in the non-driving state.

On the other hand, when the coin ejection unit is placed in the driving state where the second coupling gear is disposed at the coupling position, the engaging or engaged part of the unnecessary rotation prevention member is disengaged from the one or more engaged or engaging parts of the first coupling gear, thereby permitting both of normal rotation and reverse rotation of the rotary disk. This means that both of the normal and reverse rotations of the rotary disk can be performed when the coin ejection unit is placed in the driving state. Accordingly, both of normal rotation of a rotary disk for ejecting desired coins and reverse rotation thereof for eliminating malfunction are possible when the coin ejection unit is in the driving state.

As described above, with the coin ejection apparatus according to the second aspect of the present invention, both of normal rotation of a rotary disk for ejecting desired coins and reverse rotation thereof for eliminating malfunction can be performed when the coin ejection unit is in a driving state, and undesired normal rotation of a rotary disk for incorrectly ejecting coins to result in incorrect dispensing can be surely prevented when the coin ejection unit is in a non-driving state.

In addition, with the coin ejection apparatus according to the second aspect of the present invention, the function that both of normal rotation of a rotary disk for ejecting desired coins and reverse rotation thereof for eliminating malfunction can be performed when the coin ejection unit is in a driving state while surely preventing undesired normal rotation of a rotary disk for incorrectly ejecting coins to result in incorrect dispensing when the coin ejection units is in a non-driving state is realized by switching the engagement/disengagement between the engaging or engaged part of the unnecessary rotation prevention member and the one or more engaged or engaging parts of the first coupling gear. Moreover, since the state where both of normal rotation and reverse rotation of the rotary disk are possible (i.e., the unnecessary rotation prevention mechanism is disabled) and the state where normal rotation of the rotary disk is prevented (i.e., the unnecessary rotation prevention mechanism is enabled) can be switched by simply moving the coin ejection unit between the driving state and the non-driving state using the switching unit, there is no need to provide a dedicated mechanism or device for switching these two states. Accordingly, the aforementioned function can be realized using only a mechanical structure.

Further in addition, it is sufficient for the aforementioned mechanical structure for realizing the aforementioned function to include the engaging or engaged part of the unnecessary rotation prevention member and the one or more engaged or engaging parts of the first coupling gear. Moreover, it is unnecessary to provide a dedicated mechanism or device for switching between the state where both of normal rotation of a rotary disk for ejecting coins and reverse rotation thereof for eliminating malfunction can be performed and the state where the undesired normal rotation of the rotary disk can be surely prevented. Accordingly, the aforementioned mechanical structure is simplified, produced at low cost, unlikely to malfunction, and likely to have desired durability.

In a preferred embodiment of the coin ejection apparatus according to the second aspect of the present invention, the first coupling gear is formed by a first gear which has teeth and grooves formed on one side face thereof and which is fixed to a rotation shaft for the rotary disk of the coin ejection unit, and the second coupling gear is formed by a second gear which has grooves and teeth formed on one side face thereof to be engageable respectively with the teeth and the grooves of the first gear and which is fixed to a linking gear (e.g., a driven gear) of the driving mechanism.

In another preferred embodiment of the coin ejection apparatus according to the second aspect of the present invention, the first coupling gear comprises teeth and grooves formed on one side face thereof and is fixed to a rotation shaft for the rotary disk;

the first coupling gear comprises an engagement face on or in which the engaged or engaging parts are arranged annularly along a rotation direction of the first coupling gear; and the engaging or engaged part of the unnecessary rotation prevention member is structured in such a way as to be engaged with any one of the engaged or engaging parts of the first coupling gear when the coin ejection unit is placed in the non-driving state.

In still another preferred embodiment of the coin ejection apparatus according to the second aspect of the present invention, a function of a one-way clutch that permits only normal rotation of the rotary disk is generated by engaging the engaging or engaged part of the unnecessary rotation prevention member with the one or more engaged or engaging parts which is/are formed on or in the engagement face of the first coupling gear.

In a further preferred embodiment of the coin ejection apparatus according to the second aspect of the present invention, when the coin ejection unit is placed in the non-driving state, a function of a one-way clutch that prevents only normal rotation of the rotary disk is generated by engaging the engaging or engaged part of the relevant unnecessary rotation prevention member with the one or more engaged or engaging parts which is/are formed on or in an engagement face of the relevant first coupling gear; and when the coin ejection unit is moved to the driving state from the non-driving state by the switching unit, the unnecessary rotation prevention member is moved in such a way that the engaging or engaged part of the relevant unnecessary rotation prevention member is disengaged from the one or more engaged or engaging parts of the first coupling gear due to displacement of the second coupling gear to the coupling position from the non-coupling position, resulting in loss of the function of the one-way clutch.

In a further preferred embodiment of the coin ejection apparatus according to the second aspect of the present invention, the unnecessary rotation prevention member comprises a roller which is contactable with the second coupling gear and rotatable thereon;

when the coin ejection unit is moved to the driving state from the non-driving state by the switching unit, the roller of the unnecessary rotation prevention member is moved by displacement of the second coupling gear to the coupling position from the non-coupling position in such a way that the engaging or engaged part of the relevant unnecessary rotation prevention member is disengaged from the one or more engaged or engaging parts of the first coupling gear, thereby permitting both of normal rotation and reverse rotation of the rotary disk; and the roller which is in contact with the second coupling gear is rolled with rotation of the second coupling gear while permitting both of normal rotation and reverse rotation of the rotary disk.

BRIEF DESCRIPTION OF THE DRAWINGS

In order that the present invention may be readily carried into effect, it will now be described in detail with reference to the accompanying drawings.

DETAILED DESCRIPTION OF THE INVENTION

Figure 1:
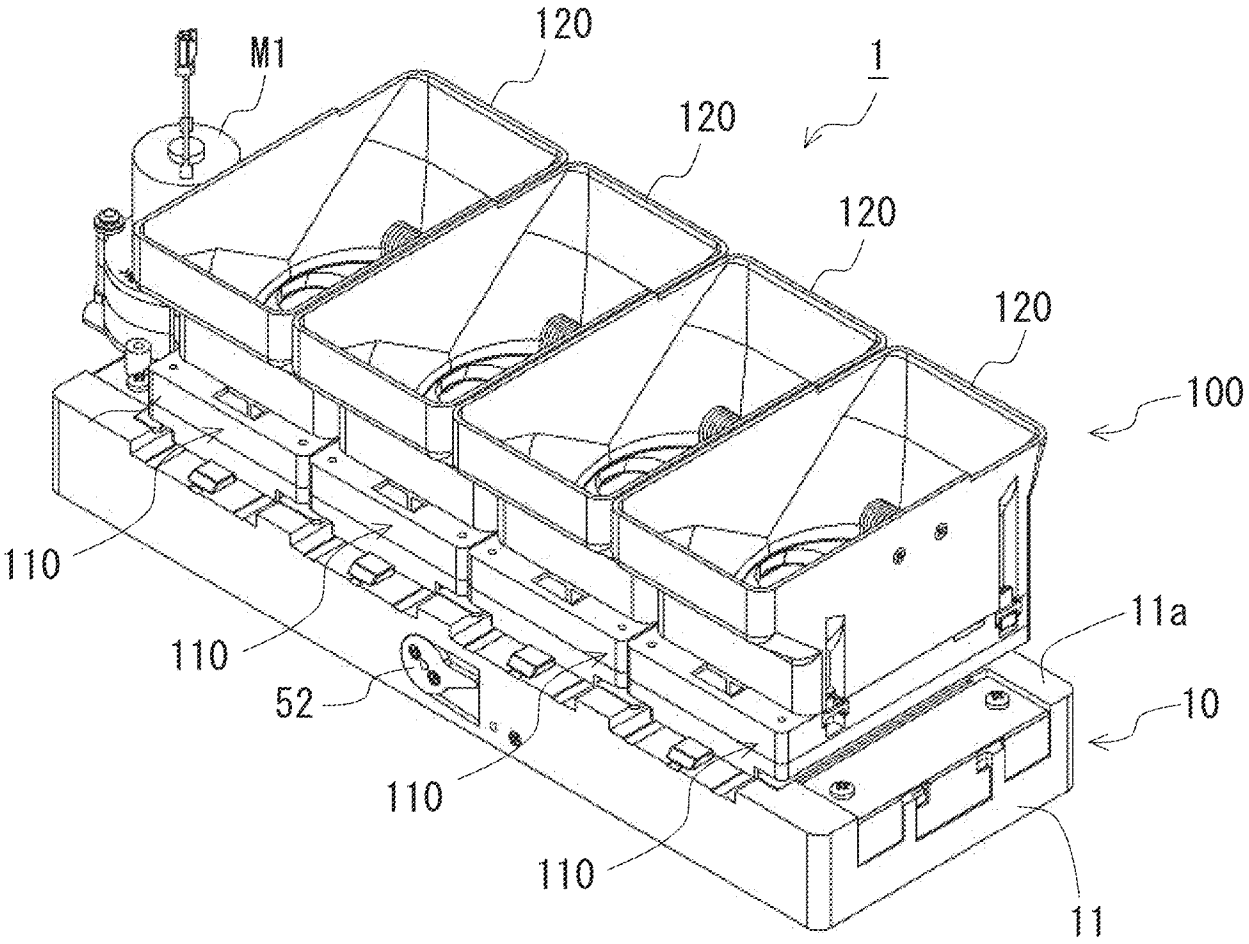
FIG. 1 is a perspective view showing the overall structure of a multi-unit coin ejection apparatus according to a first embodiment of the present invention, in which the state where lids of four coin storing containers are removed is shown.

Preferred embodiments of the present invention will be described in detail below while referring to the drawings attached.

First Embodiment

A multi-unit coin ejection apparatus 1 having four coin ejection units 110 according to a first embodiment of the present invention is shown in FIGS. 1 to 9.

Structure of Multi-Unit Coin Ejection Apparatus 1

Figure 2:
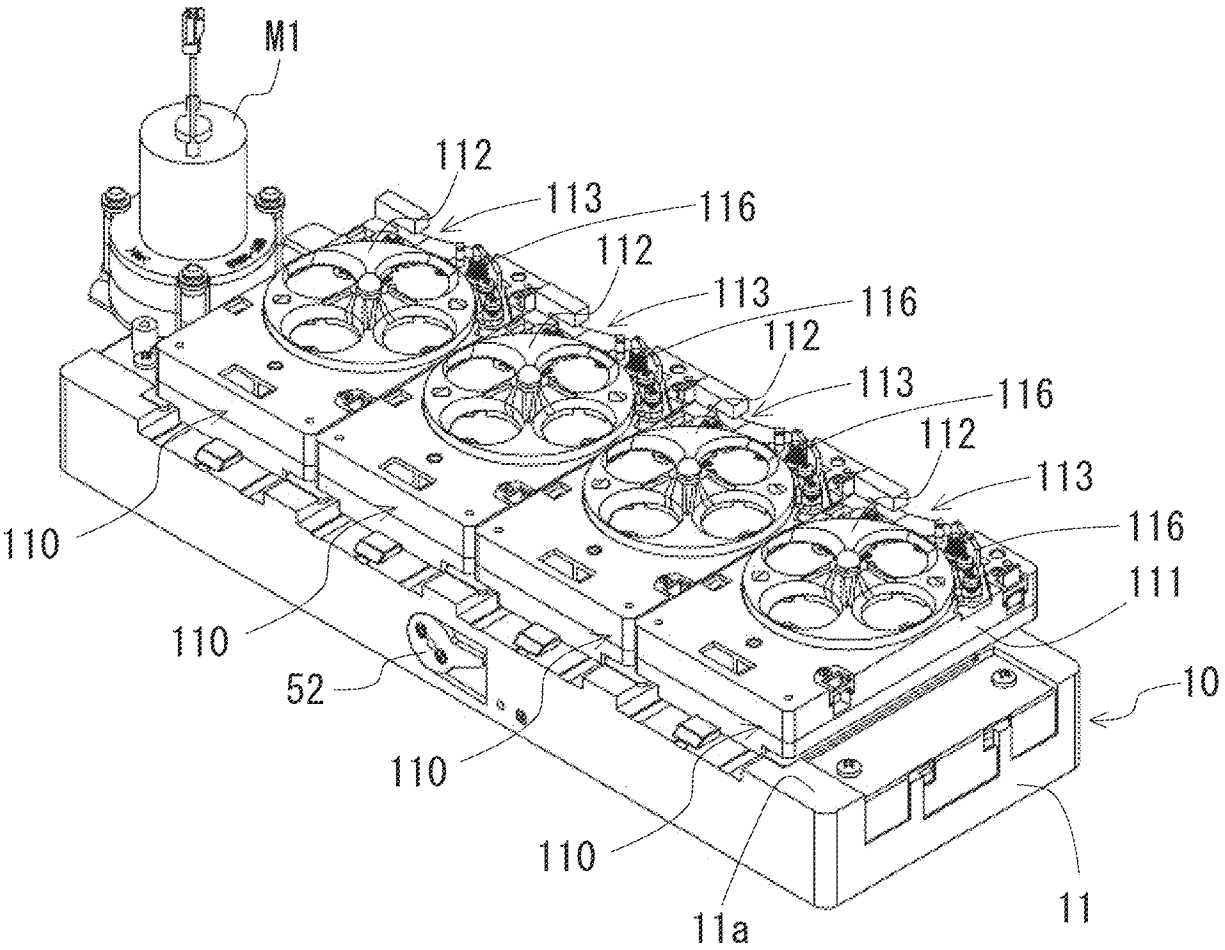
FIG. 2 is a perspective view showing the state where four coin storing containers are detached from the multi-unit coin ejection apparatus of FIG. 1.
Figure 3:
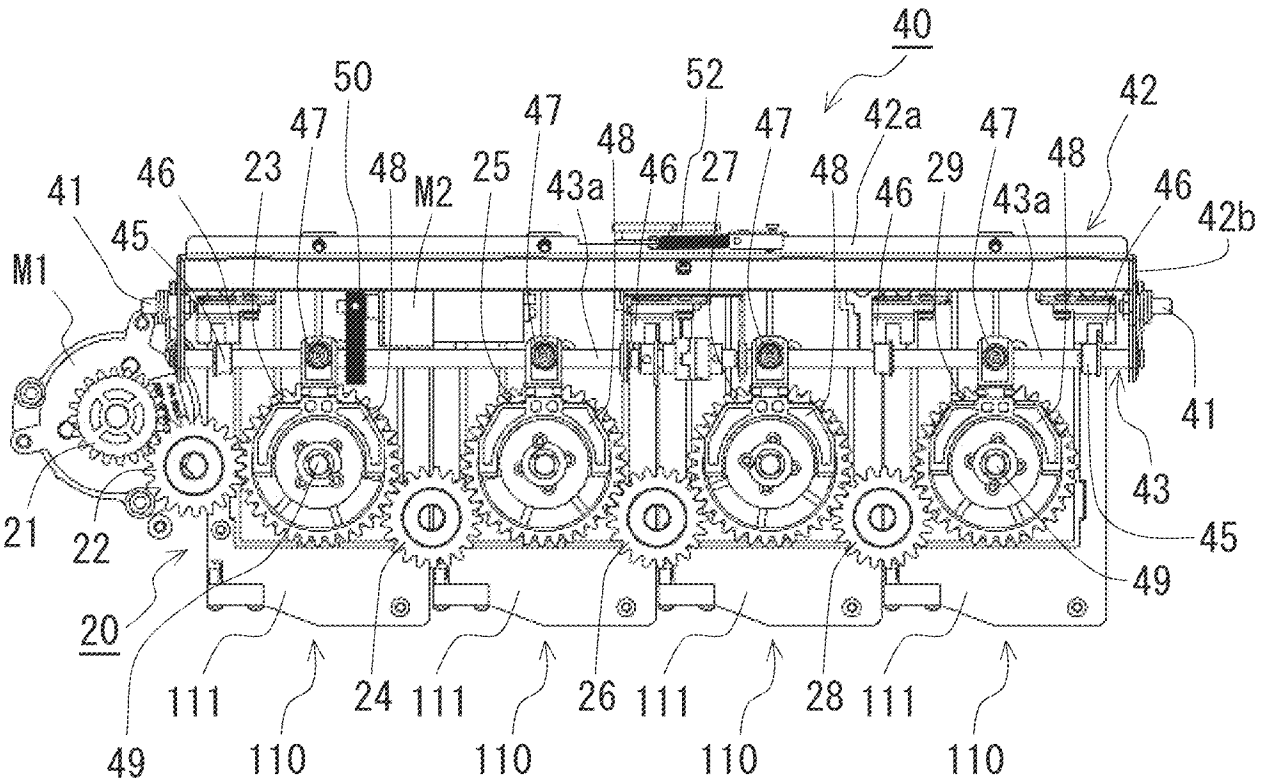
FIG. 3 is a bottom view showing the structure of a driving mechanism and a switching unit, both of which are provided in a chassis or base of the multi-unit coin ejection apparatus of FIG. 1.
Figure 4:
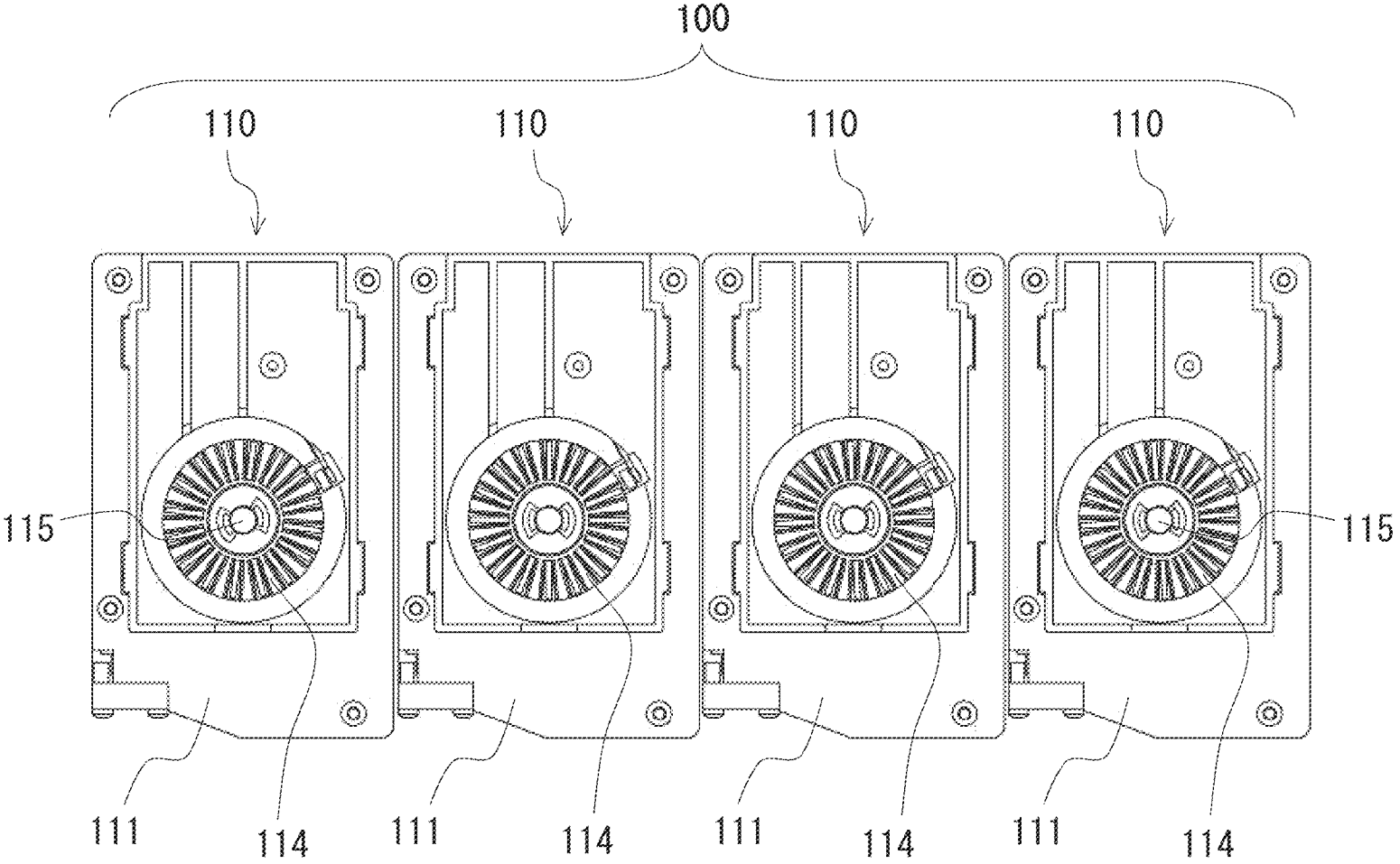
FIG. 4 is a bottom view showing the structure of four coin ejection units of the multi-unit coin ejection apparatus of FIG. 1.

The overall schematic structure of the multi-unit coin ejection apparatus 1 according to the first embodiment of the present invention is shown in FIG. 1. Moreover, the state where four coin storing containers 120 are detached from the multi-unit coin ejection apparatus 1 is shown in FIG. 2, the schematic structures of a driving mechanism 20 and a switching unit 40 both of which are provided in a chassis or base 11 of the apparatus 1 are shown in FIG. 3, and the structure of the first to fourth coin ejection units 110 is shown in FIG. 4.

As shown in FIG. 1, the multi-unit coin ejection apparatus 1 according to the first embodiment is mainly formed by a base section 10 and a coin ejection section 100. The base section 10 comprises the chassis or base 11 which has a shape like a rectangular parallelepiped, and the approximately rectangular upper surface of the chassis 11 is formed as a mounting surface 11*a*. The multi-unit coin ejection apparatus 1 is placed in such a way that the mounting surface 11*a* is approximately parallel to the horizontal plane.

The coin ejection section 100 comprises the first to fourth coin ejection units 110, each of which has a corresponding one of the four coin storing containers 120 and a lid (not shown) that covers the upper opening of the said container 120. The first to fourth coin ejection units 110 are arranged on the mounting surface 11*a* to be adjacently to each other along a straight line parallel to the long sides of the mounting surface 11*a* and are disengageably engaged with the mounting surface 11*a*, A first motor M1 for conducting the coin ejection operation by driving the respective coin ejection units 110 is fixed to one end of the chassis 11. The rotational shaft (not shown) of the first motor M1 is disposed so as to be perpendicular to the mounting surface 11*a*. The control of the first motor M1, i.e., the start and stop of rotation and the switching of the rotation direction between the normal and reverse directions, is performed by a control device (not shown).

As the first motor M1, any known motor can be used if it has a rotational driving force sufficient for driving (the rotating disk of) each of the first to fourth coin ejection units 110 to conduct the predetermined coin ejection operation.

In the following explanation, the unit 110 disposed at the nearest position to the first motor M1 is termed the "first coin ejection unit", and the remaining three units 110 arranged in this order in a direction away from the first coin ejection unit 110 along the long sides of the mounting surface 11*a* are respectively termed the "second coin ejection unit", the "third coin ejection unit", and the "fourth coin ejection unit".

The first to fourth coin ejection units 110 are respectively assigned to predetermined four denominations (for example, in the case of Japanese Yen, four denominations of 500 Yen, 100 Yen, 50 Yen, and 10 Yen). Thus, these four coin ejection units 110 are configured in such a way that coins of a relevant denomination are stored in the coin storing container 120 of a corresponding one of the units 110. Each of the coin ejection units 110 ejects the coins of the relevant denomination stored in the corresponding coin storing container 120 to the outside one by one in response to a dispensing instruction which is sent from an upper-level device (for example, a coin depositing/dispensing apparatus).

Figure 5:
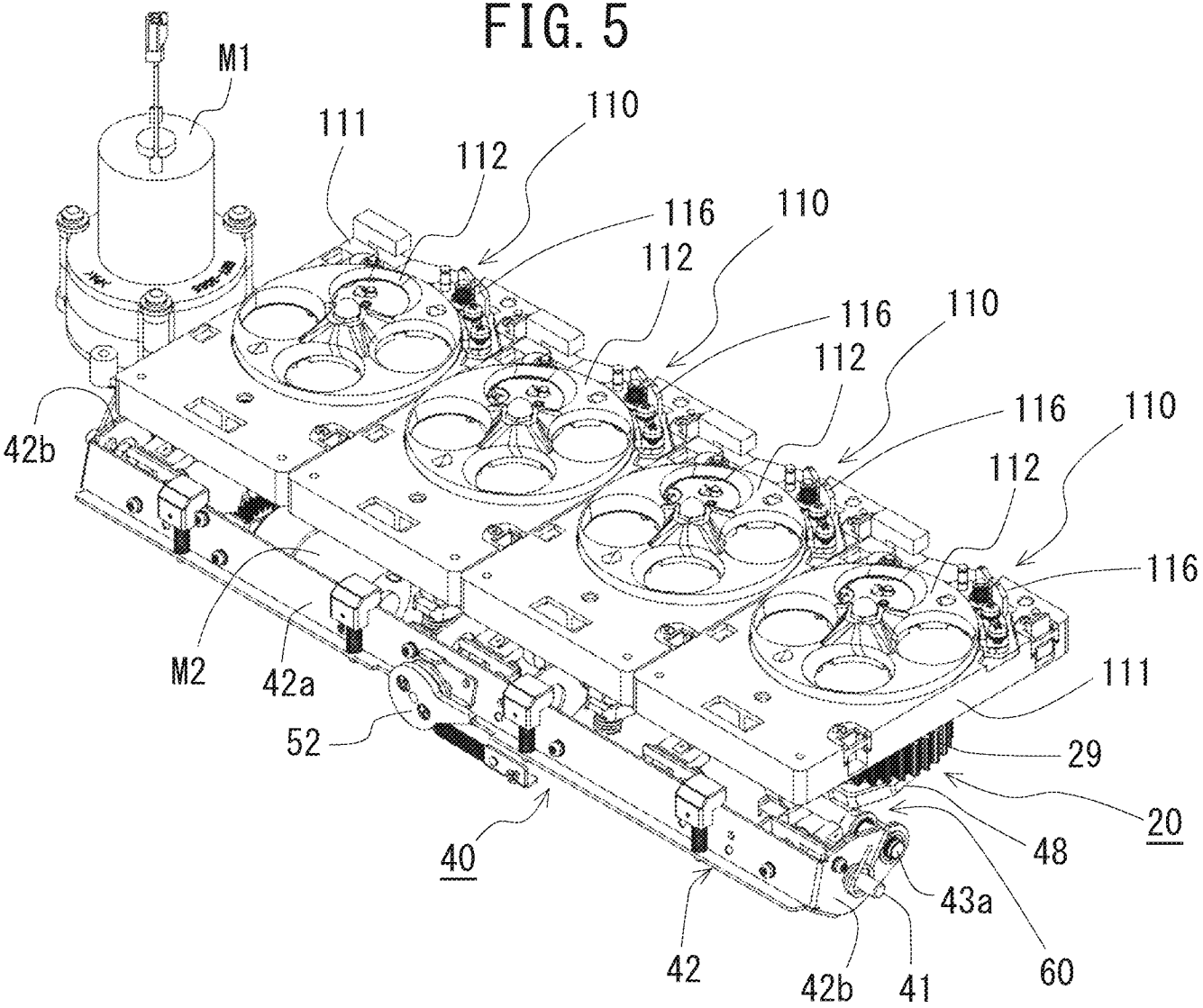
FIG. 5 is a perspective view showing the state where the four coin storing containers and the chassis or base are detached from the multi-unit coin ejection apparatus of FIG. 1.

The first to fourth coin ejection units 110 have the same structure. As shown in FIGS. 2 and 5, each of the four units 110 comprises a plate-shaped body 111, and a rotary disk 112 which has four through holes and which is mounted so as to be rotatable in the body 111. Since the mounting surface 11*a* is approximately horizontal, the disk 112 is rotatable in an approximately horizontal plane. If a coin of a relevant denomination which has been dropped from the corresponding coin storing container 120 is fitted into one of the through holes of the disk 112 during rotation, the said coin is thrown out of the hole by an inertial force caused by the rotation of the disk 112 and as a result, the said coin is ejected to the outside through an ejection outlet 113 provided at the rear end of the body 111. In addition, at the time of coin ejection, the said coin thus thrown out of the corresponding hole is controlled so as to abut on a coin guide 116 provided near the ejection outlet 113; as a result, the ejection direction of the said coin is always controlled in a predetermined direction.

Needless to say, the count of the through holes of the rotary disk 112 is not limited to four and it may be set as any number other than four. Moreover, it is needless to say that the rotary disks 112 provided for all the denominations to be ejected need not have the same structure (i.e. which have an equal count of the holes) and that the disks 112 may have different structures (i.e. which have different counts of the holes) according to the assigned denominations.

In each of the first to fourth coin ejection units 110, a rotational shaft 115 that extends approximately vertically and that is rotatably supported is provided in the body 111. The rotary disk 112 is engaged with the top end of the shaft 115. As shown in FIG. 4, a coupling gear 114 is fixed to the lower end of the shaft 115 and thus, the coupling gear 114 and the disk 112 are rotated integrally along with the rotation of the shaft 115. This means that the coupling gear 114 also is rotated in the approximately horizontal plane similar to the disk 112.

As shown in FIG. 3, in the chassis 11, there are provided with a driving mechanism 20 that selectively drives rotationally one of the rotary disks 112 in the first to fourth coin ejection units 110 by transmitting the driving force of the first motor M1, and a switching unit 40 that switches the transmission destination of the rotational driving force of the first motor M1 to selectively drive one of the first to fourth coin ejection units 110.

The structure of the driving mechanism 20 is shown in FIG. 3 and FIGS. 6 to 9. Specifically, the driving mechanism 20 comprises a plurality of gears that are arranged approximately linearly along the long sides of the chassis 11. More specifically, the driving mechanism 20 comprises (i) a driving gear 21 fixed to the rotational shaft of the first motor M1; (ii) four driven gears 23, 25, 27, and 29 that are respectively fixed to the lower ends of the rotational shafts 115 of the first to fourth coin ejection units 110; (iii) an intermediate gear 22 rotatably placed between the driving gear 21 and the driven gear 23 for the first coin ejection unit 110; (iv) an intermediate gear 24 rotatably placed between the driven gear 23 for the first coin ejection unit 110 and the driven gear 25 for the second coin ejection unit 110; (v) an intermediate gear 26 rotatably placed between the driven gear 25 for the second coin ejection unit 110 and the driven gear 27 for the third coin ejection unit 110; (vi) and an intermediate gear 28 rotatably placed between the driven gear 27 for the third coin ejection unit 110 and the driven gear 29 for the fourth coin ejection unit 110.

All of the driven gears 23, 25, 27, and 29 and the intermediate gears 22, 24, 26, and 28 are located in a plane parallel to the mounting surface 11*a* (i.e., an approximately horizontal plane) and are arranged along the straight line parallel to the long sides of the mounting surface 11*a* (along which the first to fourth coin ejection units 110 are arranged). The driven gears 23, 25, 27, and 29 and the intermediate gears 22, 24, 26, and 28 are rotatable integrally along with the corresponding eight rotational shafts (not shown) which are rotatably supported in the chassis 11, respectively. As easily understood from the structure of the driving mechanism 20, all of the driven gears 23, 25, 27, and 29 prepared respectively for the first, second, third, and fourth coin ejection units 110 are rotated in the same direction as the driving gear 21.

As shown in FIGS. 6 to 9, coupling gears 30, 31, 32, and 33 (which correspond to the second coupling gears) are respectively fixed onto the upper surfaces (upper side faces) of the driven gears 23, 25, 27, and 29 of the first to fourth coin ejection units 110. These coupling gears 30, 31, 32, and 33 are rotated integrally along with the corresponding driven gears 23, 25, 27, and 29, respectively. Moreover, the coupling gears 30, 31, 32, and 33 are disengageably engaged with corresponding four coupling gears 114 (see FIG. 4 and FIGS. 13A and 13B) (which correspond to the first coupling gears) fixed to the corresponding rotational shafts 115 of the first; second, third, and fourth units 110; respectively. These four coupling gears 30, 31, 32, and 33 are selectively engaged with the corresponding four coupling gears 114 or disengaged from the same by the switching unit 40. Due to this selective engagement or disengagement, the first to fourth coin ejection units 110 as the transmission destination of the driving force of the first motor M1 is switched or selectively selected.

The switching unit 40 has the structure shown in FIGS. 6 to 9. Specifically, the switching unit 40 comprises an approximately bar-shaped frame 42 formed by combining a plurality of thin plates; a camshaft 43 rotatably supported by the frame 42, and a second motor M2 supported by the frame 42. Four cams 44 and four detection members 45 are fixed to the camshaft 43. The second motor M2 is used for rotationally driving the camshaft 43. The frame 42 and the camshaft 43 are parallel to each other and are extended along the aforementioned straight line (along which the first to fourth coin ejection units 110 are arranged), The total length of the frame 42 and that of the camshaft 43 are approximately the same as that of the space that encloses the driven gears 23, 25, 27, and 29 and the intermediate gears 22, 24, 26, and 28. The second motor M2 has a driving gear 50 which is fixed to a rotational shaft (not shown) of the motor M2 (see FIG. 8). The driving gear 50 is rotatably engaged with the driven gear 51 which is fixed to the camshaft 43 at the position opposing to the driving gear 50. The camshaft 43 is rotationally driven by the rotational driving force of the second motor M2.

The frame 42 comprises a belt-shaped frame body 42*a* and four supporting parts 42*b*. The frame body 42*a* is extended over the whole length of the frame 42. All of the four supporting parts 42*b* are formed to protrude perpendicularly from the frame body 42*a* in the same direction. Two of the supporting parts 42*b* are disposed at a predetermined distance near the middle position of the frame body 42*a*. The remaining two supporting parts 42*b* are disposed at the two end positions of the frame body 42*a*, respectively. Two supporting shafts 41 are fixed to the two supporting parts 42*b* disposed at the end positions in the outside of the frame 42, respectively. These two supporting shafts 41 are protruded in opposite directions from the corresponding supporting parts 42*b* along the extending direction of the frame 42 and the camshaft 43, and rotatably supported by two supporting members (not shown) fixed in the chassis 11, respectively. For this reason, the entire frame 42 can be rocked or rotated around the two supporting shafts 41 disposed at the two ends of the frame 42. Due to this rocking or rotation motion of the frame 42, the camshaft 43 also is rocked or rotated around the two supporting shafts 41 to be displaced. The second motor M2, which is disposed between the camshaft 43 and the frame body 42*a* at the position approximately opposite to the intermediate gear 24, is fixed to the inner surface of the frame body 42*a*.

In this first embodiment, the camshaft 43 is formed by coupling two shaft members 43*a* with a joint or connector 43*b*, One of the shaft members 43*a* is rotatably supported by the two supporting parts 42*b* disposed at the right side half of the frame body 42*a*, and the other of the shaft members 43*a* is rotatably supported by the two supporting parts 42*b* disposed at the left side half of the frame body 42*a*. However, this structure is used for facilitating the assembly. Thus, it is needless to say that the camshaft 43 may be formed by a single shaft member.

As the second motor M2, a known servo motor or stepping motor may be used. However, the present invention is not limited to these motors. It is needless to say that any motor may be used for the second motor M2 if it can control precisely the rotational position or rotational angle of the camshaft 43.

The start and stop of the rotation of the second motor M2 and the switching of the rotation direction thereof between the normal and reverse directions, which are performed by an unillustrated control device, can be appropriately adjusted according to the arrangement of the four cams 44 on the camshaft 43. For example, the second motor M2 is usually configured to be rotated in the normal and reverse directions; however, the second motor M2 may be configured to be rotated only in one direction (i.e., only the normal or reverse direction).

The four cams 44 fixed to the camshaft 43 are respectively prepared for the first to fourth coin ejection units 110. These cams 44 are the same in shape and size as each other. Each of the cams 4 is formed by a member with a predetermined thickness which has a shape like an isosceles triangle whose three corners are rounded. As seen from FIG. 6, these four cams 44 are fixed to the camshaft 43 in such a way as to shift sequentially at a phase difference of 90°. This is to make it possible to selectively switch the transmission destination of the driving force of the first motor M1 among the first to fourth coin ejection units 110 by changing the rotational position or angle of the camshaft 43.

The four cams 44 are configured to cooperate with the four cam followers 48 (see FIGS. 7 and 8) which are respectively engaged with the corresponding driven gears 23, 25, 27, and 29 provided respectively for the first to fourth coin ejection units 110.

Figure 10A:
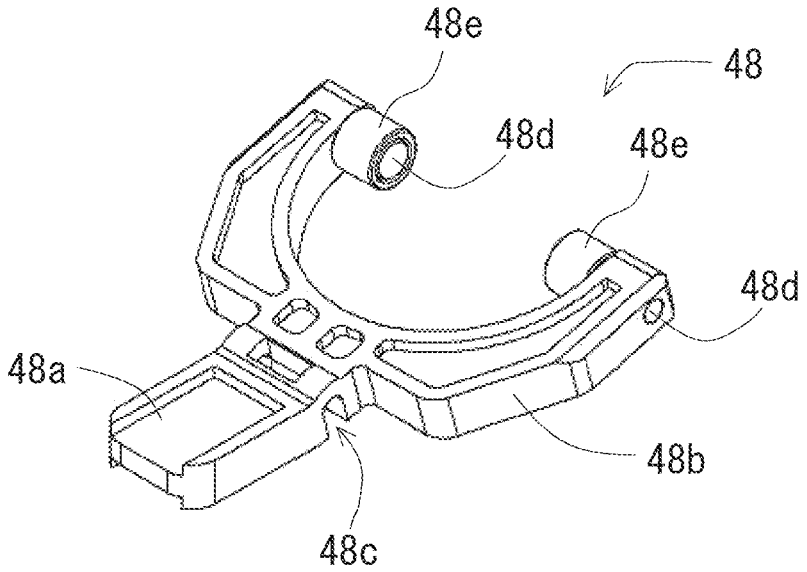
FIG. 10A is a perspective view showing an example of the structure of a cam follower used for the switching unit of the multi-unit coin ejection apparatus of FIG. 1, which is seen obliquely downward from the upper right front.
Figure 10B:
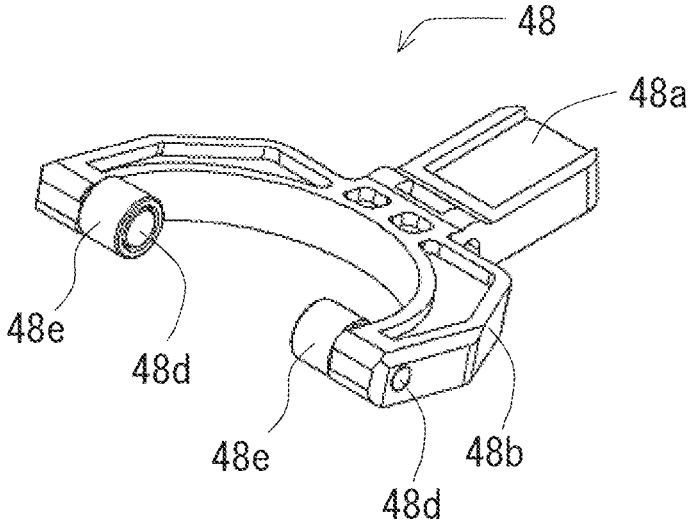
FIG. 10B is a perspective view showing the example of the structure of the cam follower of FIG. 10A, which is seen obliquely downward from the upper right rear.

The four cam followers 48 have the function of displacing the corresponding driven gears 23, 25, 27, and 29 in upper and lower directions. These four cam followers 48 are the same in shape and size, each of which has the structure shown in FIGS. 10A and 10B. Specifically, each of the cam followers 48, the entire shape of which is like a Y character, comprises a cam receiving part 48*a* and a branching part 48*b*. The cam receiving part 48*a* is a part for receiving the corresponding cam 44. The branching part 48*b* is a part that is engaged with an engagement member (e.g., an engagement member 23*a* shown in FIGS. 12A and 12B) mounted on a corresponding one of the driven gears 23, 25, 27, and 29, A shaft hole 48*c* is formed near the boundary between the cam receiving part 48*a* and the branching part 48*b*. When the cam reeving part 48*a* is pressed downward by the protruding part (which may be termed the cam end also) of the corresponding cam 44, the cam follower 48 is rotated around a support shaft 48*f* (see FIG. 12A) which is fit in the shaft hole 48*c* and as a result, the branching part 48*b* is pressed upward. When the downward pressing force applied to the cam reeving part 48*a* by the protruding part of the corresponding cam 44 is lost, the cam follower 48 is returned to its initial position by the elastic force of a corresponding spring 47 (see FIGS. 7 and 8) disposed right below the cam reeving part 48*a*. This means that the cam follower 48 is rocked upward and downward around the support shaft 48*f* (or the shaft hole 48*c*) like a seesaw in response to the presence or absence of the downward pressing force applied to the cam reeving part 48*a*.

Two pins 48*d* are respectively fixed inwardly to the ends of two arms that forms the branching part 48*b* of the cam follower 48. Two rollers 48*e* are rotatably engaged with these two pins 48*d*, respectively. The reason why the rollers 48*e* are provided is to realize the smooth engagement operation of the cam follower 48 with the engagement member (e.g., the engagement member 23*a*) mounted on the corresponding one of the driven gears 23, 25, 27, and 29.

Figure 11A:
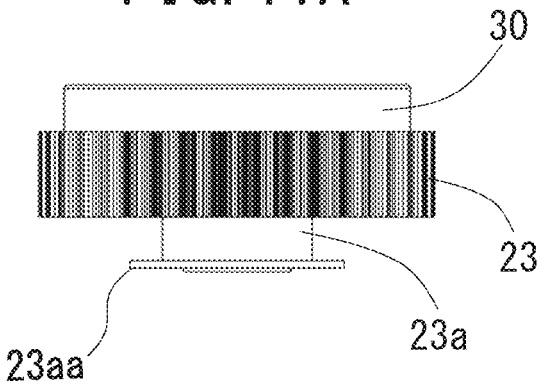
FIG. 11A is a front view showing an example of the structure of a coupling gear (which corresponds to a second coupling gear) used for the switching unit of the multi-unit coin ejection apparatus of FIG. 1, which shows the state where the coupling gear is fixed to an upper surface (upper side face) of a corresponding driven gear.
Figure 11B:
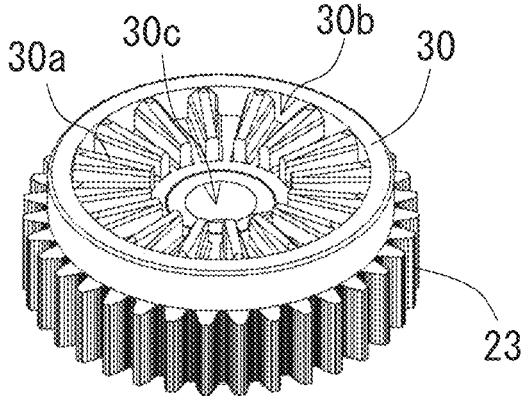
FIG. 11B is a perspective view showing the example of the structure of the coupling gear of FIG. 11A, which is seen obliquely downward from an upper position.
Figure 11C:
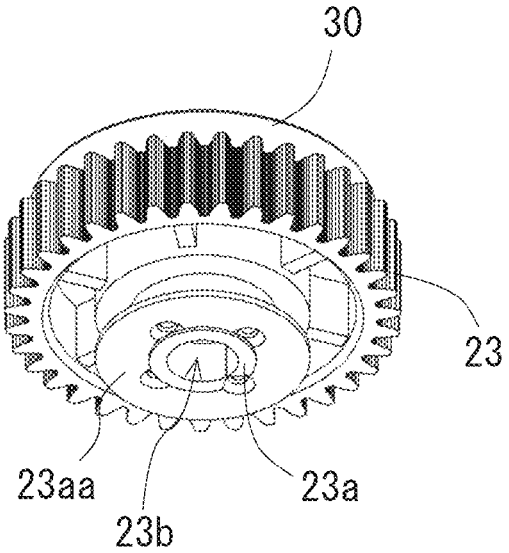
FIG. 11C is a perspective view showing the example of the structure of the driven gear of FIG. 11A, which is seen obliquely upward from a lower position.

FIGS. 11A, 11B, and 11C show an example of the structure of the engagement member 23*a* mounted on the driven gear 23 for the first coin ejection unit 110, in which the coupling gear 30 is fixed to the driven gear 23.

As seen from FIGS. 11A, 11B, and 11C, the coupling gear 30, the diameter of which is slightly smaller than the driven gear 23, is fixed to the upper side face (upper surface) of the driven gear 23 in such a way as to be coaxial with the same gear 23. The engagement member 23*a* having an approximately cylindrical shape is fixed to the lower side face (lower surface) of the driven gear 23 in such a way as to protrude downward. The engagement member 23*a*, which is fixed to be coaxial with the driven gear 23, has a flange part 23*aa* that protrudes laterally at the lower end thereof. The flange part 23*aa* forms one of the engagement faces for the branching part 48*b*. The lower side face of the driven gear 23 forms the other of the engagement faces for the branching part 48*b*. The branching part 48*b* is inserted into between the flange part 23*aa* and the lower surface of the driven gear 23 to be engaged with the same. The engagement member 23*a* has a shaft hole 23*b* which is coaxial with the corresponding driven gear 23 and the corresponding coupling gear 30. The two rollers 48*e*, which are attached to the two ends of the branching part 48*b* of the cam follower 48, are engaged with the part which is sandwiched by the flange part 23*aa* and the lower surface of the driven gear 23. While the branching part 48*b* of the cam follower 48 is rocked upward or downward around the support shaft 48*f*, the rollers 48*e* are rolled, thereby realizing smooth movement of the driven gear 23 and the coupling gear 30 between the coupling position and the non-coupling position.

Figure 7:
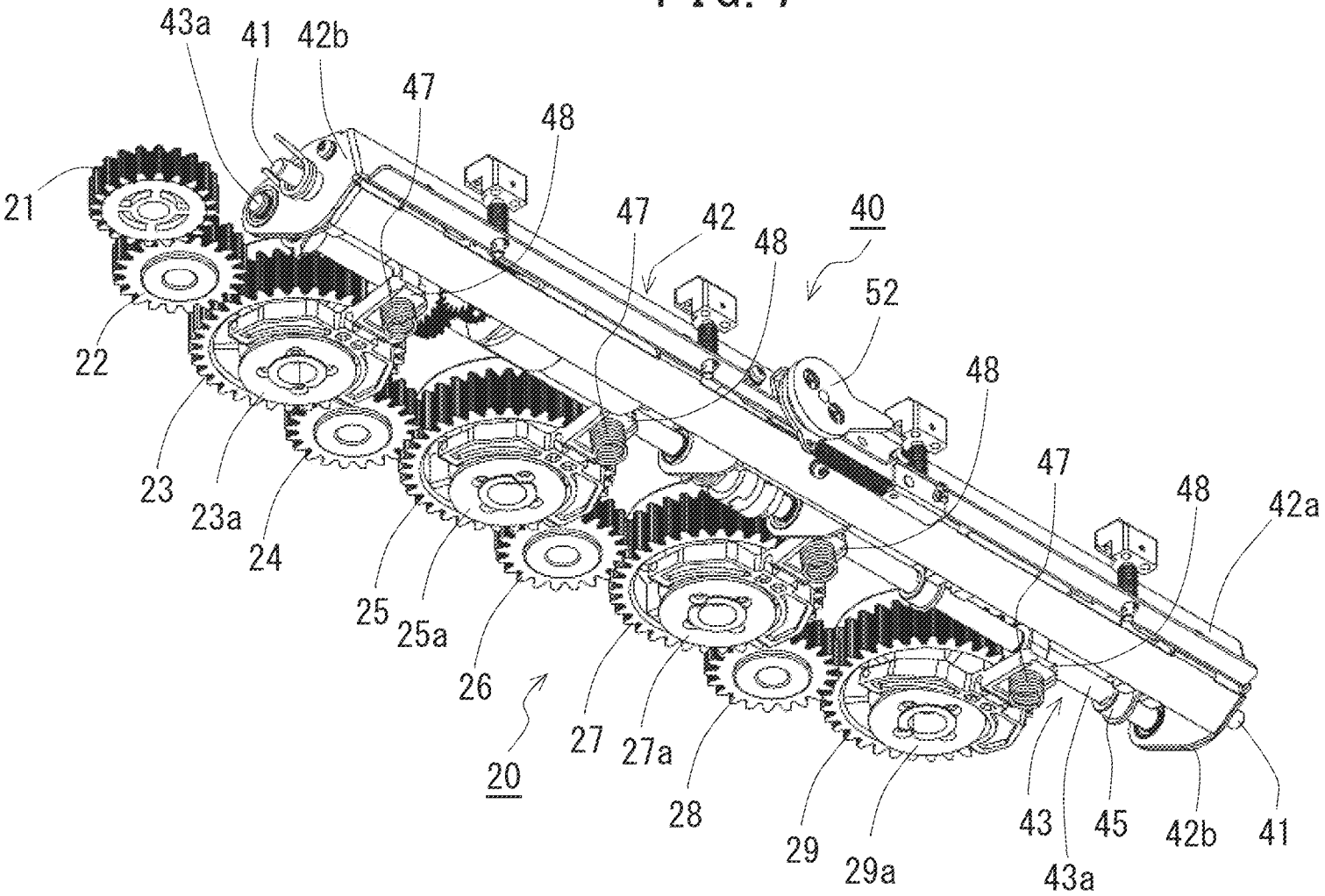
FIG. 7 is a perspective view showing the structure of the driving mechanism and the switching unit of the mufti-unit coin ejection apparatus of FIG. 1, which is seen obliquely upward from the lower left front.
Figure 8:
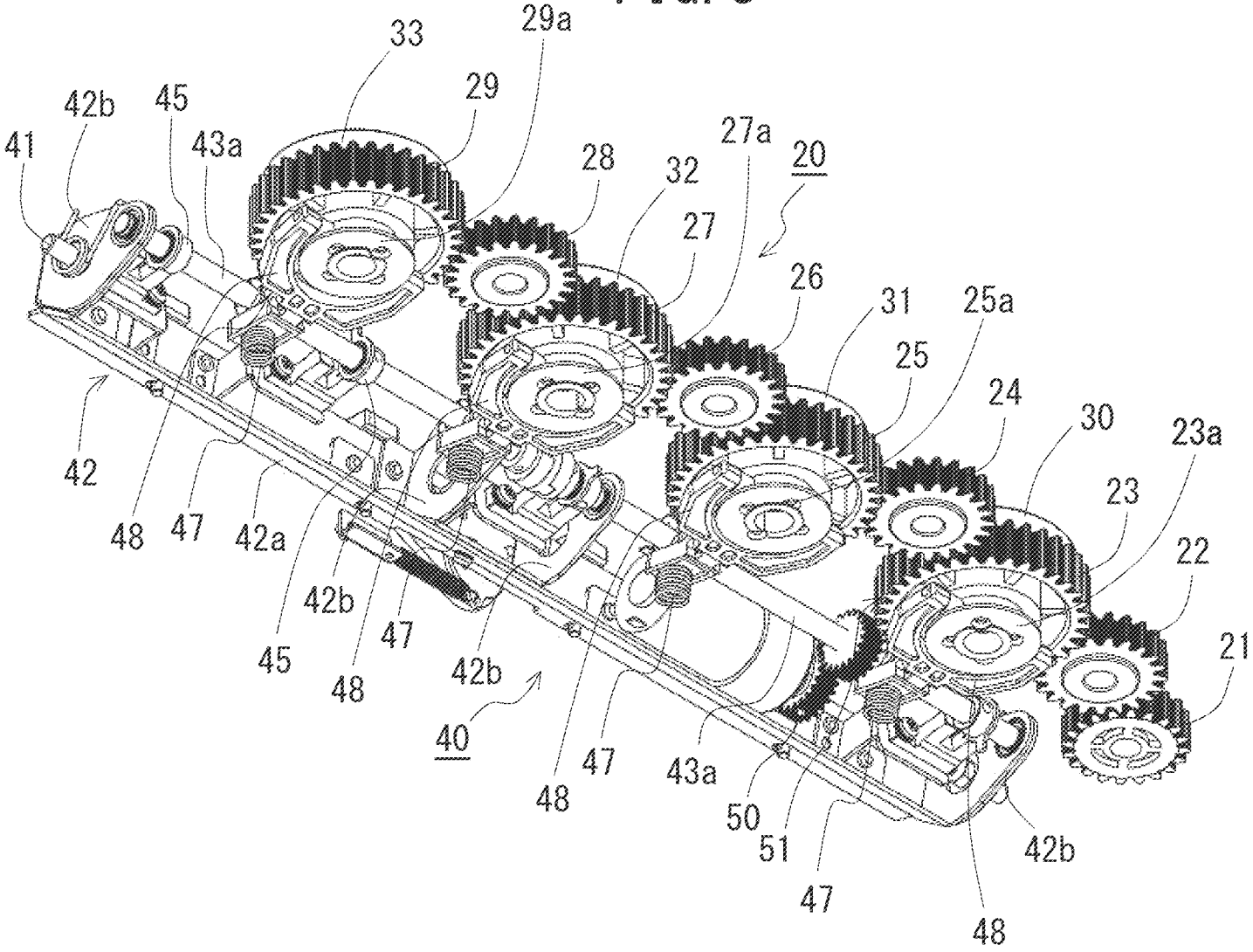
FIG. 8 is a perspective view showing the structure of the driving mechanism and the switching unit of the multi-unit coin ejection apparatus of FIG. 1, which is seen obliquely upward from the lower left rear.
Figure 9:
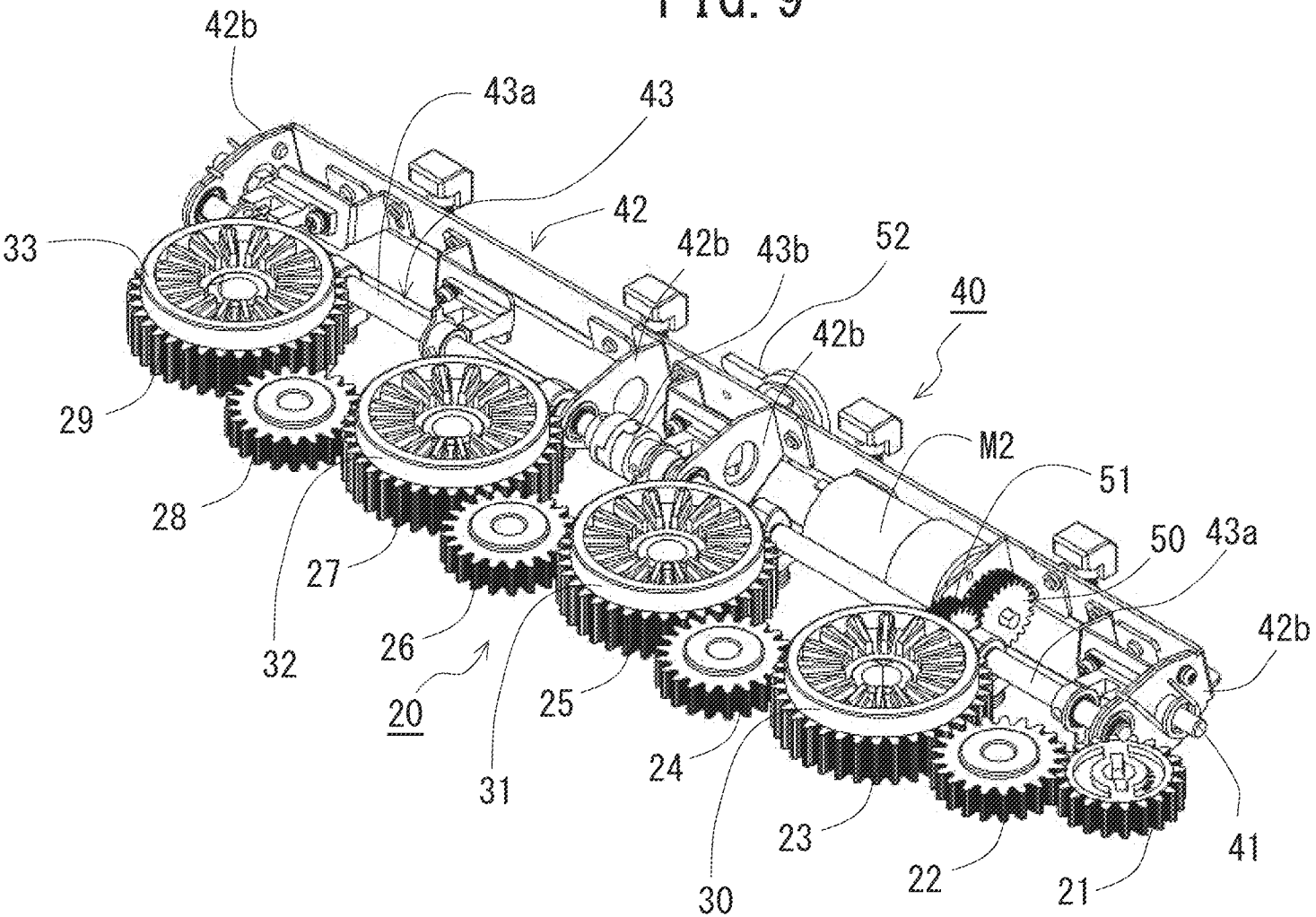
FIG. 9 is a perspective view showing the structure of the driving mechanism and the switching unit of the multi-unit coin ejection apparatus of FIG. 1, which is seen obliquely downward from the upper right rear.

The aforementioned explanation about the driven gear 23 is applicable to the driven gears 25, 27, and 29. As shown in FIG. 7, engagement members 25*a*, 27*a*, and 29*a* each having an approximately cylindrical shape are respectively mounted on the driven gears 25, 27, and 29 for the second to fourth coin ejection units 110. The engagement members 25*a*, 27*a*, and 29*a* are respectively fixed to the lower side faces (lower surfaces) of the driven gears 25, 27, and 29 in such a way as to protrude downward.

In this embodiment, as shown in FIG. 11, the coupling gear 30 fixed to the upper side face (upper surface) of the driven gear 23 has the structure that gear teeth 30*a* are formed in the upper side face thereof along its circular rim at equal intervals. A gear groove 30*b* is formed between each of the two adjoining gear teeth 30*a*. This means that the gear teeth 30*a* of the coupling gear 30 are formed to protrude upward while the gear teeth of the driven gear 23 are formed to protrude laterally and radially. A shaft hole 30*c* is formed at the center of the coupling gear 30 to be coaxial with the shaft hole of the driven gear 23.

Figure 12A:
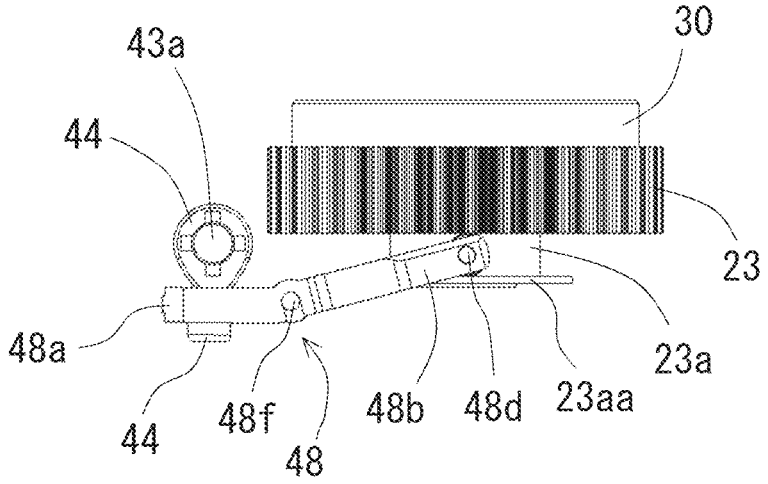
FIG. 12A is a front view showing an example of the engagement structure of the cam follower with the corresponding driven gear, which is used for the switching unit of the multi-unit coin ejection apparatus of FIG. 1.
Figure 12B:
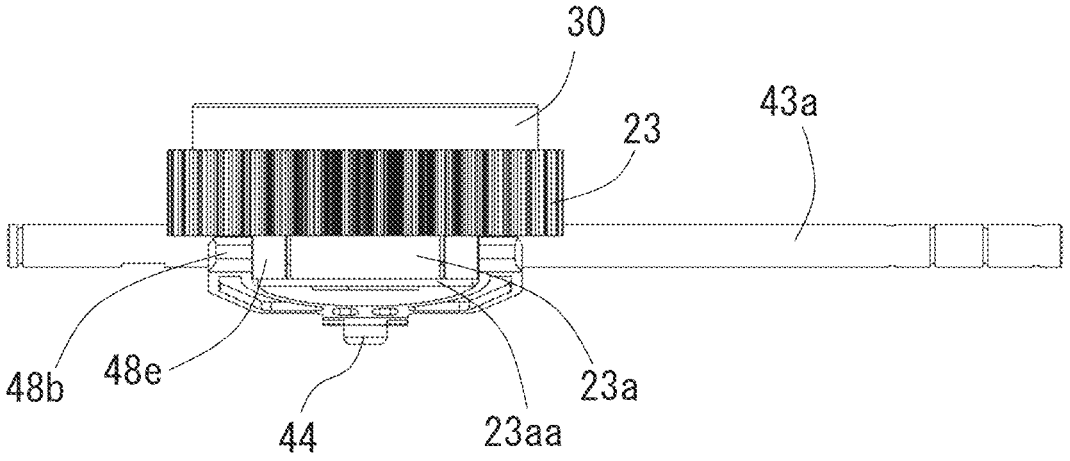
FIG. 12B is a rear view showing the example of the engagement structure of the cam follower of FIG. 12A with the corresponding driven gear.

The engagement state of the cam follower 48 with the corresponding engagement member 23*a* is shown in FIGS. 12A and 12B. The cam follower 48 is rockable around the support shaft 48*f* which is fit in the shaft hole 48*c*. Due to the rocking motion of the cam follower 48, the coupling gear 30 (one of the second coupling gears) can be switched between the coupling position and the non-coupling position. In FIG. 12A, the protruding part of the cam 44 (i.e., the part of the cam 44 that protrudes most from the cam shaft 43) lowers slightly the cam receiving part 48*a* and at the same time, the branching part 48*b* is slightly raised due to the lowering of the cam receiving part 48*a*, resulting in a slight rising operation of the driven gear 23 and the coupling gear 30. In this state, the coupling gear 30 is engaged or meshed with the corresponding coupling gear 114 (one of the first coupling gears), which means that the coupling gears 30 and 114 are coupled. On the other hand, when the cam 44 is moved and the protruding end thereof is disengaged from the cam receiving part 48*a*, the cam receiving part 48*a* is slightly displaced upward (i.e., returned to the initial position) due to the elastic force of the spring 47 (see FIG. 7, for example) placed just below the cam receiving part 48*a*, as shown in FIG. 12B, resulting in a slight lowering operation of the driven gear 23 and the coupling gear 30 (i.e., returned to the initial position). In this state, the coupling gear 30 is not engaged or meshed with the corresponding coupling gear 114, which means that the coupling gears 30 and 114 are not coupled.

The end of the aforementioned spring 47 opposite to the cam receiving part 48*a* is supported by a supporting structure (not shown) provided just below the spring 47 in the chassis 11. For this reason, the elastic force of the spring 47 is always applied to the cam receiving part 48*a* and as a result, the cam receiving part 48*a* is kept at a predetermined upper position and the branching part 48*b* is kept at a predetermined lower position. Accordingly, the coupling gear 30 is located at the aforementioned lower position, i.e., the "non-coupling position", except for the time when the cam receiving part 48*a* is pressed downward by the protruding part of the cam 44. On the other hand, when the cam receiving part 48*a* is pressed downward by the protruding part of the cam 44, the coupling gear 30 is moved to the aforementioned upper position, i.e., the "coupling position". When the downward pressing action by the protruding part of the cam 44 is lost, the coupling gear 30 is automatically returned to the "non-coupling position". In this way, the coupling gear 30 can be switched between the "coupling position" and the "non-coupling position" by way of the cam follower 48 due to a simple rocking or rotation operation of the cam 44.

Figure 13A:
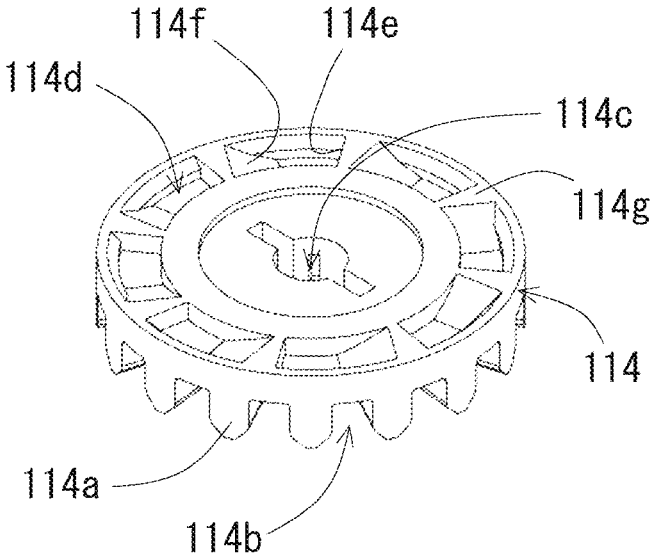
FIG. 13A is a perspective view showing an example of the structure of a coupling gear (which corresponds to a first coupling gear) used for the switching unit of the multi-unit coin ejection apparatus of FIG. 1, which is seen obliquely downward from an upper position.
Figure 13B:
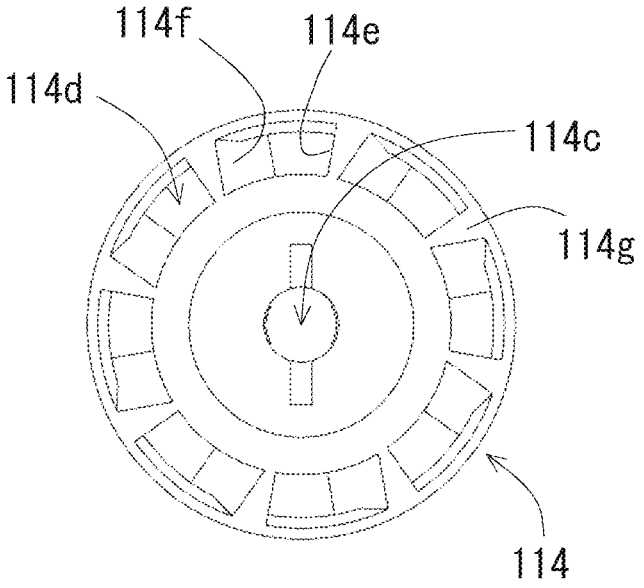
FIG. 13B is a plan view showing the example of the structure of the coupling gear of FIG. 13A.

An example of the structure of the coupling gear 114 corresponding to the coupling gear 30 is shown in FIGS. 13A and 13B. In this structure example, gear teeth 114*a* are formed in the lower side face thereof along its circular rim at equal intervals. A gear groove 114*b* is formed between each of the two adjoining gear teeth 114*a*. This means that the gear teeth 114*a* of the coupling gear 114 are formed to protrude downward. A shaft hole 114*c* is formed at the center of the coupling gear 114 to be coaxial with the shaft hole of the corresponding coupling gear 30 at the time of coupling. The gear teeth 114*a* and the gear grooves 114*b* of the coupling gear 114 can be engaged with the gear grooves 30*b* and the gear teeth 30*a* of the corresponding coupling gear 30, respectively. When the gear teeth 114*a* and the gear grooves 114*b* of the coupling gear 114 are respectively engaged with the gear grooves 30*b* and the gear teeth 30*a* of the corresponding coupling gear 30, i.e., these two gears 114 and 30 are coupled, the driving force of the coupling gear 30 is transmitted to the corresponding coupling gear 114 and as a result, the rotary disk 112 of the coin ejection unit 110 connected to the said coupling gear 114 is drivingly rotated, thereby ejecting a coin or coins of the corresponding denomination from the said unit 110.

In the structure example of FIGS. 13A and 13B, the coupling gear 114 comprises an engagement face 114*g* formed on the opposite side to the gear teeth 114*a* and the gear grooves 114*b*. Engagement holes 114*d* are formed in the engagement face 114*g* (i.e., the upper side face) to be arranged along the circular rim of the said gear 114 at equal intervals. The engagement face 114*g* is a face with which an engaging part 117*b* of an unnecessary rotation prevention member 117 of the unnecessary rotation prevention mechanism 80 which will be explained later is engaged. Each of the engagement holes 114*d* has two ends 114*e* and 114*f* formed apart from each other along the rim of the coupling gear 114. The end 114*e* has a perpendicular face with respect to the engagement face 114*g* and the end 114*f* has an inclined face with respect to the same, which means that the coupling gear 114 comprises the engagement holes 114*d* each having the perpendicular end 114*e* and the inclined end 114*f*. This is to realize the function of a one-way clutch. Specifically, when the coupling gear 114 is not coupled with the coupling gear 30, there is a possibility that unintended slip of the coupling gear 114 occurs to result in a phenomenon of undesired dispensing of a coin or coins. The function of the one-way clutch is used for preventing such the phenomenon of undesired coin dispensing. For this reason, the engagement holes 114*d* may be omitted if the function of the one-way clutch is unnecessary.

The details of the one-way clutch that uses the engagement holes 114*d* of the coupling gear 114, each of the engagement holes 114*d* has the perpendicular end 114*e* and the inclined end 114*f*, will be explained later (see FIGS. 23A to 29).

The camshaft 43 (to which the four cams 44 are fixed and which is drivingly rotated by the second motor M2) and the four cam followers 48 (which are displaceable by the corresponding cams 44) constitute a coupling gear displacement mechanism 60. The coupling gear displacement mechanism 60 selectively displaces the coupling gears 30, 31 32, and 33 (which correspond to the second coupling gears) between the "coupling position" and the "non-coupling position". At the "coupling position", each of the coupling gears 30, 31 32, and 33 is engaged to be coupled with a corresponding one of the four coupling gears 114 (which correspond to the first coupling gears), which means that the driving force of the first motor M1 is transmitted to each of the four coupling gears 114 by way of the corresponding coupling gear 30, 31 32, or 33. On the other hand, at the "non-coupling position", engagement and coupling between each of the coupling gears 30, 31 32, and 33 and the corresponding coupling gear 114 is released and disengaged, which means that the driving force of the first motor M1 is not transmitted to each of the four coupling gears 114 by way of the corresponding coupling gear 30, 31 32, or 33.

The engagement state (i.e., the coupling state) and the disengagement state (i.e., the non-coupling state) between the coupling gears 30, 31 32, and 33 and the corresponding four coupling gears 114 are respectively switched by the coupling gear displacement mechanism 60 of the switching unit 40 in such the manner as explained above. To detect the switching situation of the engagement and disengagement between the coupling gears 30, 31 32, and 33 and the corresponding four coupling gears 114, in other words, to detect which one of the first to fourth coin ejection units 110 is in the driving state, four detection members 45 and four optical sensors 46 are provided in the switching unit 40. The four detection members 45 and the four optical sensors 46 are provided for the first to fourth coin ejection units 110, respectively.

Figure 6:
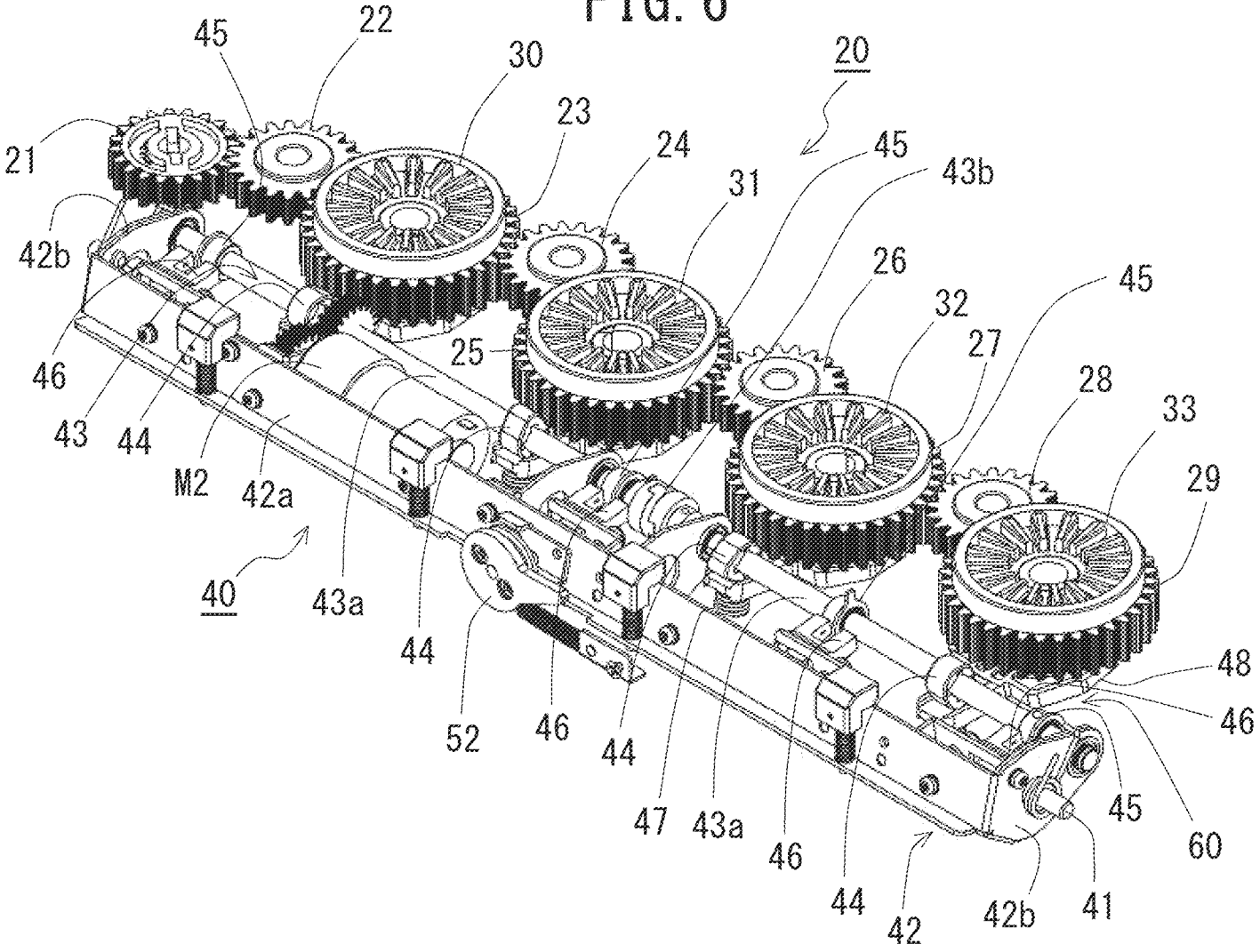
FIG. 6 is a perspective view showing the structure of the driving mechanism and the switching unit of the multi-unit coin ejection apparatus of FIG. 1, which is seen obliquely downward from the upper right front.

As the optical sensors 46, any known infrared sensors or the like may be used; however, any type of sensors other than the optical ones may be used for this purpose. It is sufficient for the sensors that they can detect the connection/disconnection of the first to fourth coin ejection units 110. Here, the four detection members 45, which are the same in shape and size, are fixed to the camshaft 43 at intervals, as shown in FIG. 6, for example.

In this first embodiment, each of the four detection members 45 is formed by a circular member having a protrusion which protrudes outwardly from a part of the said member. The camshaft 43 (or the shaft member 43*a*) is inserted into the central hole of the said circular member and fixed at a predetermined position. The optical sensors 46 that correspond to the detection members 45, which are the same in structure and function, are fixed onto the inner surface of the frame body 42*a* at the opposite positions to the corresponding detection members 45, Each of the sensors 46 has a gap formed between the light emitting part and the light receiving part thereof. When the protrusion of the detection member 45 is inserted into and passed through the gap, the infrared light emitted from the light emitting part toward the light receiving part is temporarily blocked by the said protrusion; as a result, the arrival and passing of the protrusion of the said detection member 45 at the corresponding sensor 46 is detected. Due to this detection, it is judged that the coupling gear 30 in question and its corresponding coupling gear 114 are engaged and coupled, in other words, it is judged that the relevant coupling gear 30 is disposed at the coupling position and that the relevant coin ejection unit 110 is in the driving state. In the case where this engagement and coupling state needs to be maintained, the rotational driving of the second motor M2 is stopped at the same time as the detection of the arrival of the said protrusion at the said sensor 46. In this way, the coupling gear 30 and its corresponding coupling gear 114 are coupled and the relevant coin ejection unit 110 is driven by the first motor M1. As far as this state is held, a coin or coins of a predetermined denomination which is/are dispensed from the same coin ejection unit 110, When the aforementioned infrared light is not blocked by the said protrusion, it is judged that the coupling gear 30 in question and its corresponding coupling gear 114 are not engaged and coupled, in other words, it is judged that the relevant coupling gear 30 is disposed at the non-coupling position and that the relevant coin ejection unit 110 is in the non-driving state.

Figure 21:
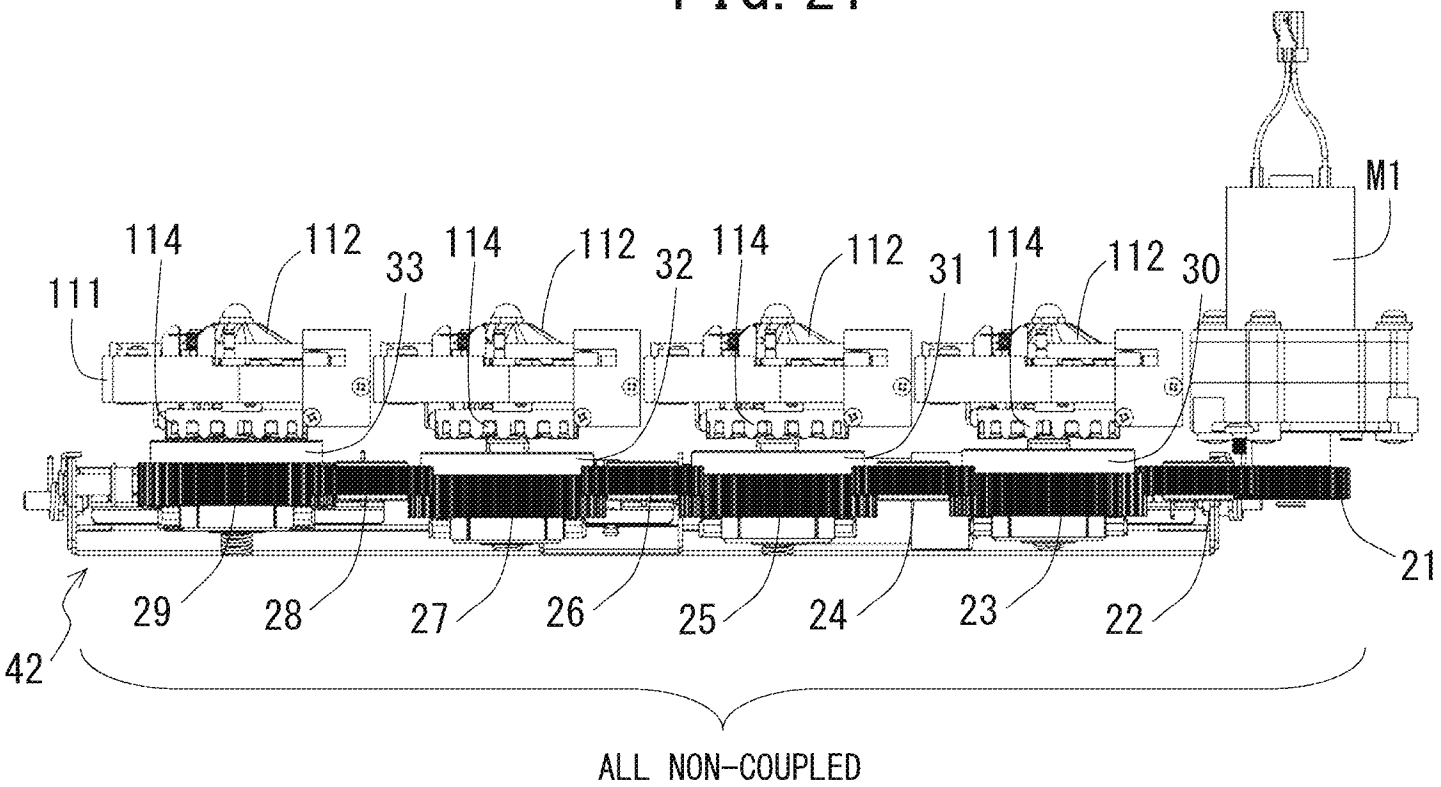
FIG. 21 is an explanatory view showing the driving/non-driving state of the first to fourth coin ejection units of the multi-unit coin ejection apparatus of FIG. 1, in which all of the first coin ejection units are in the non-driving state (i.e., the multi-unit coin ejection apparatus of FIG. 1 is in the non-operable mode).
Figure 22:
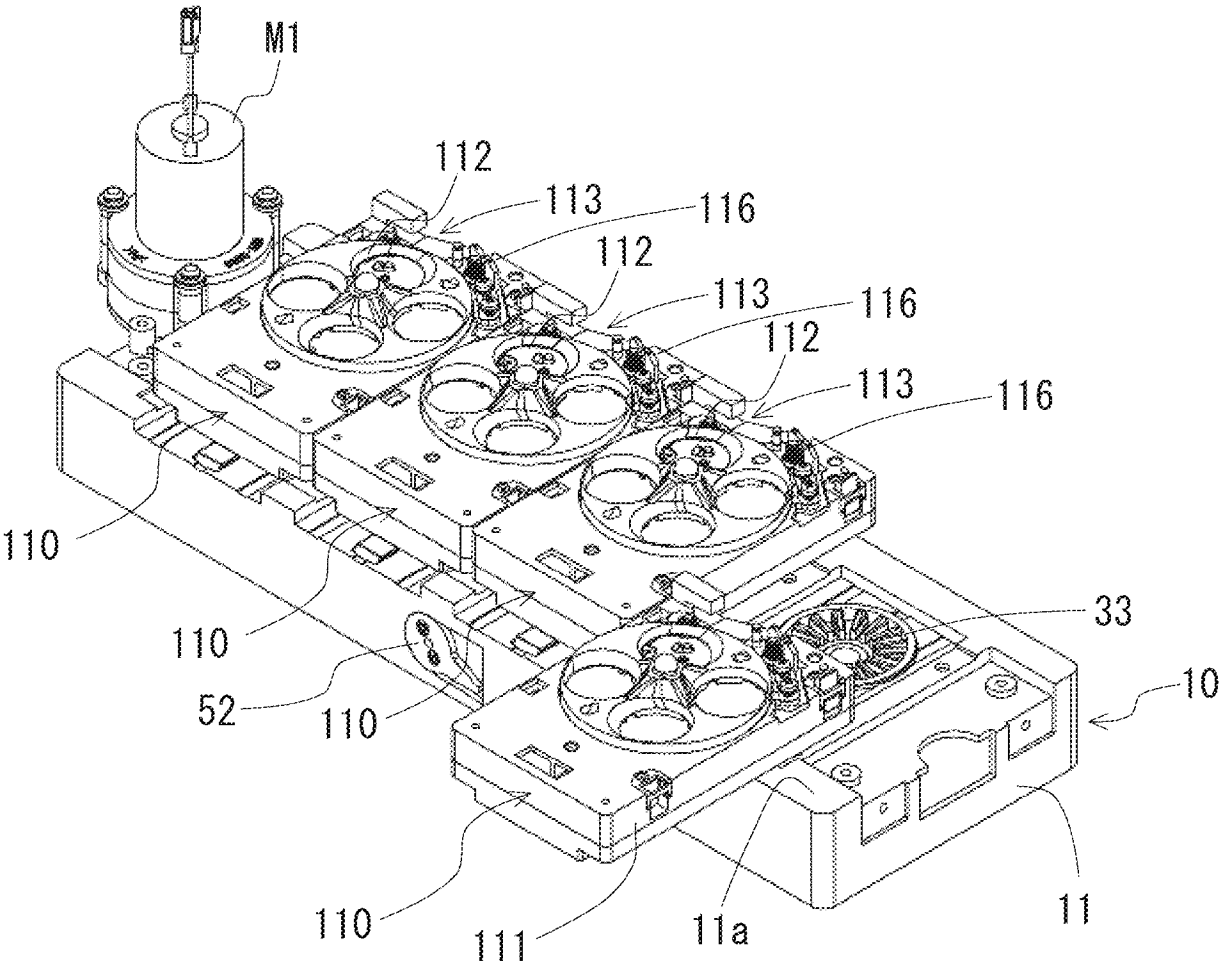
FIG. 22 is a perspective view showing the situation where the fourth coin ejection unit is detached from the chassis or base by sliding the same along the mounting surface after entering the non-operable mode in the multi-unit coin ejection apparatus of FIG. 1.
Figure 23A:
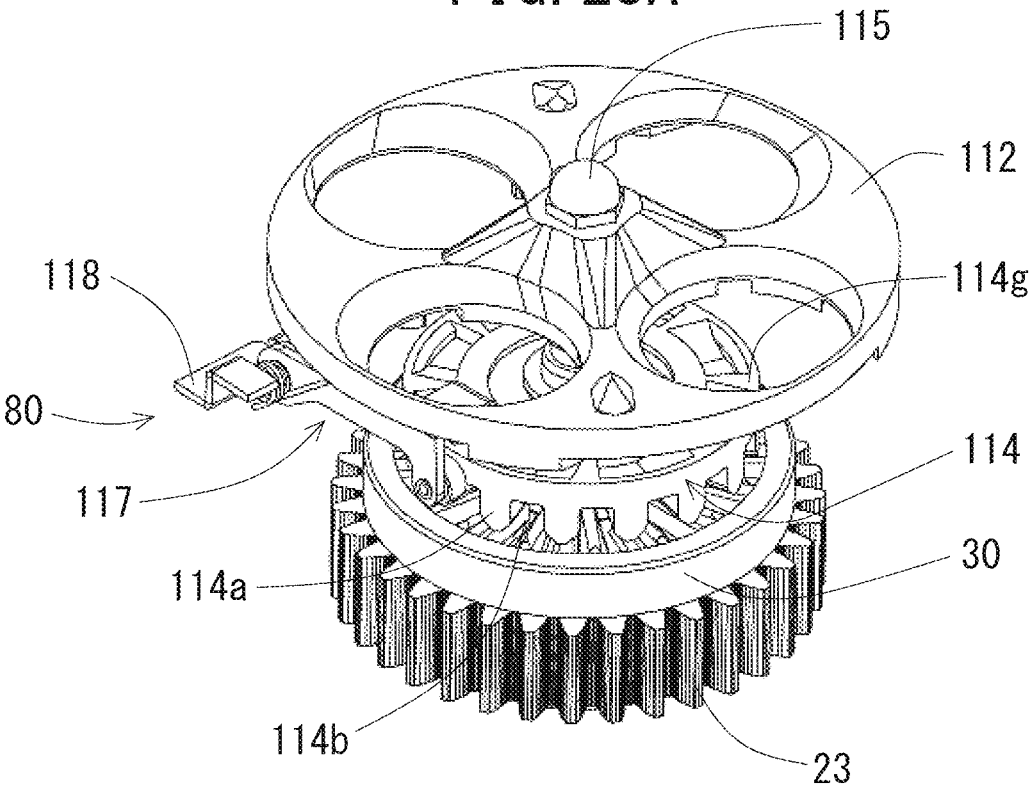
FIG. 23A is a perspective view showing the structure of an unnecessary rotation prevention mechanism of the multi-unit coin ejection apparatus of FIG. 1, which shows the positional relationship between a rotary disk which is fixed to a rotation shaft of the coin ejection unit and the unnecessary rotation prevention mechanism in the non-driving state.
Figure 23B:
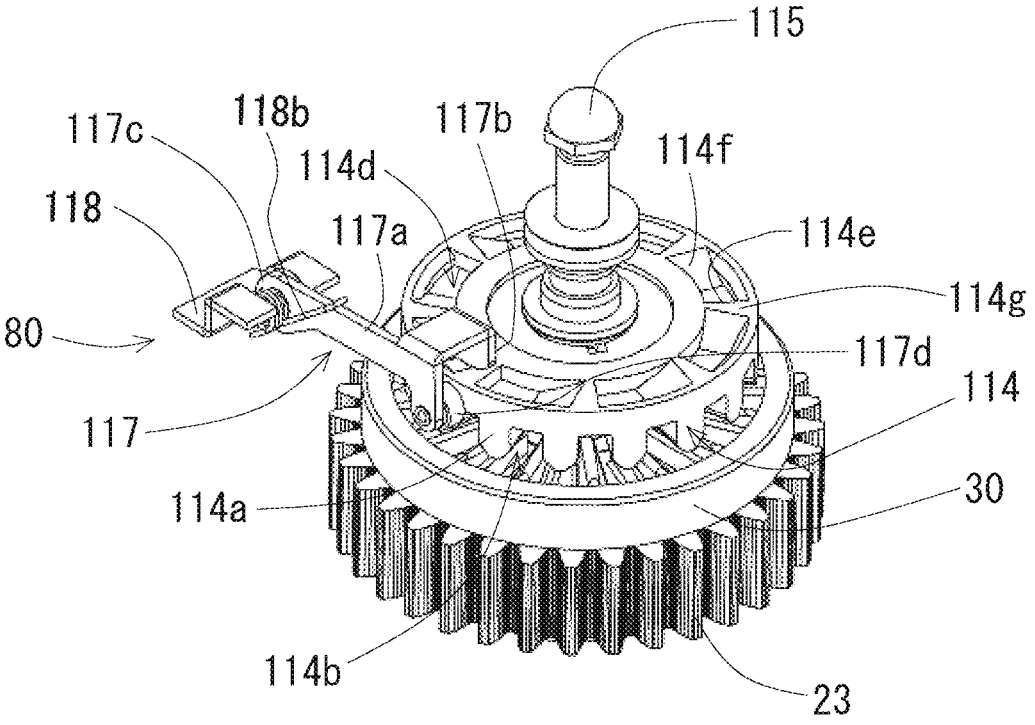
FIG. 23B is a perspective view showing the structure of the unnecessary rotation prevention mechanism of FIG. 23A, which shows the engagement state of an engaging part and a roller of an unnecessary rotation prevention member with corresponding two coupling gears in the non-driving state.

In this first embodiment, the state where the driving force of the first motor M1 is transmitted to none of the first to fourth coin ejection units 110 can be set. When the state where the driving force of the first motor M1 is transmitted to any one of the first to fourth coin ejection units 110 (in other words, a coin is ejected from the relevant unit 110) is termed the "operable mode", the state where the driving force of the first motor M1 is transmitted to none of the first to fourth coin ejection units 110 may be termed the "non-operable mode". In the "non-operable mode", all of the first to fourth coin ejection units 110 are mechanically disconnected from the driving mechanism 20, as shown in FIG. 21 and therefore, there arises an advantage that a desired one of the four coin ejection units 110 can be easily removed from the chassis 11 by sliding the desired unit 110 along the mounting surface 11*a*, It is needless to say that this "non-operable mode" may be omitted.

Figure 14:
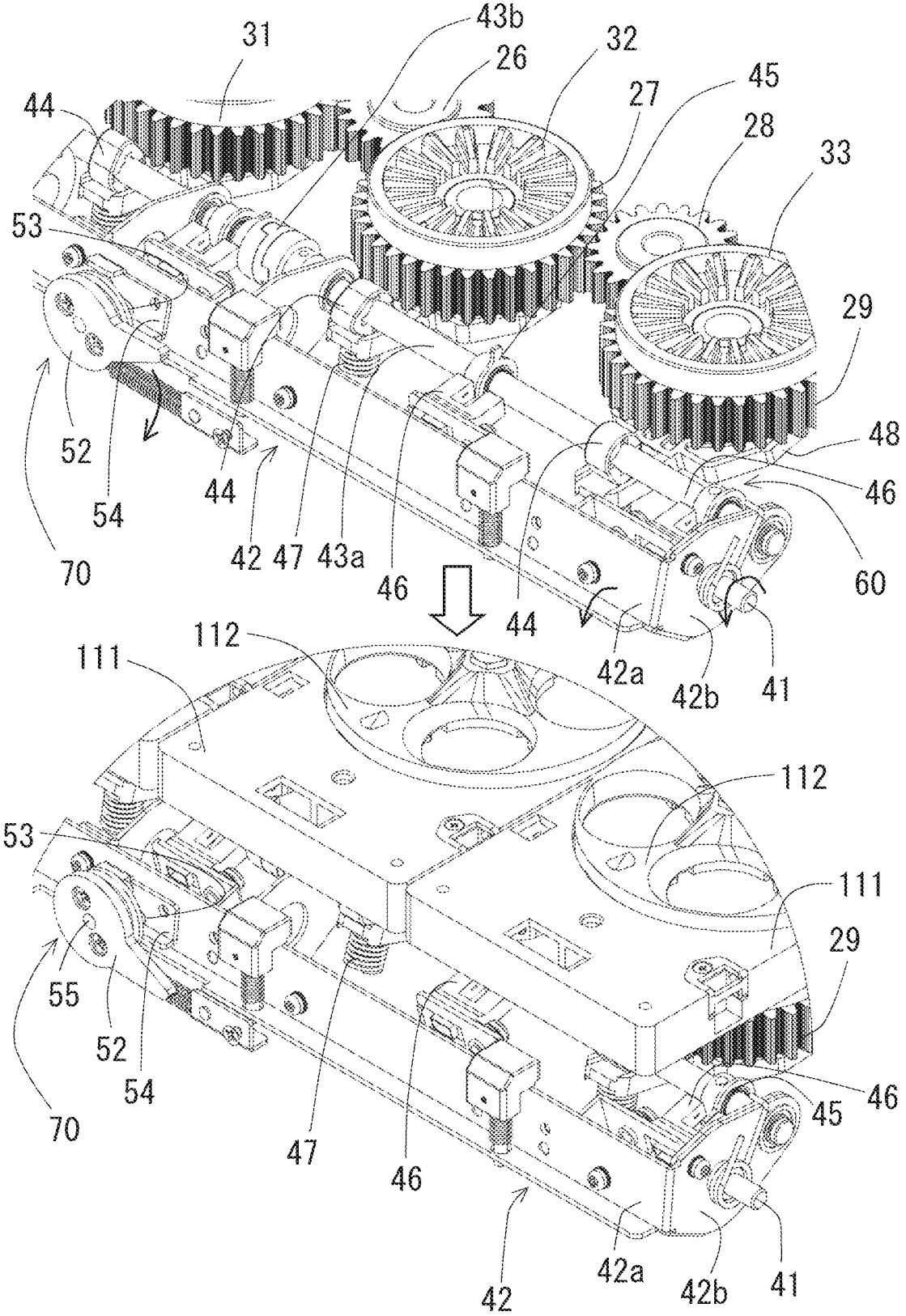
FIG. 14 is an explanatory view showing the switching operation of the multi-unit coin ejection apparatus of FIG. 1 between an operable mode and a non-operable mode by a rocking motion of the switching unit around a support shaft, in which the upper part shows the state of the said apparatus in the operable mode and the lower part shows the state thereof in the non-operable mode.

In this embodiment, the shift or transition from the "operable mode" to the "non-operable mode" is realized by operating a lever 52 which is rockably provided on the front side face of the chassis 11, as shown in FIG. 14. Specifically, the lever 52 having an operating member or piece 53 which is fixed to its back is rockably supported by a rocking shaft 55 fixed to the chassis 1. The operating member or piece 53 of the lever 52 is displaced downward along with the downward motion of the lever 52. Since a frame rocking member 54 is fixed to the frame body 42*a* on the back side of the lever 52 in such a way as to be overlapped with the lever 52, the frame rocking member 54 is pressed downward along with the downward motion of the lever 52. In this state, the entire frame 42 is slightly moved forward around the two supporting shafts 41 which are disposed at the respective ends of the frame 42 and thus, the camshaft 43 which is supported by the frame 42 is slightly displaced upward and the distances between the four cams 44 and their corresponding four cam followers 48 are increased. As a result, as shown in FIG. 7, all of the branching parts 48*a* of the cam followers 48 are moved downward by the elastic forces of the relevant springs 47 disposed just below the corresponding cam receiving parts 48*a*. Due to this lowering motion of the branching parts 48*a*, the four driven gears 23, 25, 27, and 29 and their corresponding coupling gears 30, 31, 32, and 33 are moved downward collectively. In this state, the driving force of the first motor M1 is no longer transmitted to all of the first to fourth coin ejection units 110 regardless of the positions of the protruding parts of the four cams 44. This means that the transition to the "non-operable mode" from the "operable mode" is completed in this way. The return to the "operable mode" can be easily carried out by operating the lever 52 upward to its initial position.

The lever 52 which is rockable around the rocking shaft 55 fixed to the chassis 1, the operating member 53 which is fixed to the back of the lever 52, and the frame rocking member 54 which is fixed to the frame body 42*a* on the back side of the lever 52 constitute a switching unit displacement mechanism 70 for relatively displacing the switching unit 40 with respect to the driving mechanism 20. The lever 52 functions as a manipulating member of the mechanism 70 and the operating member 53 functions as a moving member of the mechanism 70. The switching unit displacement mechanism 70 displaces the switching unit 40 with respect to the driving mechanism 20 between the "connection position" where the driving force of the first motor M1 can be selectively transmitted to any one of the first to fourth coin ejection units 110 and the "separation position" where the driving force of the first motor M1 can be transmitted to none of the first to fourth coin ejection units 110. Accordingly, when the switching unit displacement mechanism 70 is disposed at the "connection position", the multi-unit coin ejection apparatus 1 is placed in the aforementioned "operable mode". When the mechanism 70 is moved to the "separation position", the apparatus 1 is shifted to the aforementioned "non-operable mode". When the mechanism 70 is returned to the "connection position", the apparatus 1 is returned to the "operable mode".

As explained above, the action for causing a desired displacement of the switching unit 40 using the switching unit displacement mechanism 70 is realized using only the mechanical structure and its function and therefore, electronic control by the control device for the multi-unit coin ejection apparatus 1 is unnecessary at all. For this reason, there is no need to conduct the control operation for interrupting and recoupling the selective transmission of the driving force of the first motor M1 to the coin ejection units 10 by sending predetermined signals when detaching a desired one of the coin ejection units 110 from the chassis 11 for check and/or exchanging a desired one of the coin ejection units 110 for a new one. Moreover, the switching unit displacement mechanism 70 is simplified, produced at low cost, unlikely to malfunction, and likely to have desired durability.

In addition, on the back of the lever 52 as one of the structural elements of the switching unit displacement mechanism 70, a lock pin (not shown) is provided to surely fix the lever 52 to the stop position of the lever 52 in the operable mode (i.e., the position shown in the upper part of FIG. 14). This is to prevent the malfunction that engagement or connection between the four coupling gears 30, 31,32, and 33 (which correspond to the second coupling gears) and the corresponding coupling gears 114 (which correspond to the first coupling gears) is released or becomes insufficient due to the displacement of the lever 52 to its stop position in the non-operable mode (i.e., the position shown in the lower part of FIG. 14) or that to a deviated position from the stop position of the lever 52 in the operable mode, where these displacements are caused by unintentional manipulation applied to the lever 52 when the multi-unit coin ejection apparatus 1 is placed in the operable mode. Since the lock pin is mounted, the malfunction induced by a misoperation of the switching unit displacement mechanism 70 can be surely prevented and as a result, safety is greatly improved. Thus, it is preferred to provide the lock pin.

Next, the aforementioned one-way clutch 119 and the unnecessary rotation prevention mechanism 80 using this clutch 119 will be explained below with reference to FIGS. 23A to 29.

Figure 24A:
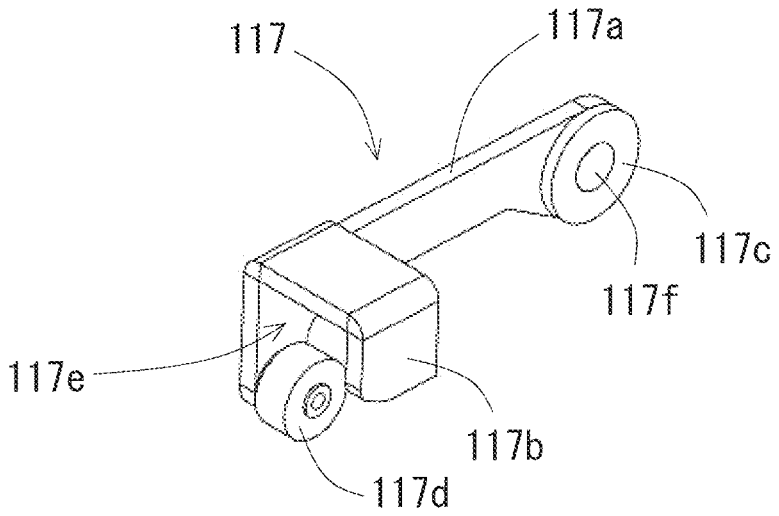
FIG. 24A is a perspective view showing an example of the structure of the unnecessary rotation prevention member of FIG. 23B, which is seen obliquely downward from the upper rear.
Figure 24B:
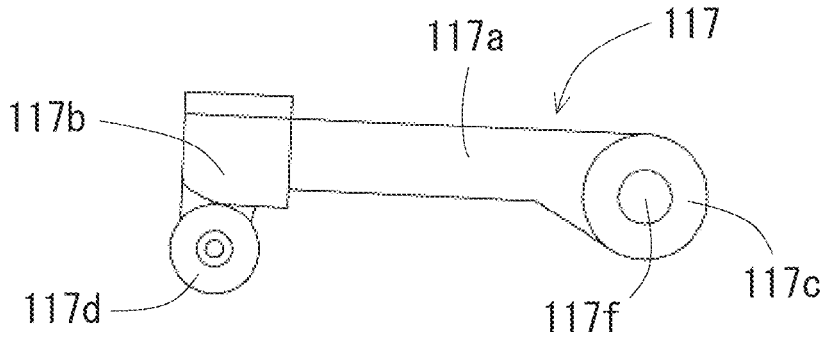
FIG. 24B is a side view showing the example of the structure of the unnecessary rotation prevention member of FIG. 23B.
Figure 24C:
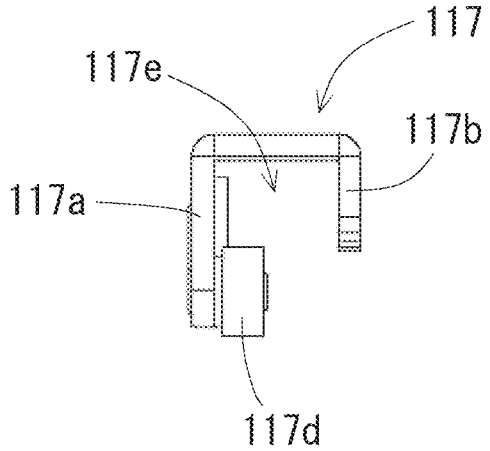
FIG. 24C is a rear view showing the example of the structure of the unnecessary rotation prevention member of FIG. 23B.
Figure 25B:
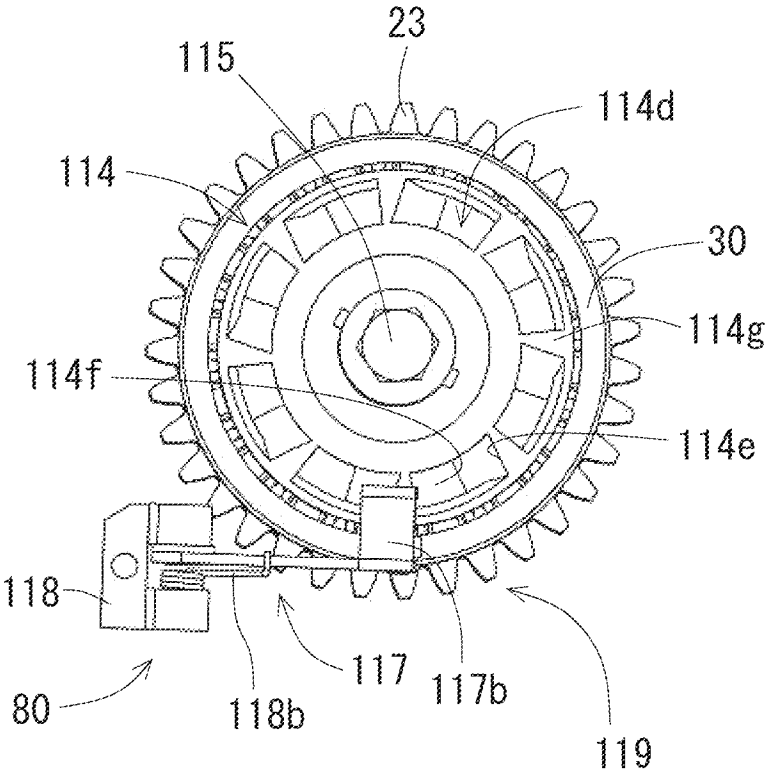
FIG. 25B is a plan view showing the engagement state of the engaging part and the roller of the unnecessary rotation prevention member with the corresponding two coupling gears in the multi-unit coin ejection apparatus of FIG. 1, where the relevant coin ejection unit is in the non-driving state.
Figure 25A:
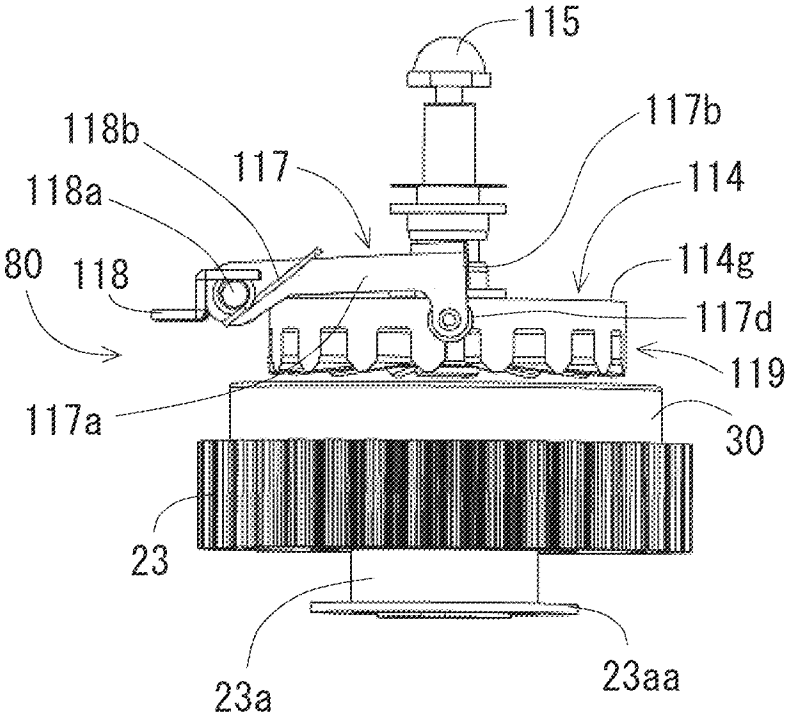
FIG. 25A is a side view showing the engagement state of the engaging part and the roller of the unnecessary rotation prevention member with the corresponding two coupling gears in the multi-unit coin ejection apparatus of FIG. 1, where the relevant coin ejection unit is in the non-driving state.
Figure 26B:
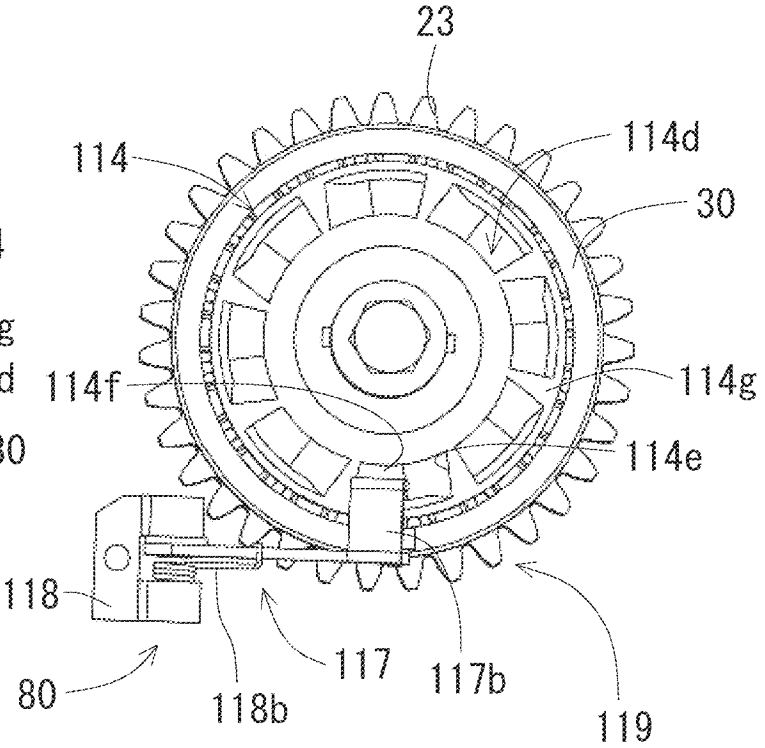
FIG. 26B is a plan view showing the engagement state of the engaging part and the roller of the unnecessary rotation prevention member with the corresponding two coupling gears in the multi-unit coin ejection apparatus of FIG. 1, where the relevant coin ejection unit is in the driving state.
Figure 26A:
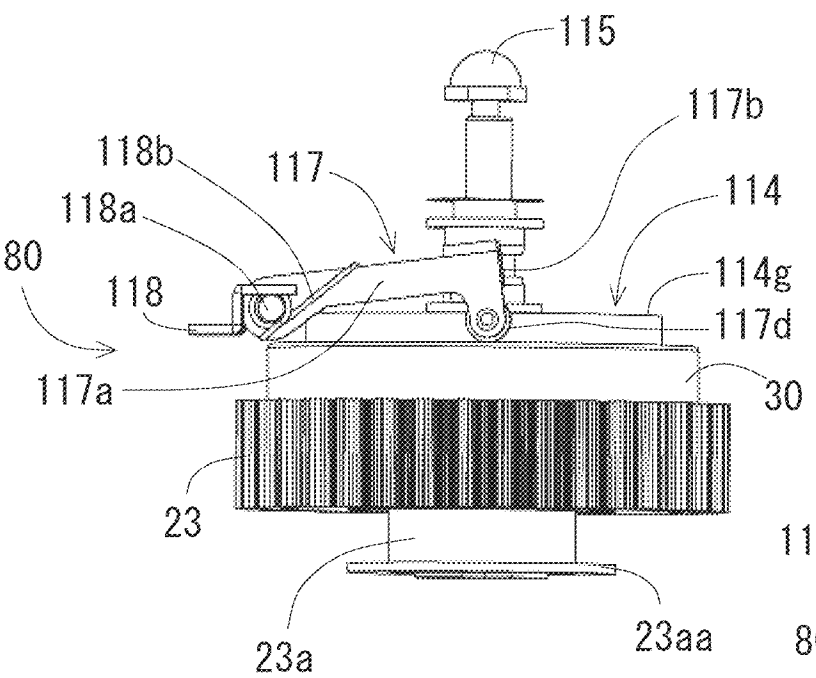
FIG. 26A is a side view showing the engagement state of the engaging part and the roller of the unnecessary rotation prevention member with the corresponding two coupling gears in the multi-unit coin ejection apparatus of FIG. 1, where the relevant coin ejection unit is in the driving state.
Figure 27B:
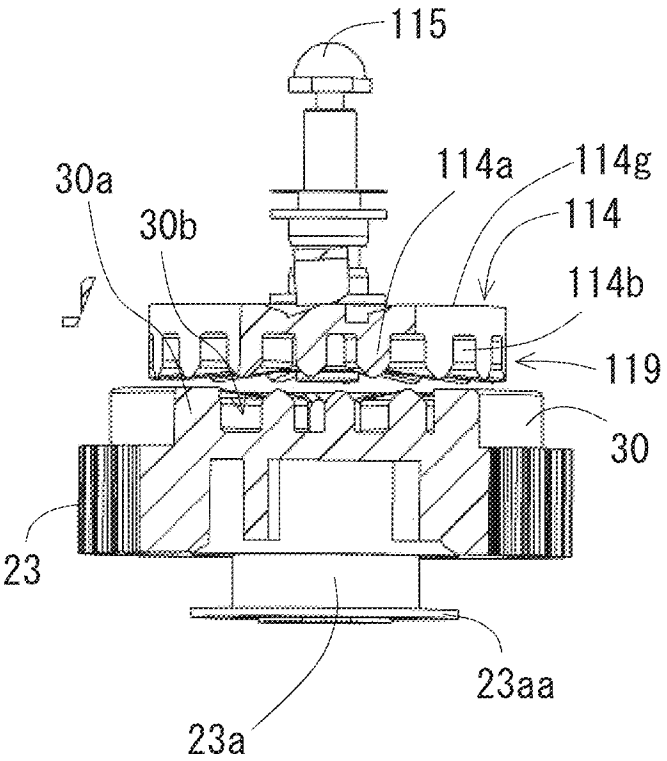
FIG. 27B is a cross-sectional view along the line XXVIIB-XXVIIB in FIG. 27A.
Figure 27A:
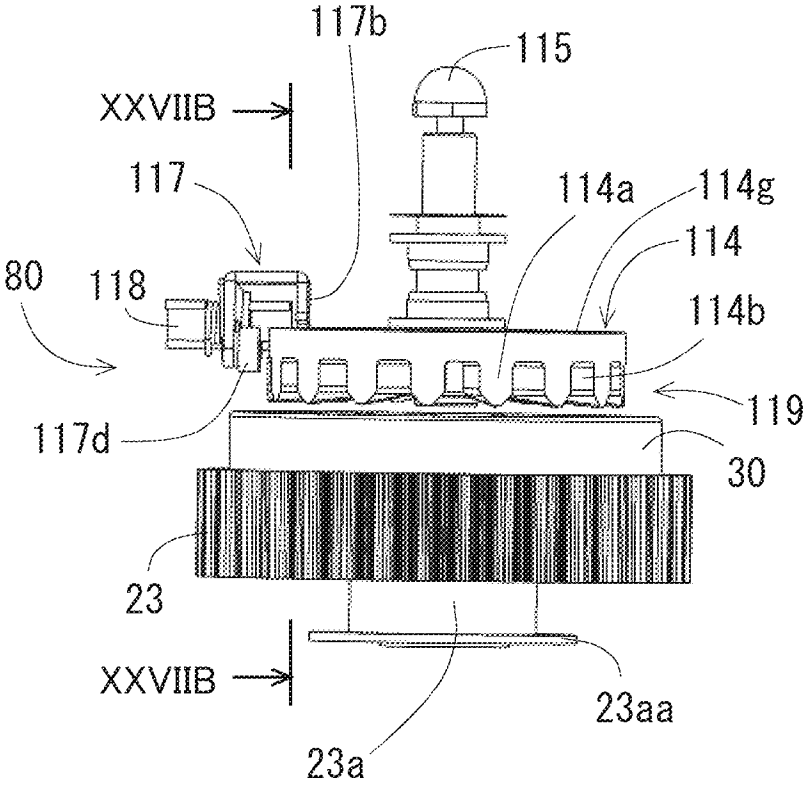
FIG. 27A is a front view showing the engagement state of the engaging part and the roller of the unnecessary rotation prevention member with the corresponding two coupling gears in the multi-unit coin ejection apparatus of FIG. 1, where the relevant coin ejection unit is in the non-driving state.
Figure 28B:
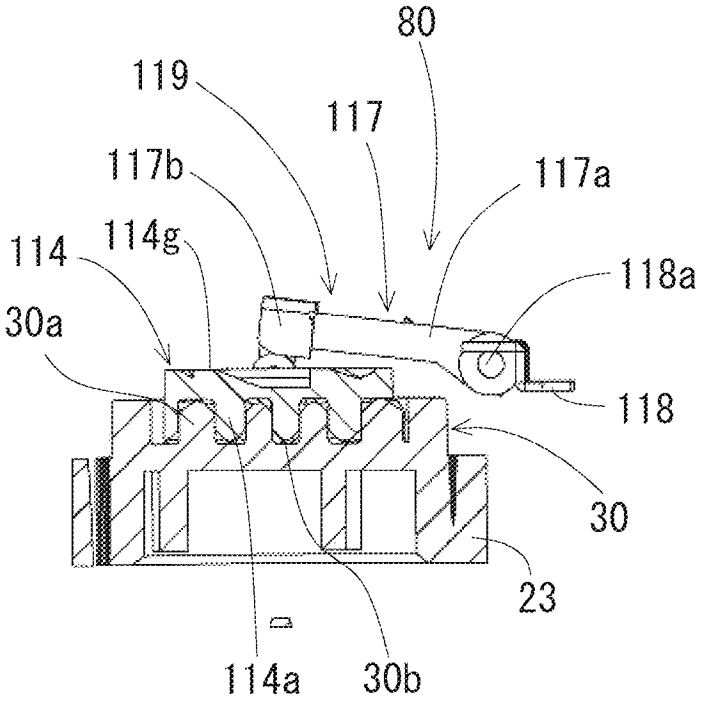
FIG. 28B is a cross-sectional view along the line XXVIIIB-XXVIIIB in FIG. 28A.
Figure 28A:
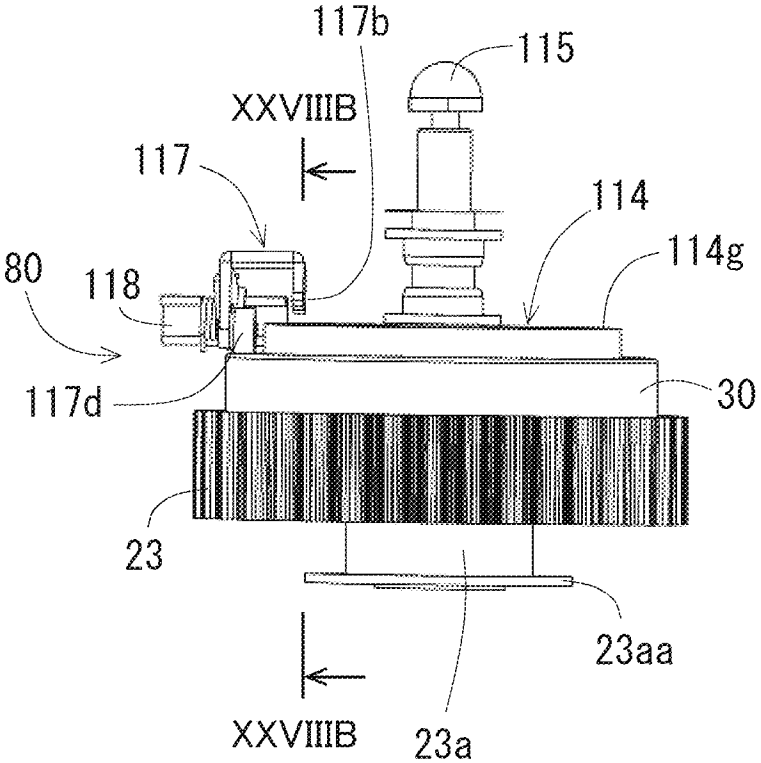
FIG. 28A is a front view showing the engagement state of the engaging part and the roller of the unnecessary rotation prevention member with the corresponding two coupling gears in the multi-unit coin ejection apparatus of FIG. 1, where the relevant coin ejection unit is in the driving state.

The reason why the one-way clutch 119 is provided is to prevent the phenomenon that when the coupling gear 114 and the corresponding coupling gear 30, 31, 32, or 33 are not coupled (see FIGS. 25A and 25B and FIGS. 27A and 27B), unintentional idling (i.e., unnecessary normal rotation) of the said coupling gear 114 is caused to result in undesired or unnecessary dispensing. In this first embodiment, an unnecessary rotation prevention member 117 having the structure shown in FIGS. 24A, 243, and 240 is provided to realize the aforementioned function of the one-way clutch 119. The member 117 having such the structure is placed in such a way as to have the positional relationship shown in FIGS. 23A and 233 with the coupling gears 114 and 23.

As shown in FIGS. 24A to 240, the unnecessary rotation prevention member 117 comprises a body 117*a*, an engaging part 117*b* fixed to the top end of the body 117*a*, a supporting part 117*c* formed at the base end of the body 117*a*, and a roller 117*d* rotatably mounted on the top end of the body 117*a*. A vacant space or gap 117*e* is formed between the engaging part 117*b* and the opposing part of the body 117*a* to the engaging part 117*b*. The roller 117*d* is rotatably supported by the body 117*a* at the position right below the vacant space 117*e*. When the relevant coupling gear 114 and the corresponding coupling gear 30, 31, 32, or 33 are not coupled (see FIGS. 25A and 25B and FIGS. 27A and 27B), the vacant space 117*e* of the unnecessary rotation prevention member 117 is overlapped with the outer peripheral part of the coupling gear 114, in which the lower end of the engaging part 117*b* is engaged with one of the engagement holes 114*d* of the coupling gear 114. Since each of the engagement holes 114*d* has the perpendicular end 114*e* on the one side and the inclined end 114*f* on the other side, the rotation of the relevant coupling gear 114 is permitted in the direction where the lower end of the engaging part 117*b* abuts on the inclined end 114*f* and is prevented in the direction where the lower end of the engaging part 117*b* abuts on the perpendicular end 114*e*. In this way, the function of the one-way clutch 119 is realized by the combination of the engaging part 117*b* of the unnecessary rotation prevention member 117 and the engagement holes 114*d* of the relevant coupling gear 114.

Specifically, in the case where the rotation direction of the relevant coupling gear 114 is a direction where the lower end of the engaging part 117*b* abuts on the perpendicular end 114*e* of the engagement holes 114*d* (for example, the opposite direction to the coin ejection direction), the motion of the lower end of the engaging part 117*b* is restrained by the abutment between the said lower end and the said perpendicular end 114*e* and as a result, the rotation of the said coupling gear 114 in this direction is prevented. On the other hand, in the case where the rotation direction of the relevant coupling gear 114 is a direction where the lower end of the engaging part 117*b* abuts on the inclined end 114*f* of the engagement holes 114*d* (for example, the coin ejection direction), the lower end of the engaging part 117*b* is able to slide upward on the inclined end 114*f* and then, to ride over the top (i.e., the engagement face 114*g*) of the said inclined end 114*f*; as a result, the rotation of the said coupling gear 114 in this direction is permitted. The function of the one-way clutch 119 (the unnecessary rotation prevention mechanism 80) is realized in this way.

When the lower end of the engaging part 117*b* which is engaged with one of the engagement holes 114*d* of the relevant coupling gear 114 rides over the top of the inclined end 114*f* to arrive at the next engagement hole 114*d* and is engaged with the same again, the engaging part 117*b* of the unnecessary rotation prevention member 117 is displaced upward and downward (i.e., displaced vertically). Thus, to make this displacement possible, a through hole 117*f* is formed in the supporting part 117*c* of the member 117. A support shaft 118*a* is inserted into the through hole 117*f*. The support shaft 118*a* is supported by a supporting member 118 which is fixed to the inner surface of the chassis 11. The member 117 is rockably supported on the inner surface of the chassis 11 using the supporting member 118 in this way.

When the relevant coupling gear 114 and the corresponding coupling gear 30, 31, 32, or 33 are coupled (see FIGS. 26A and 26B and FIGS. 28A and 28B), the lower face of the roller 117*d* is contacted with the peripheral part of the corresponding coupling gear 30, 31, 32, or 33. For this reason, in this coupling state, the roller 117*d* is displaced to an upper position from the lower position in the non-coupling state. Accordingly, the engaging part 117*b* of the unnecessary rotation prevention member 117 is detached from the relevant engagement hole 114*d* and thus, the engagement between the said engaging part 117*b* and the said relevant engagement hold 114*d* is eliminated. As a result, the function of the one-way clutch 119 (and the unnecessary rotation prevention mechanism 80) is stopped (i.e., the function of the one-way clutch 119 is disabled) and thus, not only the normal rotation of the relevant coupling gear 114 (and the relevant rotary disk 112) but also the reverse rotation thereof are possible. In this way, the unnecessary rotation prevention mechanism 80 is configured in such a way as to be effective or enabled only for the coupling gears 114 of the coin ejection units 110 which are placed in the non-driving state and to be ineffective or disabled for the coin ejection operation and the malfunction elimination operation of the coin ejection unit 110 which is placed in the driving state.

A spring 118*b* that urges downward the body 117*a* and the engaging part 117*b* of the engaging part 117*b* of the unnecessary rotation prevention member 117 is attached to the supporting shaft 118*a* which is supported by the supporting member 118. Since the downward pressing force is always applied to the engaging part 117*b*, the engaging part 117*b* is surely engaged with any one of the engagement holes 114*d* when the relevant coupling gear 114 is not coupled with the corresponding coupling gear 30, 31, 32, or 33 (see FIGS. 25A and 25B and FIGS. 27A and 27B). Accordingly, the one-way clutch 119 (and the unnecessary rotation prevention mechanism 80) operates with high-level reliability. Moreover, when the relevant coupling gear 114 is coupled with the corresponding coupling gear 30, 31, 32, or 33 (see FIGS. 26A and 26B and FIGS. 28A and 28B), the engaging part 117*b* is easily displaced upward by the corresponding coupling gear 30, 31, 32, or 33 against the elastic force of the spring 18*b* and as a result, the engagement between the engaging part 117*b* and one of the engagement holes 117*d* is surely eliminated.

The combination of the unnecessary rotation prevention member 117 having the aforementioned structure and function and the engagement holes 114*d* (each of which comprises the perpendicular end 114*e* and the inclined end 114*f*) formed on the relevant coupling gear 114 constitutes the unnecessary rotation prevention mechanism 80 that prevents the unnecessary rotation (normal rotation) of the rotary disk 112 provided in each of the first to fourth coin ejection units 110. This mechanism 80 includes the function of conducting and stopping the function of the one-way clutch 119 (i.e., the ON/OFF function of the clutch 119) in response to the displacement of each of the coin ejection units 110 between the driving state (see FIGS. 26A and 26B and FIGS. 28A and 28B) and the non-driving state (see FIGS. 25A and 25B and FIGS. 27A and 27B). The ON/OFF switching of the one-way clutch 119 is carried out by the coupling gear displacement mechanism 60 (which includes the four cams 44, the camshaft 43, and the four cam followers 48).

As explained above, with the unnecessary rotation prevention mechanism 80, when the relevant coin ejection unit 110 is in the non-driving state, the engaging part 117*b* of the unnecessary rotation prevention member 117 is engaged with one of the engagement holes 114*d* located in the engagement surface 114*g* of the corresponding coupling gear 114 and thus, the function of the one-way clutch 119 is performed. Because of this function, the unnecessary rotation of the relevant rotary disk 112 in the predetermined coin ejection direction (i.e., the unnecessary normal rotation) is prevented and at the same time, the rotation of the said disk 112 in the opposite direction to the coin ejection direction (i.e., the reverse rotation direction) is permitted. Moreover, when the relevant coin ejection unit 110 is in the driving state, the function of the one-way clutch 119 is unnecessary. Therefore, in response to the transition or shift of the relevant coin ejection unit 110 to the driving state from the non-driving state, the engaging part 117*b* of the unnecessary rotation prevention member 117 is disengaged from the one of the engagement holes 114*d* of the corresponding coupling gear 114 and thus, the function of the one-way clutch 119 (the unnecessary rotation prevention mechanism 80) is stopped. In this way, the unnecessary rotation prevention mechanism 80 surely prevents the unintentional normal rotation of the rotary disk 112 (which leads to incorrect coin dispensing) in each of the coin ejection units 110 which are placed in the non-driving state without affecting the normal and reverse rotations of the rotary disk 112 of the coin ejection unit 110 which is placed in the driving state.

Operation of Multi-Unit Coin Ejection Apparatus 1

Next, the coin ejection operation of the multi-unit coin ejection apparatus 1 according to the first embodiment of the present invention having the aforementioned structure will be explained below with reference to FIGS. 15A to 15D.

FIGS. 15A to 15D show the situation change where the driving state and the non-driving state of the fourth coin ejection unit 110 are switched in order in accordance with the rotational position (the rotational angle) of the corresponding cam 44 included in the switching unit 40 of the multi-unit coin ejection apparatus 1 while the said cam 44 is rotated once. In the following explanation, the situation change that occurs while the camshaft 43 is rotated counterclockwise once, as shown in FIGS. 15A to 15D, will be described.

Figure 15A:
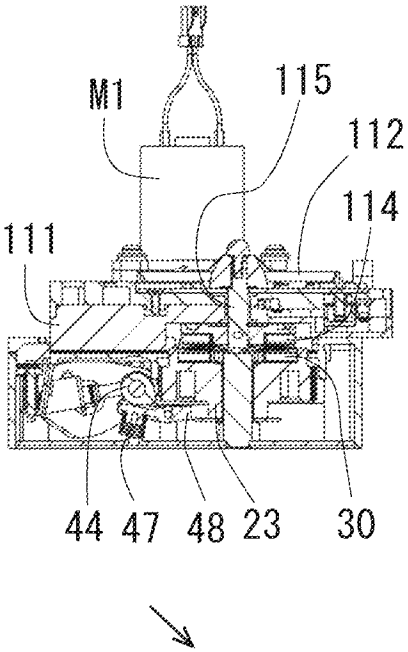
FIG. 15A is a cross-sectional view showing the switching operation of a fourth coin ejection unit of the multi-unit coin ejection apparatus of FIG. 1 between a driving state and a non-driving state according to a rotation position (or a rotation angle) of cams included in the switching unit, in which the cam end is directed diagonally downward right and the fourth coin ejection unit is in the non-driving state.

First, as shown in FIG. 15A, when the protruding part of the cam 44 (the cam end) is in a diagonally downward right direction, the cam receiving part 48*a* of the cam follower 48 corresponding to the said cam 44 is disposed at its upper position. This is because the said cam receiving part 48*a* is always pressed upward by the elastic force of the corresponding spring 47 which is just below the said cam receiving part 48*a*. In this state, the branching part 48*b* of the said cam follower 48 is disposed at its lower position, and the coupling gear 114 of the fourth coin ejection unit 110 is apart or disconnected from the corresponding coupling gear 33 of the driving mechanism 20 (which is disposed at the non-driving position) and therefore, these two coupling gears 114 and 33 are not coupled. Accordingly, the driving force of the first motor M1 is not transmitted to the coupling gear 114 of the fourth coin ejection unit 110, which means that no coin ejection occurs from the said unit 110.

Figure 15B:
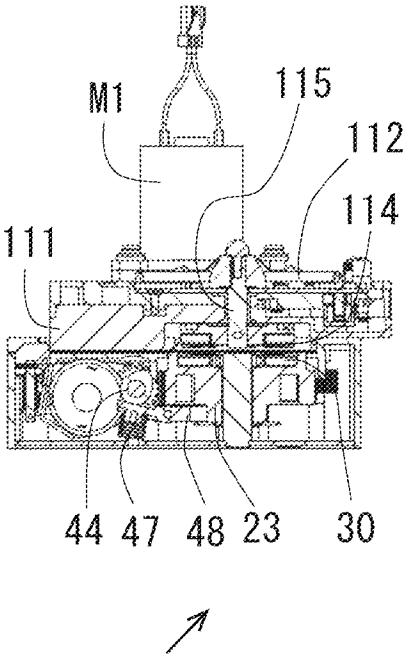
FIG. 15B is a cross-sectional view showing the switching operation of the fourth coin ejection unit of the multi-unit coin ejection apparatus of FIG. 1 between the driving state and the non-driving state, in which the cam end is directed diagonally upward right and the fourth coin ejection unit is in the non-driving state.

Next, when the camshaft 43 is rotated counterclockwise by 90° from the position of FIG. 15A, in other words, the phase of the camshaft 43 is advanced by 90°, the protruding part of the said cam 44 is turned to a diagonally upward right direction, as shown in FIG. 15B. At this time, the cam receiving part 48*a* of the said cam follower 48 is disposed at its upper position, which is the same as the state of FIG. 15A, In this state also, the branching part 48*b* of the said cam follower 48 is disposed at its lower position and therefore, the coupling gear 114 of the fourth coin ejection unit 110 is disconnected from the corresponding coupling gear 33 of the driving mechanism 20, which means that these two coupling gears 114 and 33 are not coupled and the said unit 110 is placed in the non-driving stare. For this reason, the driving force of the first motor M1 is not transmitted to the coupling gear 114 of the fourth coin ejection unit 110 and no coin ejection occurs from the said unit 110. This is the same as the state of FIG. 15A.

Figure 15C:
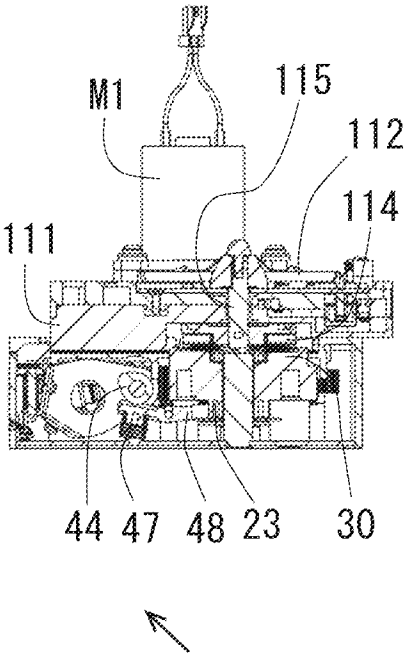
FIG. 15C is a cross-sectional view showing the switching operation of the fourth coin ejection unit of the multi-unit coin ejection apparatus of FIG. 1 between the driving state and the non-driving state, in which the cam end is directed diagonally upward left and the fourth coin ejection unit is in the non-driving state.
Figure 15D:
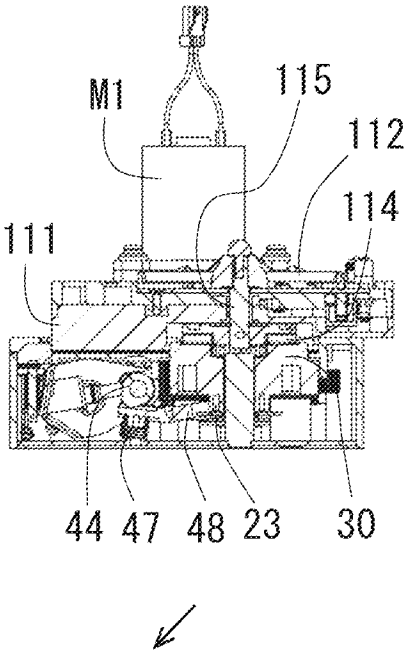
FIG. 15D is a cross-sectional view showing the switching operation of the fourth coin ejection unit of the multi-unit coin ejection apparatus of FIG. 1 between the driving state and the non-driving state, in which the cam end is directed diagonally downward left and the fourth coin ejection unit is in the driving state.

Following this, when the camshaft 43 is further rotated counterclockwise by 90° from the position of FIG. 15B, in other words, the phase of the camshaft 43 is advanced by 180° from the position of FIG. 15A, the protruding part of the said cam 44 is turned to a diagonally upward left direction, as shown in FIG. 15C. At this time also, the cam receiving part 48*a* of the said cam follower 48 is kept at its upper position, which is the same as the state of FIG. 15A. In this state also, the branching part 48*b* of the said cam follower 48 is kept at its lower position and therefore, the coupling gear 114 of the fourth coin ejection unit 110 is kept disconnected from the corresponding coupling gear 33 of the driving mechanism 20, which means that these two coupling gears 114 and 33 are kept non-coupled and the said unit 110 is kept in the non-driving stare. For this reason, in the state of FIG. 150 also, the driving force of the first motor M1 is not transmitted to the coupling gear 114 of the fourth coin ejection unit 110 and no coin ejection occurs from the said unit 110.

Finally, when the camshaft 43 is further rotated counterclockwise by 90° from the position of FIG. 150, in other words, the phase of the camshaft 43 is advanced by 270° from the position of FIG. 15A, the protruding part of the said cam 44 is turned to a diagonally downward left direction, as shown in FIG. 150. At this time, the cam receiving part 48*a* of the said cam follower 48 is moved to its lower position, which is different from the states of FIGS. 15A to 15C. This is because the said cam receiving part 48*a* of the said cam follower 48 is pressed downward by the protruding part of the said cam 44 against the elastic force of the corresponding spring 47. Due to this downward motion of the said cam receiving part 48*a*, the branching part 48*b* of the said cam follower 48 is moved to its upper position. At this upper position, the coupling gear 114 of the fourth coin ejection unit 110 is coupled with the corresponding coupling gear 33 of the driving mechanism 20, which means that these two coupling gears 114 and 33 are coupled and the said unit 110 is placed in the driving stare. For this reason, in the state of FIG. 15D, the driving force of the first motor M1 is transmitted to the coupling gear 114 of the fourth coin ejection unit 110 and thus, desired coin ejection occurs from the said unit 110 in response to a dispensing instruction.

Figure 20B:
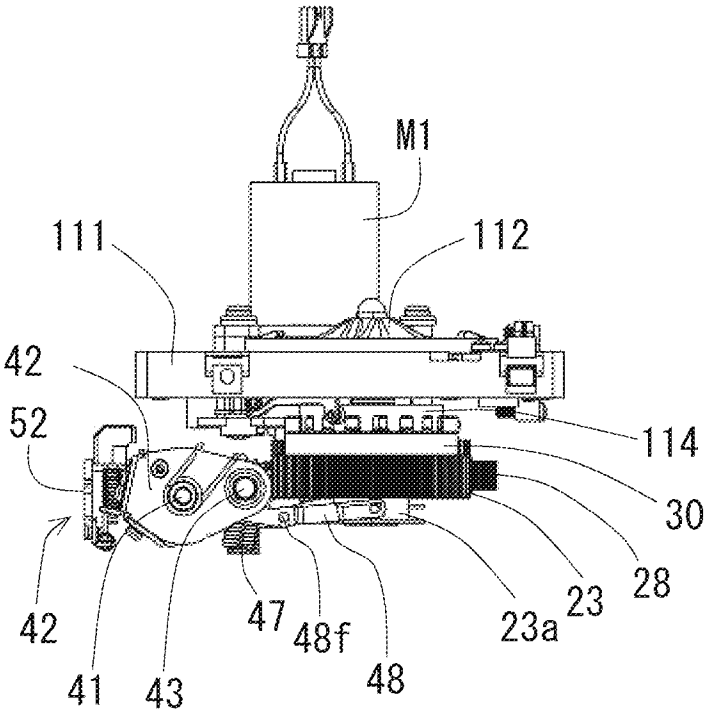
FIG. 20B is an explanatory view showing the relative positions of the coupling gear in the first coin ejection unit and the corresponding coupling gear on the driven gear, in which the relative positions in the non-driving (non-connected) state is shown.
Figure 20A:
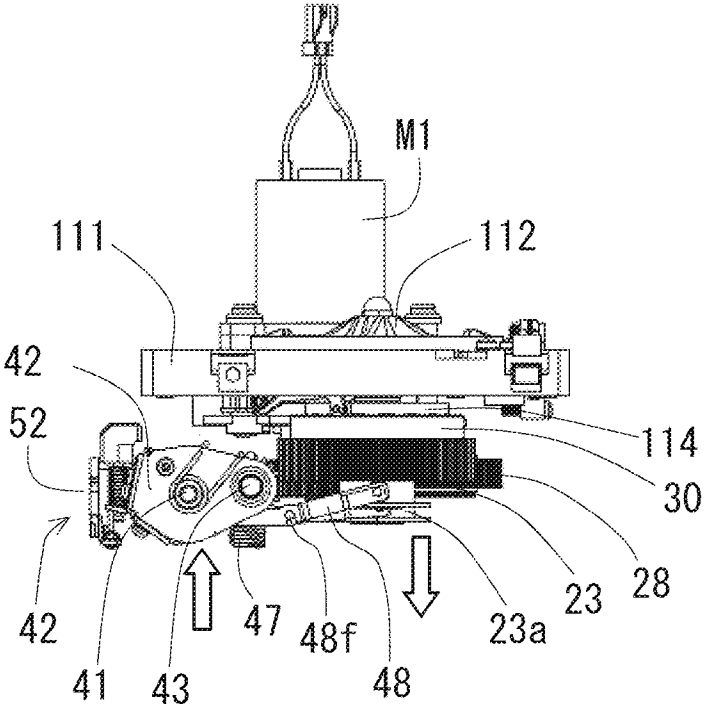
FIG. 20A is an explanatory view showing the relative positions of the coupling gear in the first coin ejection unit and the corresponding coupling gear fixed to the underlying driven gear, in which the relative positions in the driving (connected) state is shown.

As explained above, due to the rocking or rotation motion of the cam 44 which is caused by the rotation of the camshaft 43, the coupling gear 114 of the fourth coin ejection unit 110 is coupled with the corresponding coupling gear 33 of the driving mechanism 20 (i.e., the fourth coin ejection unit 110 is displaced to the driving state), as shown in FIG. 20A, or decoupled from the corresponding coupling gear 33 of the driving mechanism 20 (i.e., the fourth coin ejection unit 110 is displaced to the non-driving state), as shown in FIG. 20B, In this way, the coin ejection operation in the fourth coin ejection unit 110 can be performed only at the limited time when both of the relevant coupling gears 114 and 33 are coupled, i.e., the fourth coin ejection unit 110 is placed in the driving state. This is applicable to the first to third coin ejection units 110 also.

The situation where the coupling and non-coupling states between the four coupling gears 110 of the first to fourth coin ejection units 110 and the corresponding four coupling gears 30, 31, 32, and 33 of the driving mechanism 20 are changed by the rotation of the single camshaft 43 is shown in FIGS. 16 to 19.

Figure 16:
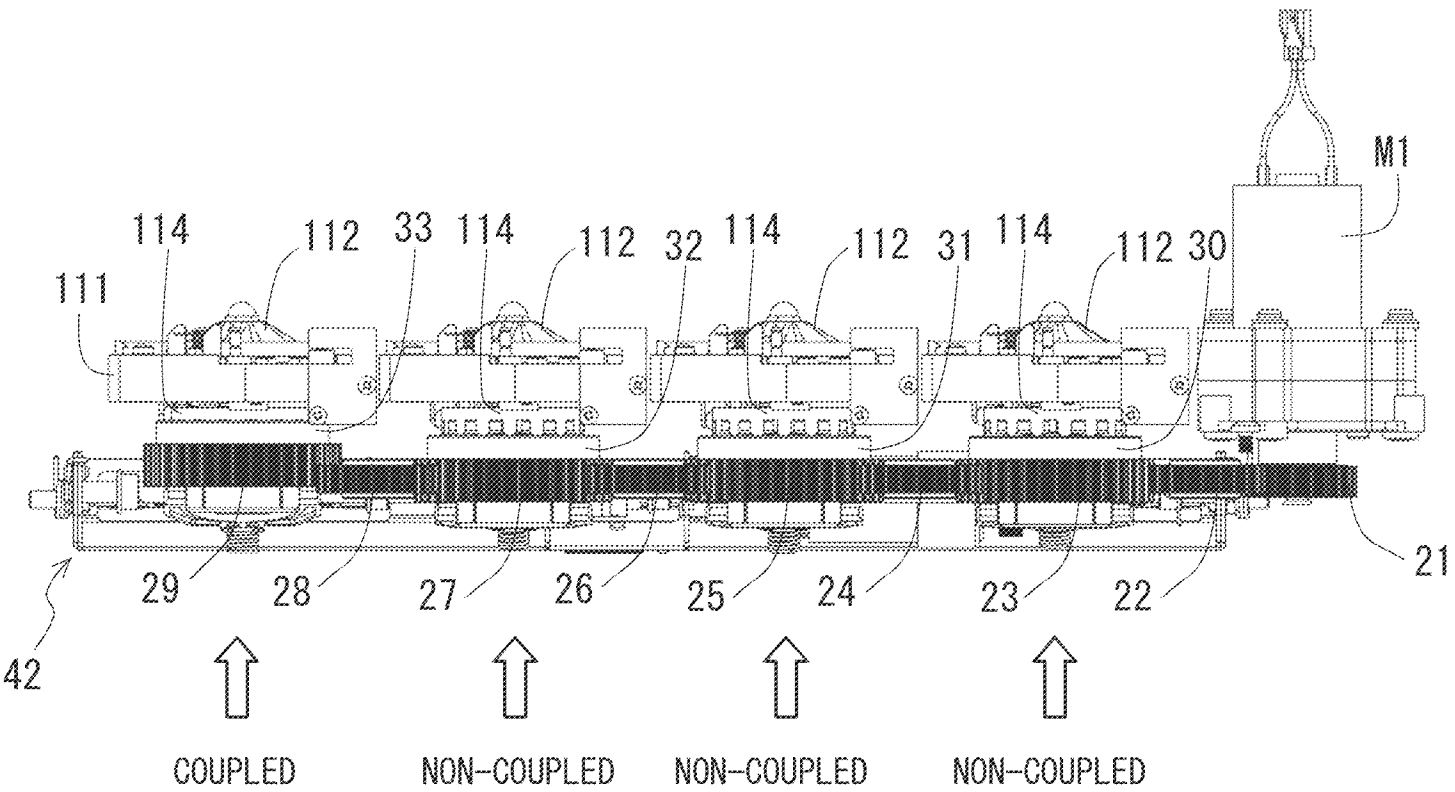
FIG. 16 is an explanatory view showing the driving/non-driving state of the first to fourth coin ejection units of the multi-unit coin ejection apparatus of FIG. 1, in which only the fourth coin ejection unit is in the driving state and the first to third coin ejection units are in the non-driving state.
Figure 17:
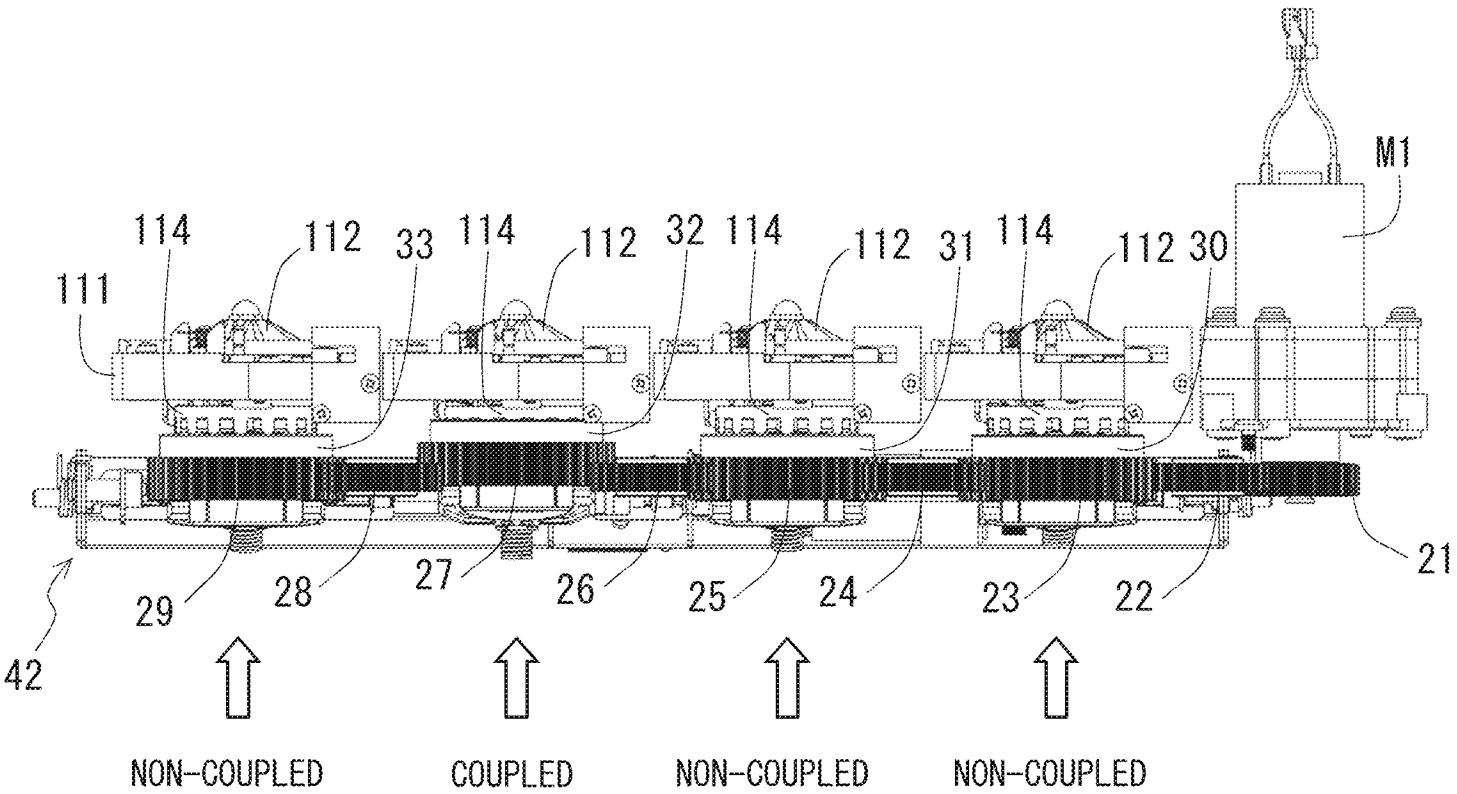
FIG. 17 is an explanatory view showing the driving/non-driving state of the first to fourth coin ejection units of the multi-unit coin ejection apparatus of FIG. 1, in which only the third coin ejection unit is in the driving state and the first, second, and fourth coin ejection units are in the non-driving state.
Figure 18:
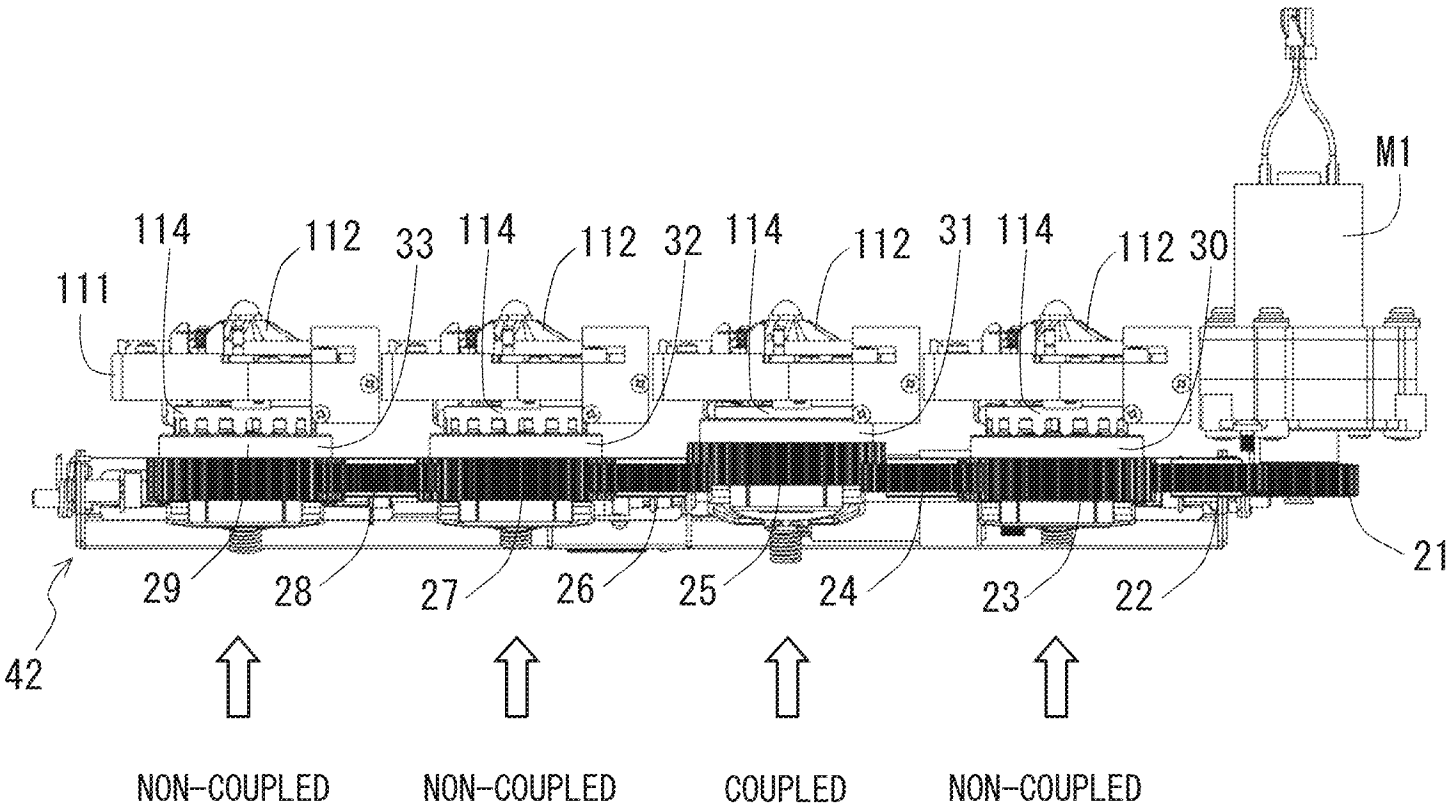
FIG. 18 is an explanatory view showing the driving/non-driving state of the first to fourth coin ejection units of the multi-unit coin ejection apparatus of FIG. 1, in which only the second coin ejection unit is in the driving state and the first, and third to fourth coin ejection units are in the non-driving state.
Figure 19:
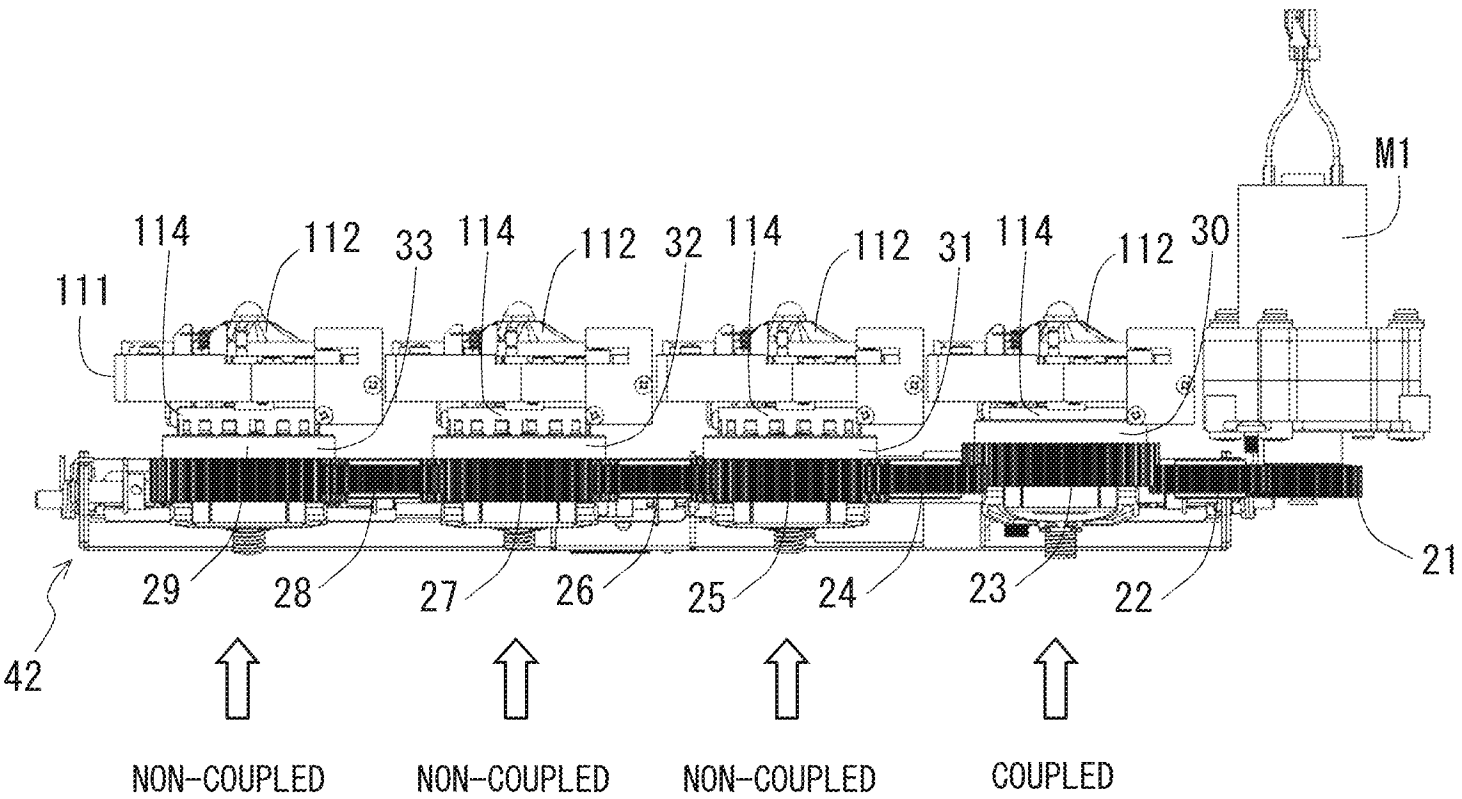
FIG. 19 is an explanatory view showing the driving/non-driving state of the first to fourth coin ejection units of the multi-unit coin ejection apparatus of FIG. 1, in which only the first coin ejection unit is in the driving state and the second to fourth coin ejection units are in the non-driving state.

In the state of FIG. 16, only the coupling gear 33 of the driving mechanism 20 corresponding to the fourth coin ejection unit 110 is displaced upward to the coupling position and only the fourth coin ejection unit 110 is in the driving state while the first to third coin ejection units 110 are in the non-driving state. In the state of FIG. 17, only the coupling gear 32 of the driving mechanism 20 corresponding to the third coin ejection unit 110 is displaced upward to the coupling position and only the third coin ejection unit 110 is in the driving state while the first, second, and fourth coin ejection units 110 are in the non-driving state. In the state of FIG. 18, only the coupling gear 31 of the driving mechanism 20 corresponding to the second coin ejection unit 110 is displaced upward to the coupling position and only the second coin ejection unit 110 is in the driving state while the first, third, and fourth coin ejection units 110 are in the non-driving state. In the state of FIG. 19, only the coupling gear 30 of the driving mechanism 20 corresponding to the first coin ejection unit 110 is displaced upward to the coupling position and only the first coin ejection unit 110 is in the driving state while the second to fourth coin ejection units 110 are in the non-driving state. In this way, any one of the first to fourth coin ejection units 110 can be selectively driven by simply changing the phase (the rotational position) of the four cams 44.

Concretely speaking, for example, in the case where a dispensing instruction for dispensing the amount of 630 YEN as the change is sent, the control device (not shown) of the multi-unit coin ejection apparatus 1 controls or operates the switching unit 40 in accordance with the dispensing instruction in the following way. Specifically, first, the first coin ejection unit 110 for ejecting coins of 500 YEN is selected as the transmission destination of the driving force of the first motor M1 and driven by the first motor M1, thereby ejecting one coin of 500 YEN, Next, the second coin ejection unit 110 for ejecting coins of 100 YEN is selected as the transmission destination of the said driving force and driven, thereby ejecting one coin of 100 YEN. Furthermore, the fourth coin ejection unit 110 for ejecting coins of 10 YEN is selected as the transmission destination of the said driving force and driven, thereby ejecting three coins of 10 YEN successively. In this way, the aforementioned dispensing instruction for the amount of 630 YEN can be executed.

In the case where the multi-unit coin ejection apparatus 1 is shifted to the "non-operable mode" from the "operable mode" in order to conduct an operation such as a detaching or exchanging operation of a desired one of the first to fourth coin ejection units 110, it is sufficient to displace relatively the switching unit 40 with respect to the driving mechanism 20 using the switching unit displacement mechanism 70 shown in FIG. 14, thereby moving the switching unit 40 to the "separation position" from the "connection position". Concretely speaking, it is sufficient for a user or a service engineer to rotate downward the lever 52 which is provided on the front side face of the chassis 11 to a predetermined limiting point shown in FIG. 14, Since the entirety of the switching unit 40 is relatively moved collectively by this action, the multi-unit coin ejection apparatus 1 can be shifted to the "non-operable mode" (see FIG. 21) from the "operable mode" (see FIGS. 16 to 19) easily and quickly by only doing so. Moreover, to return the apparatus 1 to the "operable mode" from the "non-operable mode", it is sufficient to rotate upward the lever 52 to the initial position. Since the entirety of the switching unit 40 is relatively moved collectively in the opposite direction by only doing so, the apparatus 1 is returned to the "operable mode" easily and quickly.

Next, the operation of the aforementioned unnecessary rotation prevention mechanism 80 of the multi-unit coin ejection apparatus 1 will be explained below with reference to FIGS. 23 to 29 while taking the aforementioned first coin ejection unit 110 as an example.

When the coupling gear 30 and the corresponding coupling gear 114 for the first coin ejection unit 110 are not coupled, in other words, the coupling gear 30 is placed and kept at the "non-coupling position" by the coupling gear displacement mechanism 60, these two coupling gears 30 and 114 are disengaged from each other and therefore, the unnecessary rotation prevention mechanism 80 is in the state shown in FIGS. 25A and 25B and FIGS. 27A and 27B.

In the state of FIGS. 25A and 25B and FIGS. 27A and 27B, the engaging part 117*b* of the unnecessary rotation prevention member 117 is inserted into one of the engagement holes 114*d* of the relevant coupling gear 114 and engaged therewith, in which the roller 117*d* mounted on the top end of the body 117*a* is not contacted with the underlying coupling gear 30. This is because the coupling gear 30 is disposed at the "non-coupling position" and thus, the roller 117*d* is apart from the coupling gear 30. The roller 117*d* is located at such the position as to be overlapped with the circular peripheral part of the gear 30. In this state, the engaging part 117*b*, which is disposed at the top end of the unnecessary rotation prevention member 117, is inserted into one of the engagement holes 114*d* of the relevant coupling gear 114 and engaged therewith and thus, the one-way clutch 119 is effective. Accordingly, the normal rotation of the relevant coupling gear 114 for coin ejection is prevented and at the same time, the reverse rotation of the same gear 114 is permitted. Since the rotary disk 120 of the first coin ejection unit 110 is fixed to its own rotational shaft 115 along with the relevant coupling gear 114, the disk 120 is rotated in the same direction as that of the said gear 114. For this reason, unintentional or undesired rotation of the disk 120 of the first coin ejection unit 110 placed in the non-driving state, which is usually occurs due to vibration or the like induced by the coin ejection operation in the second, third, or fourth coin ejection unit 110 placed in the driving state, can be surely prevented from occurring. This means that incorrect coin dispensing can be surely prevented.

In addition, the reason why the reverse rotation of the rotary disk 120 of the first coin ejection unit 110 in the non-driving state is permitted is that permitting the reverse rotation of the disk 120 and the coupling gear 114 is more convenient compared with preventing the same. Accordingly, it is possible to omit the one-way clutch 119 in order to prevent both of the normal and reverse rotations of the disk 112.

On the other hand, when malfunction such as coin jam occurs in the second, third, or fourth coin ejection unit 110 which is in the driving state, it is often to eliminate or solve the malfunction by rotating the rotary disk 12 of the relevant coin ejection unit 110 in the reverse direction to the coin ejection direction. In this case, the unnecessary rotation prevention mechanism 80 is effective in the first coin ejection unit 110 which is in the non-driving state and as a result, the reverse rotation of the relevant coupling disk 114 is permitted. This means that the reverse rotation of the rotary disk 120 for eliminating the malfunction in the first coin ejection unit 110 is also permitted. Thus, the aforementioned malfunction can be eliminated or solved easily by the reverse rotation of the relevant disk 120.

Figure 29:
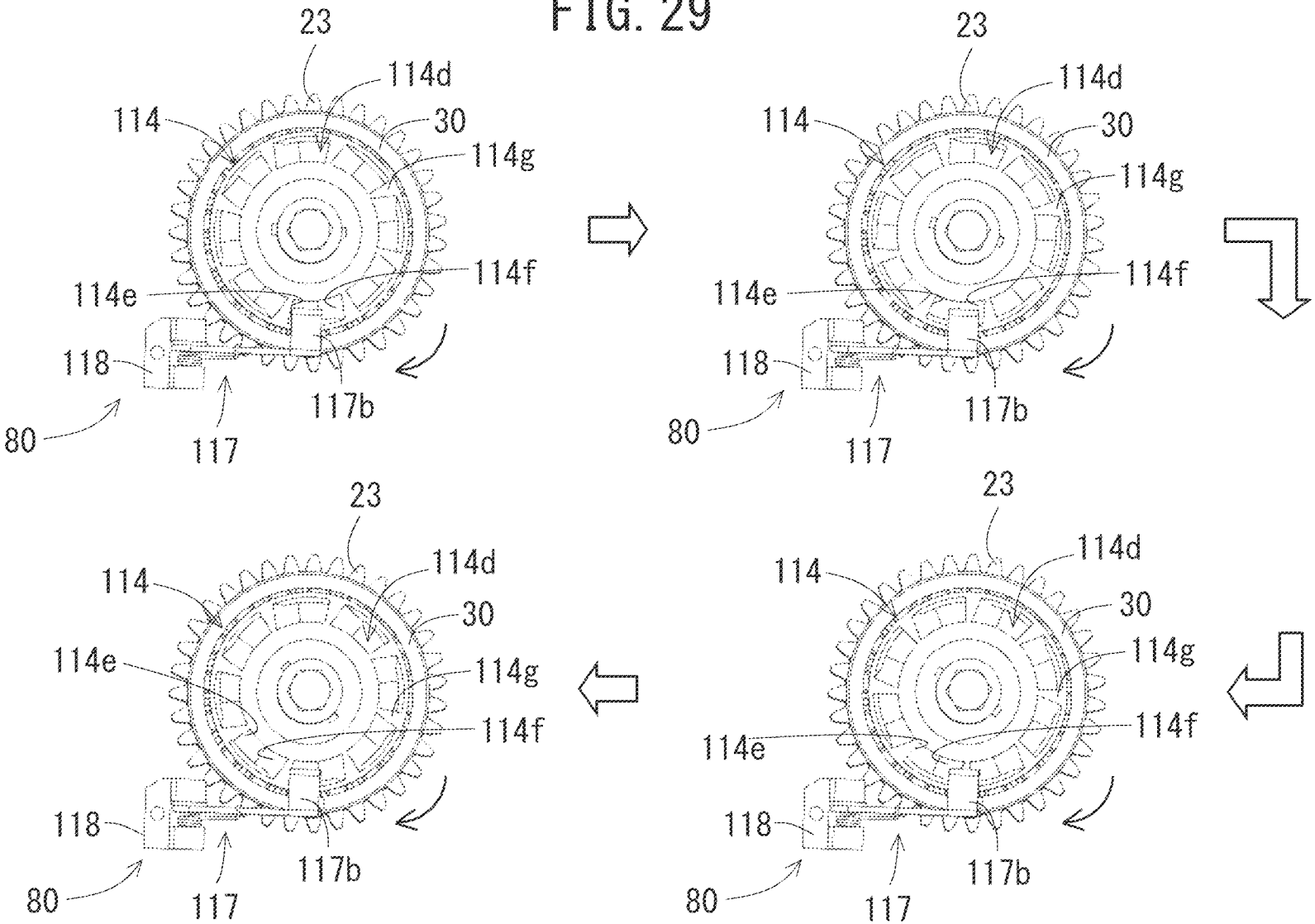
FIG. 29 is an explanatory plan view showing the change of the engagement state of the engaging part of the unnecessary rotation prevention member with an engagement hole of the corresponding coupling gear along with the rotation of the said coupling gear for realizing the function of a one-way clutch in the multi-unit coin ejection apparatus of FIG. 1, where the relevant coin ejection unit is in the non-driving state.

FIG. 29 shows the situation where the normal rotation of the coupling gear 114 for coin ejection is prevented and the reverse rotation thereof is permitted when the one-way clutch 119 is effective or enabled.

First, it is supposed that the engaging part 117*b* of the unnecessary rotation prevention member 117 is inserted into and engaged with one of the underlying engagement hole 114*d* of the relevant coupling gear 114, in other words, the said engaging part 117*b* is inserted into between the inclined end 114*f* and the perpendicular end 114*e* of the said engagement hole 114*d* and engaged therewith (see the upper left diagram in FIG. 29). When the reverse rotation of the said coupling gear 114 is slightly advanced in the direction of an arrow from this state, the said engaging part 117*b* is obliquely moved on the inclined end 114*f* of the said engagement hole 114*d*, As a result, the member 117 is slightly moved upward around the support shaft 118*a* against the elastic force of the spring 118*b* and the engaging part 117*b* is slightly raised (see the upper right diagram in FIG. 29). When the reverse rotation of the said coupling gear 114 is further advanced in the same direction, the said engaging part 117*b* reaches the top edge of the said inclined end 114*f*. As a result, the unnecessary rotation prevention member 117 is further moved upward around the support shaft 118*a* against the elastic force of the spring 118*b* and the said engaging part 117*b* is further raised (see the lower right diagram in FIG. 29). The height of the said engaging part 117*b* at this stage is the maximum. When the reverse rotation of the said coupling gear 114 is advanced in the same direction furthermore, the said engaging part 117*b* goes beyond the top edge of the said inclined end 114*f* into the adjoining next engagement hole 114*d* and is engaged therewith, in which the said engaging part 117*b* is positioned between the inclined end 114*f* and the perpendicular end 114*e* of the said next engagement hole 114*d* (see the lower left diagram in FIG. 29). The same actions as explained above are repeated in accordance with the reverse rotation of the relevant coupling gear 114. In this way, the said coupling gear 114 can be rotated in the reverse direction to the coin ejection direction.

When the said coupling gear 114 is about to rotate in the coin ejection direction (i.e., in the normal direction) in the state of the upper left or the lower left diagram in FIG. 29, the said engaging part 117*b* will abut on the perpendicular end 114*e* of the said engagement hole 114*d*. However, the perpendicular end 114*e* does not have an inclined face like the inclined end 1141 and therefore, no raising force is applied to the said engaging part 117*b*, which means that the said engaging part 117*b* will not be able to advance furthermore. In this way, the normal rotation (i.e., the rotation in the coin ejection direction) of the said coupling gear 114 is prevented.

When the coupling gear 30 and the corresponding coupling gear 114 for the first coin ejection unit 110 are coupled with each other, the coupling gear 30 is disposed at the "coupling position" by the coupling gear displacement mechanism 60. In this state, the unnecessary rotation prevention mechanism 80 is in the state as shown in FIGS. 26A and 26B and FIGS. 28A and 28B.

In the state of FIGS. 26A and 26B and FIGS. 28A and 28B, the engaging part 117*b* of the unnecessary rotation prevention member 117 is apart from of the engagement holes 114*d* of the relevant coupling gear 114, and the roller 117*d* mounted near the said engaging part 117*b* is contacted with the circular peripheral part of the underlying coupling gear 30. This is because the coupling gear 30 is moved to the "coupling position" and therefore, the said gear 30 is raised to the higher position than that at the "non-coupling position". In this state, the teeth 30*a* and the grooves 30*b* of the coupling gear 30 are respectively engaged with the grooves 114*b* and the teeth 114*a* of the corresponding coupling gear 114 and thus, the driving force of the first motor M1 is transmitted to the said coupling gear 114 by way of the coupling gear 30. Since the one-way clutch 119 (the unnecessary rotation prevention mechanism 80) is disabled or ineffective in this state, the said coupling gear 114 and the corresponding rotary disk 112 can be rotated in both of the coin ejection direction (i.e., the normal rotation direction) and in the opposite direction thereto (i.e., the reverse rotation direction). Accordingly, the rotary disk 112 of the first coin ejection unit 110 placed in the connection state can perform a desired coin ejection operation by the normal rotation and a malfunction elimination operation by the reverse rotation.

With the unnecessary rotation prevention mechanism 80 having the aforementioned structure and function, enabling (ON) and disabling (OFF) of the mechanism 80 can be realized by only the selectively shifting action of the coupling gears 30, 31, 32, and/or 33 between the "coupling position" and the "non-coupling position" using the coupling gear displacement mechanism 60 and therefore, it is unnecessary for the unillustrated control device of the multi-unit coin ejection apparatus 1 to control the operation of the unnecessary rotation prevention mechanism 80. Accordingly, there is an advantage that not only the structure and function of the mechanism 80 are highly simplified but also the control program which is incorporated into the control device of the apparatus 1 is simplified.

As explained above in detail, with the multi-unit coin ejection apparatus 1 according to the first embodiment of the present invention, the first to fourth coin ejection units 110 are structured in such a way that any one of the first to fourth coin ejection units 110 is selectively driven by switching the transmission destination of the driving force of the commonly used first motor M1 using the switching unit 40 in response to instructions. In the one of the first to fourth coin ejection units 110 which is driven in this way, in other words, to which the driving force of the first motor M1 is transmitted, a coin or coins of the corresponding denomination to an instruction is/are ejected. Accordingly, a coin or coins of a desired denomination can be ejected by selectively transmitting the driving force of the first motor M1 to one of the first to fourth coin ejection units 110 that ejects coins of the desired denomination.

Moreover, the unnecessary rotation prevention mechanism 80, which is provided in each of the first to fourth coin ejection units 110, comprises the unnecessary rotation prevention member 117 that is formed to prevent the relevant rotary disk 112 from rotating unintentionally to result in incorrect coin ejection when the relevant coin ejection unit 110 is placed in the non-driving state. The member 117 is structured in such a way as to be engaged with the engagement face 114*g* of the relevant coupling gear 114 and disengaged therefrom in response to displacement of the relevant coupling gear 30 between the coupling position and the non-coupling position. Thus, the unnecessary rotation prevention mechanism 80 can be enabled or disabled by simply shifting the relevant coin ejection unit 110 between the driving state and the non-driving state, in other words, by simply moving the relevant coupling gear 30, 31, 32, or 33 between the coupling position and the non-coupling position, using the coupling gear displacement mechanism 60. Accordingly, the state where both of the normal rotation and the reverse rotation of the relevant rotary disk 112 are possible (i.e., where the unnecessary rotation prevention mechanism 80 is disabled) and the state where the normal rotation of the relevant rotary disk 112 is prevented (i.e., where the unnecessary rotation prevention mechanism 80 is enabled) can be switched by simply displacing the relevant coupling gear 30, 31, 32, or 33 between the coupling position and the non-coupling position.

Furthermore, when the relevant coin ejection unit 110 is placed in the non-driving state where the relevant coupling gear 30, 31, 32, or 33 is disposed at the non-coupling position, the engaging part 114*d* of the unnecessary rotation prevention member 117 is engaged with one of the engagement holes 114*d* formed in the engagement face 114*g* of the relevant coupling gear 114, thereby preventing undesired normal rotation of the relevant rotary disk 112. This means that the undesired normal rotation of the relevant rotary disk 112 can be surely prevented when the relevant coin ejection unit 110 is placed in the non-driving state. Accordingly, undesired normal rotation of the relevant rotary disks 112 for incorrectly ejecting coins to result in incorrect dispensing, which is likely to be caused by vibration from the coin ejection unit 110 and/or that from outside of the coin ejection unit 110 in the driving state, can be surely prevented when the remaining coin ejection units 110 are in the non-driving state.

On the other hand, when the relevant coin ejection unit 110 is placed in the driving state where the relevant coupling gear 30, 31, 32, or 33 is disposed at the coupling position, the engaging part 117*b* of the unnecessary rotation prevention member 117 is disengaged from the engagement holes 114*d* of the relevant coupling gear 114, thereby permitting both of normal rotation and reverse rotation of the relevant rotary disk 112. This means that both of the normal rotation and the reverse rotation of the relevant rotary disk 112 can be performed when the relevant coin ejection unit 110 is placed in the driving state. Accordingly, both of normal rotation of a rotary disk 112 for ejecting desired coins and reverse rotation thereof for eliminating malfunction can be performed when a designated one of the coin ejection units 110 is in the driving state.

As described above, with the multi-unit coin ejection apparatus 1 according to the first embodiment having the structure that the coin ejection units 110 are selectively driven using the single first motor M1 in response to an instruction, both of normal rotation of the rotary disk 112 for ejecting desired coins and reverse rotation thereof for eliminating malfunction can be performed in a designated one of the first to fourth coin ejection units 110 which is in the driving state and at the same time, undesired normal rotation of the rotary disks 112 for incorrectly ejecting coins to result in incorrect dispensing can be surely prevented in the remainder of the first to fourth coin ejection units 110 which are in the non-driving state.

In addition, with the multi-unit coin ejection apparatus 1 according to the first embodiment, the function that both of the normal rotation of the rotary disk 112 for ejecting desired coins and the reverse rotation thereof for eliminating malfunction can be performed in a designated one of the first to fourth coin ejection units 110 which is in the driving state while surely preventing undesired normal rotation of the rotary disks 112 for incorrectly ejecting coins to result in incorrect dispensing in the remainder of the first to fourth coin ejection units 110 which are in the non-driving state is realized by switching the engagement and disengagement between the engaging part 117*d* of the unnecessary rotation prevention member 117 and the one of the engagement holes 114*d* formed in the engagement face 114*g* of the relevant coupling gear 114. Moreover, since the state where both of the normal rotation and the reverse rotation of the relevant rotary disk 112 are possible (i.e., the unnecessary rotation prevention mechanism 80 is disabled) and the state where the normal rotation of the relevant rotary disk 112 is prevented (i.e., the unnecessary rotation prevention mechanism 80 is enabled) can be switched by simply moving the relevant coin ejection unit 110 between the driving state and the non-driving state, there is no need to provide a dedicated mechanism or device for switching these two states. Accordingly, the aforementioned function can be realized using only a mechanical structure.

Further in addition, it is sufficient for the aforementioned mechanical structure for realizing the aforementioned function to include the engaging part 117*b* of the unnecessary rotation prevention member 117 and the one of the engagement holes 114*d* of the relevant coupling gear 114. Moreover, it is unnecessary to provide a dedicated mechanism or device for switching between the state where both of the normal rotation of the rotary disk 112 for ejecting coins and the reverse rotation thereof for eliminating malfunction can be performed and the state where the undesired normal rotation of the relevant rotary disk 112 can be surely prevented. Accordingly, the aforementioned mechanical structure is simplified, produced at low cost, unlikely to malfunction, and likely to have desired durability.

The multi-unit coin ejection apparatus 1 according to the first embodiment has the following additional advantages in addition to the aforementioned advantages:

Each of the four coupling gears 114 (the first coupling gears) has the teeth 114*a* and the grooves 114*b* formed on one side face thereof and is fixed to the rotation shaft 115 for the rotary disk 112 of the relevant coin ejection unit 110, and each of the coupling gears 30, 31, 32, and 33 (the second coupling gears) has the grooves 30*b* and the teeth 30*a* formed on one side face thereof to be engageable respectively with the teeth 114*a* and the grooves 114*b* of the corresponding coupling gear 114 and is fixed to the driven gear 23, 25, 27, or 29 (which correspond to the relevant linking gear) of the driving mechanism 20. Thus, the structure for realizing the engagement and disengagement between the four coupling gears 114 and the corresponding coupling gears 30, 31, 32, and 33 can be realized easily.

Moreover, each of the four coupling gears 114 (the first coupling gears), which is fixed to the rotation shaft 115 for the rotary disk 112 of the relevant coin ejection unit 110, has the teeth 114*a* and the grooves 114*b* which are formed on one side face thereof, and the engagement holes 114*d* which are arranged annularly in the engagement face 114*g* opposite to the side face. In addition, the engaging part 117*b* of the unnecessary rotation prevention member 117 is structured in such a way as to be engaged with any one of the engagement holes 114*d* of the relevant coupling gear 114, Thus, the unnecessary rotation prevention mechanism 80 can be realized with a very simple structure.

Moreover, since the function of the one-way clutch 119 that permits only the normal rotation of the relevant rotary disk 112, which is realized by engaging the engaging part 117*b* of the unnecessary rotation prevention member 117 with one of the engagement holes 114*d* formed in the engagement face 114*g* of the relevant first coupling gear 114, is provided, only the normal rotation of the relevant rotary disk 112 in the non-driving state can be surely prevented.

Moreover, when one of the first to fourth coin ejection units 110 displaced to the driving state from the non-driving state by the switching unit 40, the relevant unnecessary rotation prevention member 117 is moved in such a way that the engaging part 117*b* of the member 117 is disengaged from the one of the engagement holes 114*d* of the relevant first coupling gear 114 due to displacement of the relevant second coupling gear 30, 31, 32, or 33 to the coupling position from the non-coupling position, thereby losing the function of the one-way clutch 119. Thus, the normal rotation and the reverse rotation of the relevant rotary disk 112 in the driving state can be permitted with a very simple structure.

Moreover, the relevant unnecessary rotation prevention member 117 comprises the roller 117*d* which is rotatable on the engagement face 114*g* of the relevant coupling gear 114 in addition to the engaging part 117. When one of the first to fourth coin ejection units 110 is moved to the driving state from the non-driving state by the switching unit 40, the roller 117*d* of the relevant unnecessary rotation prevention member 117 is contacted with the engagement face 114*g* of the relevant first coupling gear 114 and moved such that the engaging part 117*b* of the member 117 is disengaged from one of the engagement holes 114*d* of the relevant coupling gear 114, resulting in permission of the normal rotation and the reverse rotation of the relevant rotary disk 112. The roller 117*d* which is contacted with the engagement face 114*g* of the relevant coupling gear 114 is rolled with rotation of the relevant coupling gear 114 on the engagement face 114*g* thereof. Accordingly, it is easy to enable the normal rotation and the reverse rotation of the relevant disk 112 in the coin ejection unit 110 which is moved to the driving state from the non-driving state.

Furthermore, the relevant unnecessary rotation prevention member 117*b* comprises the spring 118*b* having an elastic force that urges the engaging part 117*b* of the relevant unnecessary rotation prevention member 117 toward the engagement face 114*g* of the relevant coupling gear 114.

When the relevant coin ejection unit 110 is placed in the non-driving state, the engaging part 117*b* of the member 117 is engaged with one of the engagement holes 114*d* of the relevant coupling gear 114 by the elastic force of the spring 118*b*. When the relevant coin ejection unit 110 is placed in the driving state, the engaging part 117*b* of the member 117 is separated from the one of the engagement holes 114*d* of the relevant coupling gear 114 against the elastic force of the spring 118*b*, resulting in loss of engagement of the engaging part 117*b* of the member 117 with the one of the engagement holes 114*d* of the relevant coupling gear 114. Accordingly, the engaging part 117*b* of the member 117 and one of the engagement holes 114*d* are surely engaged by the elastic force of the spring 118*b*, which raises the reliability of the unnecessary rotation prevention mechanism 80.

Furthermore, the coupling gear displacement mechanism 60 comprises the camshaft 43 which is rotationally driven by the second motor M2, in which the camshaft 43 has the four cams 44 which are respectively assigned to the first to fourth coin ejection units 110; and the four cam followers 48 which are respectively engaged with the four coupling gears 114 and which are displaceable by the corresponding cams 44. The coupling gears 30, 31, 32, and 33 are structured in such a way as to be displaced between the coupling position and the non-coupling position according to displacements of the corresponding cam followers 48 due to rotations of the corresponding cams 44. Accordingly, the coupling gear displacement mechanism 60 can be realized with a very simple structure.

Furthermore, there are provided with the sensors 46 that detect respectively the rotational positions (or rotational angles) of the cams; 44 and which one of the coupling gears 30, 31, 32, or 33 is disposed at the coupling position is judged based on the detected rotational positions (or rotational angles) of the cams 44 by the sensors 46 and the corresponding detection members 45 fixed to the camshaft 43. Accordingly, the rotational position (rotational angle) of each of the cams 44 can be continuously detected with a simple structure and the coin ejection operation from the first to fourth coin ejection units 110 can be controlled precisely.

Furthermore, there is provided with the switching unit displacement mechanism 70 that is configured to displace the switching unit 40 between the connection position where the driving force of the first motor M1 is selectively transmittable to a designated one of the first to fourth coin ejection units 110 and the separation position where the driving force of the first motor M1 is transmittable to none of the first to fourth coin ejection units 110. The switching unit displacement mechanism 70 comprises the operating member (e.g., the lever 52) mounted on the chassis 11, and the moving member (e.g., the combination of the operating part 53 and the frame rocking member 54) that displaces mechanically the switching unit 40 between the connection position and the separation position in response to a predetermined action applied to the operating member. When a predetermined action is applied to the operating member in the state where the switching unit 40 is disposed at the connection position, the switching unit 40 is displaced to the separation position.

Accordingly, there is no need to conduct the control operation for interrupting and recoupling the selective transmission of the driving force of the first motor M1 to any one of the coin ejection units 110 using the control device (not shown) of the multi-unit coin ejection unit 1 when moving the switching unit 40 to the connection position from the separation position. In addition, after the switching unit 40 is moved to the separation position, the driving force of the first motor M1 can be transmitted to none of the first to fourth coin ejection units 110 and therefore, it is easy to detach a desired one of the first to fourth coin ejection units 110 for check and to exchange the same for a new one.

Moreover, when the switching unit 40 is moved to the separation position using the switching unit displacement mechanism 70, the multi-unit coin ejection apparatus 1 is shifted to the "non-operable mode" where the driving force of the first motor M1 is not transmitted to none of the first to fourth coin ejection units 110 and as a result, a desired one of the first to fourth coin ejection units 110 is detachable from the mounting surface 11*a* of the chassis 11. When the switching unit 40 is returned to the connection position using the switching unit displacement mechanism 70, the apparatus 1 is shifted to the "operable mode" where the driving force of the first motor M1 is transmitted to any one of the first to fourth coin ejection units 110. Accordingly, removal or exchange of these four coin ejection units 110 can be carried out easily according to the necessity by sliding a desired one of the units 110 along the mounting surface 11*a*.

Furthermore, the switching unit displacement mechanism 70 is structured in such a way as to be rockable around the shaft 41 which is supported by the chassis 11 and the operable mode where the driving force of the first motor M1 is selectively transmitted to a designated one of the first to fourth coin ejection units 110 and the non-operable mode where the driving force of the first motor M1 is transmitted to none of these units 110 are switched by rocking the coupling gear displacement mechanism 60 around the shaft 41. Accordingly, the switching operation between the operable mode and the non-operable mode can be easily and quickly.

Second Embodiment

Next, a coin ejection apparatus having a coin ejection unit according to a second embodiment of the present invention will be explained below.

Unlike the aforementioned multi-unit coin ejection apparatus 1 according to the first embodiment, the coin ejection apparatus according to the second embodiment has a single coin ejection unit 110 which is mounted on the mounting surface 11*a* of the base 11. The single coin ejection unit 110 is selectively driven according to whether or not the driving force of the first motor M1 is transmitted to the said unit 110 by displacing the coupling gear 30 between the coupling position and the non-coupling position using the switching unit 40. Thus, the coin ejection unit 110 is switchable between the driving state and the non-driving state in response to instructions.

The overall structure of the coin ejection apparatus according to the second embodiment corresponds to the structure obtained by (a) removing the second to fourth coin ejection units 110 and their coin storing containers 120, (b) reducing the lengths of the chassis 11 and the switching unit 40 (which includes the frame 42 and the camshaft 43) in such a way as to be matched with the length of the first coin ejection unit 110, (c) removing the driven gears 25, 27, and 29 and the intermediate gears 24, 26, and 28 from the driving mechanism 20, and (d) removing the three cams 44, the three sensors 46, and the three detection members 45 from the switching unit 40, The unnecessary rotation prevention mechanism 80 is kept unchanged in the second embodiment.

Thus, the structure of the coin ejection apparatus of the second embodiment corresponds to the structure obtained by reducing the count of four in the aforementioned multi-unit coin ejection apparatus 1 according to the first embodiment to unity, and the function of the second embodiment is approximately the same as that of the first embodiment. Accordingly, it is apparent that the coin ejection apparatus of the second embodiment has approximately the same advantages as those of the coin ejection apparatus 1 according to the first embodiment.

Specifically, both of the normal rotation of the rotary disk 112 in the coin ejection unit 110 for ejecting desired coins and the reverse rotation thereof for eliminating malfunction can be performed in the driving state, and undesired normal rotation of the said disk 112 for incorrectly ejecting coins to result in incorrect dispensing can be surely prevented in the non-driving state.

In addition, the state where both of the normal and reverse rotations of the rotary disk 112 are possible (i.e., where the unnecessary rotation prevention mechanism 80 is disabled) and the state where normal rotation of the said disk 112 is prevented (i.e., where the unnecessary rotation prevention mechanism 80 is enabled) can be switched by simply moving the coupling gear 30 between the coupling position and the non-coupling position.

Moreover, the function that the normal and reverse rotations of the rotary disk 112 can be performed in the driving state and the undesired normal rotation of the said disk 112 for incorrectly ejecting coins can be surely prevented in the non-driving state can be realized using only a mechanical structure, in which the said mechanical structure is simplified, produced at low cost, unlikely to malfunction, and likely to have desired durability.

Modifications

The aforementioned first and second embodiments are exemplary embodied examples of the present invention. Thus, it is needless to say that the present invention is not limited to these embodiments and any other modification is applicable to the embodiments without departing the spirit of the invention.

For example, in the aforementioned first and second embodiments, to constitute the unnecessary rotation prevention mechanism 80 provided in each of the first to fourth coin ejection units 110, the unnecessary rotation prevention member 117 that prevents the relevant rotary disks 112 in the non-driving state from unintentionally rotating to result in incorrect dispensing is provided, and the engagement and disengagement between the unnecessary rotation prevention member 117 and the engagement face 114*g* of the relevant coupling gear 114 are switched in response to the shift of the relevant coin ejection unit 110 between the driving state and the non-driving state. However, the present invention is not limited to this. Any structure may be used for this purpose if it can prevent the normal rotation of the rotary disk 112 when the coin ejection unit 110 is in the non-driving state and a the same time, it can permit the normal and reverse rotations of the said disk 112 when the coin ejection unit 110 is in the driving state.

Moreover, in the aforementioned first and second embodiments, the unnecessary rotation prevention mechanism 80 comprises the function of the one-way clutch 119; however, both of the normal and reverse rotations of the relevant rotary disk 112 may be prevented when the relevant coin ejection unit 110 is in the non-driving state without providing the function of the one-way clutch 119.

Moreover, in the aforementioned first and second embodiments, the coupling gears 30, 31, 32, and 33 each of which has the teeth 30*a* and the grooves 30*b* on one side face thereof as shown in FIGS. 11A to 110 and the four coupling gears 114 each of which has the teeth 114*a* and the grooves 114*b* on one side face thereof as shown in FIGS. 13A and 13B are used; however, the present invention is not limited to this. Any coupling gear having a different structure from that of these coupling gears 30, 31, 32, and 33 and 114 may be used for this purpose if it can transmit the driving force of the first motor M1 to the side of the coin ejection unit or units 110 from the side of the driving mechanism 20.

Moreover, in the aforementioned first and second embodiments, the coupling gear displacement mechanism 60 comprises the camshaft 43 which is rotatably driven by the second motor M2 and to which the four corns 44 are fixed, and the four cam followers 48 which are displaced by the corresponding cams 44; however, the present invention is not limited to this. Any structure different from the said structure including the camshaft 43 and the cam follower 48 may be used if it realizes desired displacement operation of the coupling gear(s) 30, 31, 32, and/or 33 and/or that of the coupling gear(s) 114.

Moreover, there is no restriction on the structure of the coin ejection units 110. Any coin ejection unit having any structure may be used if it can dispense coins as desired using the rotation of a rotary disk 112.

Moreover, in the aforementioned first and second embodiments, the switching unit displacement mechanism 70 comprises the lever 52 fixed to the chassis 1, and the operating member 53 and the frame rocking member 54 that displace relatively the switching unit 40 with respect to the driving unit 20 between the connection position and the separation position in response to a predetermined action applied to the lever 52. However, the present invention is not limited to this. It is needless to say that the switching unit displacement mechanism 70 may have any other structure than this if it can displace relatively the switching unit 40 between the connection or transmittable position and the separation or non-transmittable position with respect to the driving unit 20.

INDUSTRIAL APPLICABILITY

The coin ejection apparatus, which has one or more coin ejection units, according to the present invention is applicable not only to coins as currency but also to coin equivalents such as token and medals. Moreover, the coin ejection apparatus according to the present invention is applicable not only to any coin depositing/dispensing apparatus but also to any coin processing apparatus that necessitates selective ejection of coins of desired denominations.

While the preferred forms of the present invention have been described, it is to be understood that modifications will be apparent to those skilled in the art without departing from the spirit of the invention. The scope of the present invention, therefore, is to be determined solely by the following claims.

What is claimed is:

1. A multi-unit coin ejection apparatus comprising:

a base having a mounting surface;

coin ejection units mounted on the mounting surface, each of the coin ejection units having a rotary disk;

a first motor for driving the coin ejection units;

a driving mechanism that is configured to drive the coin ejection units by transmitting a driving force of the first motor using gears;

a switching unit that is configured to switch a destination of the driving force of the first motor, thereby selectively driving a desired one of the rotary disks of the coin ejection units; and an unnecessary rotation prevention mechanism, provided in each of the coin ejection units, that is configured to prevent unnecessary normal rotation of a corresponding one of the rotary disks of the coin ejection units;

wherein the switching unit comprises (i) first coupling gears which are respectively provided for the coin ejection units, (ii) second coupling gears which are engageable with the corresponding first coupling gears and which are provided for the driving mechanism, and (iii) a coupling gear displacement mechanism that is configured to displace the second coupling gears between a coupling position and a non-coupling position;

the coupling gear displacement mechanism is operated in response to an instruction such that a designated one of the coin ejection units is placed in a driving state where a designated one of the second coupling gears is disposed at the coupling position and that a remainder of the coin ejection units is/are placed in a non-driving state where a remainder of the second coupling gears is/are disposed at the non-coupling position;

the unnecessary rotation prevention mechanism comprises an unnecessary rotation prevention member that is formed to prevent the relevant rotary disk from normally rotating to result in incorrect coin ejection when the relevant coin ejection unit is placed in the non-driving state;

the unnecessary rotation prevention member is configured to be engaged with the relevant first coupling gear or disengaged therefrom in response to displacement of the relevant second coupling gear between the coupling position and the non-coupling position;

when the relevant coin ejection unit is placed in the non-driving state, an engaging or engaged part of the unnecessary rotation prevention member is engaged with one or more engaged or engaging parts of the relevant first coupling gear, thereby preventing normal rotation of the relevant rotary disk; and when the relevant coin ejection unit is placed in the driving state, the engaging or engaged part of the unnecessary rotation prevention member is disengaged from the one or more engaged or engaging parts of the relevant first coupling gear, thereby permitting normal rotation and reverse rotation of the relevant rotary disk.

2. The apparatus according to claim 1, wherein each of the first coupling gears is formed by a first gear which has teeth and grooves formed on one side face thereof and which is fixed to a rotation shaft for the rotary disk of the relevant coin ejection unit; and each of the second coupling gears is formed by a second gear which has grooves and teeth formed on one side face thereof to be engageable respectively with the teeth and the grooves of the first gear and which is fixed to a relevant linking gear of the driving mechanism.

3. The apparatus according to claim 1, wherein each of the first coupling gears comprises teeth and grooves formed on one side face thereof and is fixed to a rotation shaft for the rotary disk of the relevant coin ejection unit;

the relevant first coupling gear comprises an engagement face on or in which the engaged or engaging parts are arranged annularly along a rotation direction of the relevant first coupling gear; and the engaging or engaged part of the unnecessary rotation prevention member is configured to be engaged with any one of the engaged or engaging parts of the relevant first coupling gear when the relevant coin ejection unit is placed in the non-driving state.

4. The apparatus according to claim 1, wherein a function of a one-way clutch that permits only normal rotation of the relevant rotary disk is generated by engaging the engaging or engaged part of the unnecessary rotation prevention member with the one or more engaged or engaging parts which is/are formed on or in an engagement face of the relevant first coupling gear.

5. The apparatus according to claim 1, wherein in each of the coin ejection units placed in the non-driving state, a function of a one-way clutch that prevents only normal rotation of the relevant rotary disk is generated by engaging the engaging or engaged part of the relevant unnecessary rotation prevention member with the one or more engaged or engaging parts which is/are formed on or in an engagement face of the relevant first coupling gear; and when the relevant coin ejection unit is moved to the driving state from the non-driving state by the switching unit, the relevant unnecessary rotation prevention member is moved such that the engaging or engaged part of the relevant unnecessary rotation prevention member is disengaged from the one or more engaged or engaging parts of the relevant first coupling gear due to displacement of the relevant second coupling gear to the coupling position from the non-coupling position, resulting in loss of the function of the one-way clutch.

6. The apparatus according to claim 1, wherein the relevant unnecessary rotation prevention member comprises a roller which is contactable with the relevant second coupling gear and rotatable thereon;

when one of the coin ejection units is moved to the driving state from the non-driving state by the switching unit, the relevant unnecessary rotation prevention member is moved by displacement of the relevant second coupling gear to the coupling position from the non-coupling position such that the engaging or engaged part of the relevant unnecessary rotation prevention member is disengaged from the one or more engaged or engaging parts of the relevant first coupling gear, thereby permitting both of normal rotation and reverse rotation of the relevant rotary disk; and the roller which is in contact with the relevant second coupling gear is rolled with rotation of the relevant second coupling gear while permitting both of normal rotation and reverse rotation of the relevant rotary disk.

7. The apparatus according to claim 1, wherein the relevant unnecessary rotation prevention member comprises a spring having an elastic force that urges the engaging or engaged part of the relevant unnecessary rotation prevention member toward the relevant first coupling gear;

when the relevant coin ejection unit is placed in the non-driving state, the engaging or engaged part of the relevant unnecessary rotation prevention member is engaged with the one or more engaged or engaging parts of the relevant first coupling gear by the elastic force of the spring; and when the relevant coin ejection units is placed in the driving state, the engaging or engaged part of the relevant unnecessary rotation prevention member is disengaged from the one or more engaged or engaging parts of the relevant first coupling gear by displacement of the relevant second coupling gear to the coupling position from the non-coupling position against the elastic force of the spring, resulting in permission of both of normal rotation and reverse rotation of the relevant rotary disk.

8. The apparatus according to claim 1, wherein the coupling gear displacement mechanism comprises a camshaft which is rotationally driven by a second motor, wherein the camshaft has cams which are respectively assigned to the coin ejection units; and cam followers which are respectively engaged with the second coupling gears and which are displaceable by the corresponding cams;

wherein the second coupling gears are configured to be displaced between the coupling position and the non-coupling position according to displacements of the corresponding cam followers which are respectively caused by rotations of the corresponding cams.

9. The apparatus according to claim 1, further comprising sensors that detect respectively rotational positions of the cams; and which one of the second coupling gears is disposed at the coupling position is judged based on the detected rotational positions of the cams using the sensors.

10. The apparatus according to claim 1, wherein detection members are fixed to the camshaft in a one-by-one correspondence to the cams;

sensors that detect respectively rotational positions of the detection members are provided at corresponding positions to the detection members; and which one of the second coupling gears is disposed at the coupling position is judged based on detection of the detection members by the corresponding sensors.

11. The apparatus according to claim 1, further comprising a switching unit displacement mechanism that is configured to displace the switching unit between a connection position where the driving force of the first motor is selectively transmittable to a designated one of the coin ejection units and a separation position where the driving force of the first motor is transmittable to none of the coin ejection units;

the switching unit displacement mechanism comprises an operating member mounted on the base, and a moving member that displaces mechanically the switching unit between the connection position and the separation position in response to a predetermined action applied to the operating member; and when a predetermined action is applied to the operating member in the state where the switching unit is disposed at the connection position, the switching unit is displaced to the separation position.

12. The apparatus according to claim 11, wherein when the switching unit is displaced to the separation position from the connection position using the switching unit displacement mechanism, the said apparatus is shifted to a non-operable mode where the driving force of the first motor is transmitted to none of the coin ejection units, wherein a desired one of the coin ejection units can be removed from the base; and when the switching unit is returned to the connection position from the separation position using the switching unit displacement mechanism, the said apparatus is shifted to an operable mode where the driving force of the first motor is selectively transmitted to a desired one of the coin ejection units.

13. The apparatus according to claim 11, wherein the operating member of the switching unit displacement mechanism comprises a manually operable lever which is mounted on the base;

the moving member of the switching unit displacement mechanism is configured to be mechanically connected to the switching unit and to be moved by a manual operation applied to the lever; and when a predetermined manual operation is applied to the lever, the switching unit is displaced mechanically between the connection position and the separation position in response to the applied manual operation.

14. The apparatus according to claim 1, wherein the coupling gear displacement mechanism is configured to be rockable around a shaft which is supported by the base; and an operable mode where the driving force of the first motor is selectively transmitted to a desired one of the coin ejection units and a non-operable mode where the driving force of the first motor is transmitted to none of the coin ejection units are switched by rocking the coupling gear displacement mechanism around the shaft.

15. The apparatus according to claim 1, wherein a non-operable mode where the driving force of the first motor is transmitted to none of the coin ejection units is provided in addition to an operable mode where the driving force of the first motor is selectively transmitted to a desired one of the coin ejection units are provided; and the coin ejection units are configured to be detachable from the base by sliding a desired one or ones of the coin ejection units along the mounting surface in the separation mode.

16. A coin ejection apparatus comprising:

a base having a mounting surface;

a coin ejection unit mounted on the mounting surface, the coin ejection unit having a rotary disk;

a first motor for driving the coin ejection unit;

a driving mechanism that is configured to drive the coin ejection unit by transmitting a driving force of the first motor using gears;

a switching unit that is configured to switch between a driving state where the driving force of the first motor is transmitted to the coin ejection unit and a non-driving state where the driving force of the first motor is not transmitted to the coin ejection unit, thereby selectively driving the coin ejection unit; and an unnecessary rotation prevention mechanism, provided in the coin ejection unit, that is configured to prevent unnecessary normal rotation of the rotary disk;

wherein the switching unit comprises (i) a first coupling gear which is provided for the coin ejection unit, (ii) a second coupling gear which is engageable with the first coupling gear and which is provided for the driving mechanism, and (iii) a coupling gear displacement mechanism that is configured to displace the second coupling gear between a coupling position and a non-coupling position;

the coupling gear displacement mechanism is operated in response to an instruction such that the coin ejection unit is placed in the driving state where the second coupling gear is disposed at the coupling position or in the non-driving state where the second coupling gear is disposed at the non-coupling position;

the unnecessary rotation prevention mechanism comprises an unnecessary rotation prevention member that is formed to prevent the rotary disk from normally rotating to result in incorrect coin ejection when the coin ejection unit is placed in the non-driving state;

the unnecessary rotation prevention member is configured to be engaged with the first coupling gear or disengaged therefrom in response to displacement of the second coupling gear between the coupling position and the non-coupling position;

when the coin ejection unit is placed in the non-driving state, an engaging or engaged part of the unnecessary rotation prevention member is engaged with one or more engaged or engaging parts of the first coupling gear, thereby preventing normal rotation of the rotary disk; and when the coin ejection unit is placed in the driving state, the engaging or engaged part of the unnecessary rotation prevention member is disengaged from the one or more engaged or engaging parts of the first coupling gear, thereby permitting normal rotation and reverse rotation of the rotary disk.

17. The apparatus according to claim 16, wherein the first coupling gear is formed by a first gear which has teeth and grooves formed on one side face thereof and which is fixed to a rotation shaft for the rotary disk of the coin ejection unit, and the second coupling gear is formed by a second gear which has grooves and teeth formed on one side face thereof to be engageable respectively with the teeth and the grooves of the first gear and which is fixed to a linking gear of the driving mechanism.

18. The apparatus according to claim 16, wherein the first coupling gear comprises teeth and grooves formed on one side face thereof and is fixed to a rotation shaft for the rotary disk;

the first coupling gear comprises an engagement face on or in which the engaged or engaging parts are arranged annularly along a rotation direction of the first coupling gear; and the engaging or engaged part of the unnecessary rotation prevention member is configured to be engaged with any one of the engaged or engaging parts of the first coupling gear when the coin ejection unit is placed in the non-driving state.

19. The apparatus according to claim 16, wherein a function of a one-way clutch that permits only normal rotation of the rotary disk is generated by engaging the engaging or engaged part of the unnecessary rotation prevention member with the one or more engaged or engaging parts which is/are formed on or in the engagement face of the first coupling gear.

20. The apparatus according to claim 16, wherein when the coin ejection unit is placed in the non-driving state, a function of a one-way clutch that prevents only normal rotation of the rotary disk is generated by engaging the engaging or engaged part of the relevant unnecessary rotation prevention member with the one or more engaged or engaging parts which is/are formed on or in an engagement face of the relevant first coupling gear; and when the coin ejection unit is moved to the driving state from the non-driving state by the switching unit, the unnecessary rotation prevention member is moved such that the engaging or engaged part of the relevant unnecessary rotation prevention member is disengaged from the one or more engaged or engaging parts of the first coupling gear due to displacement of the second coupling gear to the coupling position from the non-coupling position, resulting in loss of the function of the one-way clutch.

* * * * *